US011980991B2

(12) United States Patent
Tabushi et al.

(10) Patent No.: US 11,980,991 B2
(45) Date of Patent: May 14, 2024

(54) ELECTRIC POWER TOOL

(71) Applicant: MAKITA CORPORATION, Anjo (JP)

(72) Inventors: Kenichi Tabushi, Anjo (JP); Akira Mizutani, Anjo (JP); Ken Goto, Anjo (JP); Kenji Shibata, Anjo (JP); Hideharu Muto, Anjo (JP); Satoshi Ninagawa, Anjo (JP); Junya Ishikawa, Anjo (JP); Takafumi Kotsuji, Anjo (JP)

(73) Assignee: MAKITA CORPORATION, Anjo (JP)

( * ) Notice: Subject to any disclaimer, the term of this patent is extended or adjusted under 35 U.S.C. 154(b) by 687 days.

(21) Appl. No.: 17/265,164

(22) PCT Filed: Aug. 1, 2019

(86) PCT No.: PCT/JP2019/030357
§ 371 (c)(1),
(2) Date: Feb. 1, 2021

(87) PCT Pub. No.: WO2020/031866
PCT Pub. Date: Feb. 13, 2020

(65) Prior Publication Data

US 2021/0299813 A1 Sep. 30, 2021

(30) Foreign Application Priority Data

Aug. 7, 2018 (JP) ..... 2018-148937

(51) Int. Cl.
*B24B 23/02* (2006.01)

(52) U.S. Cl.
CPC ..... *B24B 23/028* (2013.01)

(58) Field of Classification Search
CPC ..... B24B 55/04; B24B 55/05; B24B 55/052; B24B 55/06; B24B 55/10; B24B 55/102;
(Continued)

(56) References Cited

U.S. PATENT DOCUMENTS

2003/0190877 A1* 10/2003 Gallagher ..... B24B 55/00 451/344
2005/0215186 A1 9/2005 Stierle et al.
(Continued)

FOREIGN PATENT DOCUMENTS

CN 1476959 A 2/2004
CN 202910699 U 5/2013
(Continued)

OTHER PUBLICATIONS

Jun. 29, 2023 Office Action issued in Chinese Patent Application No. 201980052101.4.
(Continued)

*Primary Examiner* — Brian D Keller
*Assistant Examiner* — Tim Brady
(74) *Attorney, Agent, or Firm* — Oliff PLC

(57) ABSTRACT

An electric power tool disclosed herein may include a motor; a power transmission mechanism connected to the motor; a housing that houses the motor and the power transmission mechanism; a tip tool holder connected to the power transmission mechanism; a cover covering the tip tool holder partially; a first locking mechanism configured to switch between a first locking state and a first unlocked state; and a second locking mechanism configured to switch between a second locking state and a second unlocked state. In the electric power tool, the cover may become detachable from the housing when the user performs the second unlocking operation on the second locking mechanism and the first unlocking operation on the first locking mechanism.

19 Claims, 44 Drawing Sheets

(58) Field of Classification Search
CPC ... B24B 55/055; B24B 55/105; B24B 23/028; B24B 27/06; B24B 27/08; B25F 5/00
USPC ..... 451/357–361, 370, 378, 431, 451, 455, 451/458
See application file for complete search history.

(56) References Cited

U.S. PATENT DOCUMENTS

| | | | | |
|---|---|---|---|---|
| 2009/0019899 | A1 | 1/2009 | Boeck et al. | |
| 2009/0036044 | A1 | 2/2009 | Boeck et al. | |
| 2009/0098812 | A1 | 4/2009 | Boeck et al. | |
| 2009/0100885 | A1 | 4/2009 | Boeck et al. | |
| 2009/0130961 | A1 | 5/2009 | Boeck et al. | |
| 2009/0209184 | A1* | 8/2009 | Esenwein | B24B 55/052 451/451 |
| 2012/0034855 | A1 | 2/2012 | Boeck et al. | |
| 2012/0231710 | A1 | 9/2012 | Boeck et al. | |
| 2012/0295524 | A1 | 11/2012 | Numata | |
| 2013/0000935 | A1* | 1/2013 | Kelleher | B23Q 11/08 173/46 |
| 2013/0157550 | A1* | 6/2013 | Ikuta | B24B 23/028 451/451 |
| 2013/0165030 | A1 | 6/2013 | Copeland, Jr. et al. | |
| 2014/0349556 | A1 | 11/2014 | Zhang et al. | |
| 2015/0016814 | A1 | 1/2015 | Kuroiwa | |
| 2015/0075830 | A1 | 3/2015 | Zhang et al. | |
| 2015/0151403 | A1 | 6/2015 | Copeland, Jr. et al. | |
| 2016/0039068 | A1 | 2/2016 | Morris et al. | |
| 2016/0193713 | A1 | 7/2016 | Takeda | |
| 2017/0320192 | A1* | 11/2017 | Herchek | B24B 23/028 |
| 2018/0236634 | A1* | 8/2018 | Chen | B24B 55/052 |
| 2018/0250536 | A1 | 9/2018 | Shigematsu et al. | |
| 2018/0326554 | A1 | 11/2018 | Schadow et al. | |

FOREIGN PATENT DOCUMENTS

| | | | |
|---|---|---|---|
| CN | 103182704 | A | 7/2013 |
| CN | 104280983 | A | 1/2015 |
| CN | 107530561 | A | 1/2018 |
| DE | 102006053305 | A1 | 5/2008 |
| JP | 2000-135687 | A | 5/2000 |
| JP | 2010-273942 | A | 12/2010 |
| JP | 2012-240127 | A | 12/2012 |
| JP | 2013-144351 | A | 7/2013 |
| WO | 2015/029659 | A1 | 3/2015 |
| WO | 2017/092947 | A1 | 6/2017 |

OTHER PUBLICATIONS

Apr. 19, 2022 Office Action issued in Japanese Patent Application No. 2018-148937.

Sep. 10, 2019 International Search Report issued in International Patent Application No. PCT/JP2019/030357.

Sep. 10, 2019 Written Opinion of the International Searching Authority issued in International Patent Application No. PCT/JP2019/030357.

* cited by examiner

ELECTRIC POWER TOOL

TECHNICAL FIELD

The technique disclosed herein relates to an electric power tool.

BACKGROUND ART

Japanese Patent Application Publication No. 2000-135687 describes an electric power tool including: a motor; a power transmission mechanism connected to the motor; a housing that houses the motor and the power transmission mechanism; a tip tool holder connected to the power transmission mechanism; a cover covering at least a part of the tip tool holder; a locking mechanism configured to switch between a locking state and an unlocked state and switching from the locking state to the unlocked state in response to an unlocking operation by a user. In this electric power tool, the cover becomes detachable from the housing when the user performs the unlocking operation on the locking mechanism.

SUMMARY OF INVENTION

Technical Problem

In a configuration where only a single locking mechanism prohibits detachment of a cover from a housing, the cover may be unintentionally detached from the housing due to an operation being erroneously performed on the locking mechanism. The disclosure herein provides a technique that reliably prevents a cover from being unintentionally detached from a housing.

Solution to Technical Problem

The disclosure herein discloses an electric power tool. The electric power tool may comprise: a motor; a power transmission mechanism connected to the motor; a housing that houses the motor and the power transmission mechanism; a tip tool holder connected to the power transmission mechanism; a cover covering at least a part of the tip tool holder; a first locking mechanism configured to switch between a first locking state and a first unlocked state, wherein the first locking mechanism switches from the first locking state to the first unlocked state in response to a first unlocking operation by a user; and a second locking mechanism configured to switch between a second locking state and a second unlocked state, wherein the second locking mechanism switches from the second locking state to the second unlocked state in response to a second unlocking operation by the user. In the electric power tool, the cover may become detachable from the housing when the user performs the second unlocking operation on the second locking mechanism and the first unlocking operation on the first locking mechanism.

According to the above configuration, the cover will not be detached from the housing unless the first unlocking operation is performed on the first locking mechanism and the second unlocking operation is performed on the second locking mechanism. Therefore, even when the first unlocking operation is accidentally performed on the first locking mechanism, the cover cannot be detached from the housing unless the second unlocking operation is performed on the second locking mechanism. On the contrary, even when the second unlocking operation is accidentally performed on the second locking mechanism, the cover cannot be detached from the housing unless the first unlocking operation is performed on the first locking mechanism. According to the above configuration, it is possible to reliably prevent the cover from being unintentionally detached from the housing.

DESCRIPTION OF EMBODIMENTS

Figure 1:
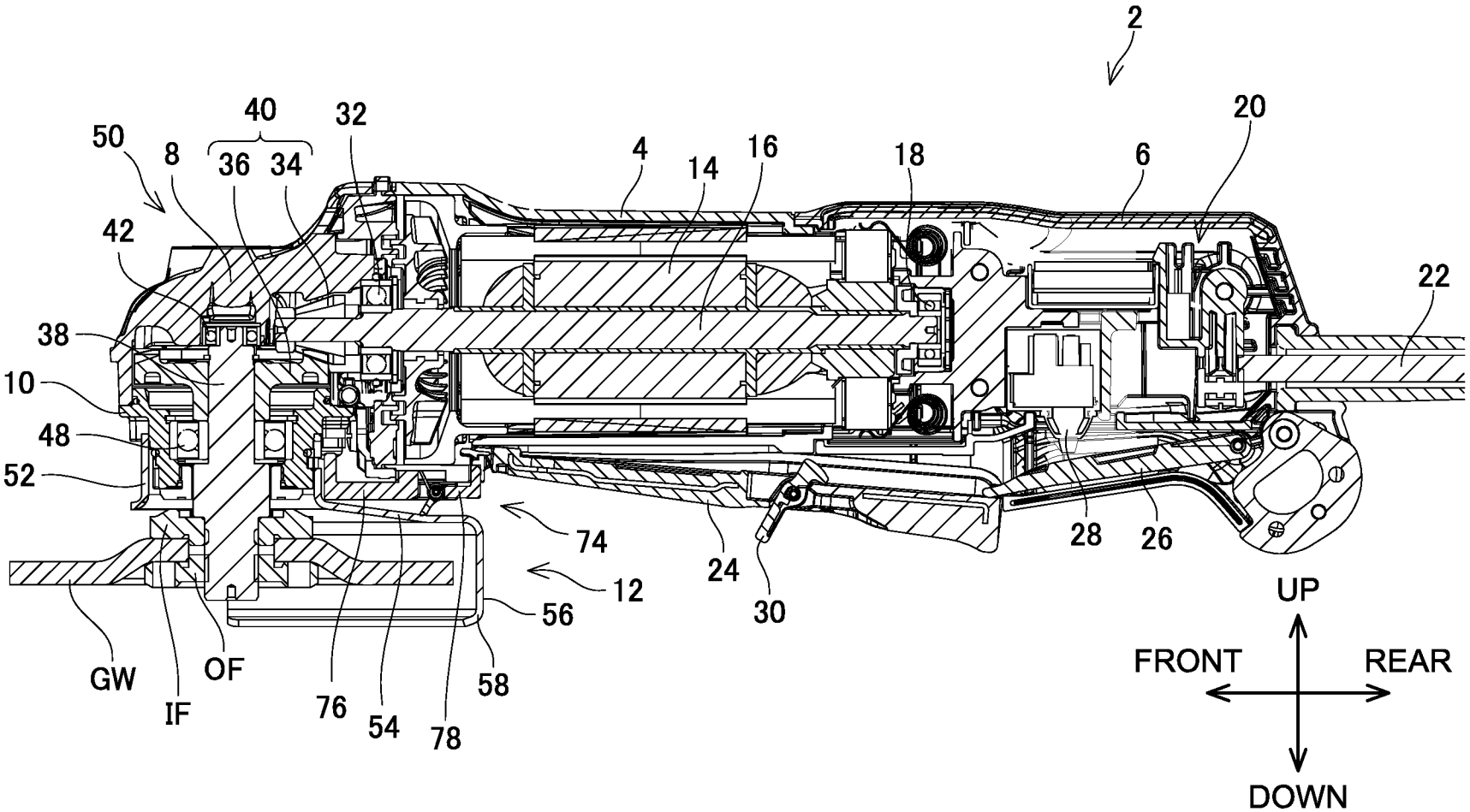
FIG. 1 is a longitudinal sectional view of a grinder 2 according to a first embodiment.

Representative, non-limiting examples of the present disclosure will now be described in further detail with reference to the attached drawings. This detailed description is merely intended to teach a person of skill in the art further details for practicing preferred aspects of the present teachings and is not intended to limit the scope of the disclosure. Furthermore, each of the additional features and teachings disclosed below may be utilized separately or in conjunction with other features and teachings to provide improved electric power tools, as well as methods for using and manufacturing the same.

Moreover, combinations of features and steps disclosed in the following detailed description may not be necessary to practice the disclosure in the broadest sense, and are instead taught merely to particularly describe representative examples of the disclosure. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, an electric power tool may comprise a motor; a power transmission mechanism connected to the motor; a housing that houses the motor and the power transmission mechanism; a tip tool holder connected to the power transmission mechanism; a cover covering at least a part of the tip tool holder; a first locking mechanism configured to switch between a first locking state and a first unlocked state, wherein the first locking mechanism switches from the first state to the first unlocked state in response to a first unlocking operation by a user; and a second locking mechanism configured to switch between a second locking state and a second unlocked state, wherein the second locking mechanism switches from the second locking state to the second unlocked state in response to a second unlocking operation by the user. In the electric power tool, the cover may become detachable from the housing when the user performs the second unlock operation on the second locking mechanism and the first unlocking operation on the first locking mechanism.

According to the above configuration, the cover will not be detached from the housing unless the first unlocking operation is performed on the first locking mechanism and the second unlocking operation is performed on the second locking mechanism. Therefore, even when the first unlocking operation is accidentally performed on the first locking mechanism, the cover cannot be detached from the housing unless the second unlocking operation is performed on the second locking mechanism. On the contrary, even when the second unlocking operation is accidentally performed on the second locking mechanism, the cover cannot be detached from the housing unless the first unlocking operation is performed on the first locking mechanism. According to the above configuration, it is possible to reliably prevent the cover from being unintentionally detached from the housing.

In one or more embodiments, the first locking mechanism may be configured to prohibit the cover from being detached from the housing in the first locking state, and allow the cover to be detached from the housing in the first unlocked state. The second locking mechanism may be configured to prohibit the first locking mechanism from switching from the first locking state to the first unlocked state in the second locking state, and allow the locking mechanism to switch from the first locking state to the first unlocked state in the second unlocked state.

According to the above configuration, the first unlocking operation cannot be performed on the first locking mechanism unless the second unlocking operation is performed on the second locking mechanism. Further, even when the second unlocking operation is performed on the second locking mechanism, the cover cannot detached from the housing unless the first unlocking operation is performed on the first locking mechanism. According to the above configuration, it is possible to reliably prevent the cover from being unintentionally detached from the housing.

In one or more embodiments, the first locking mechanism may include a first slidable member supported by the housing so as to be movable in a first sliding direction that is substantially orthogonal to a rotation axis of the tip tool holder. When the first locking mechanism is in the first locking state, the first slidable member may be at a first locking position at which the first slidable member engages with the cover. When the first locking mechanism is in the first unlocked state, the first slidable member may be at a first unlocked position at which the first slidable member does not engage with the cover. In response to the first unlocking operation by the user, the first slidable member may move from the first locking position to the first unlocked position. The second locking mechanism may be configured to prohibit the first slidable member from moving from the first locking position to the first unlocked position in the second locking state, and allow the first slidable member to move from the first locking position to the first unlocked position in the second unlocked state.

According to the above-described configuration, it is possible to prevent the cover from being detached from the housing by the first locking mechanism with a simple configuration.

In one or more embodiments, the cover may include a plurality of engaged portions arranged circumferentially about the rotation axis of the tip tool holder. The first slidable member may include an engagement portion configured to engage with any one of the engaged portions. When the first locking mechanism is in the first locking state, the first slidable member may be at the first locking position at which the engagement portion engages with one of the engaged portions. When the first locking mechanism is in the first unlocked state, the first slidable member may be at the first unlocked position at which the engagement portion does not engage with any of the engaged portions. In response to the first unlocking operation by the user, the first slidable member may move from the first locking position to the first unlocked position.

The above configuration can realize fixation of a rotational angle of the cover with respect to the housing as well as prevention of detachment of the cover from the housing, by the first locking mechanism with a simple configuration.

In one or more embodiments, the second locking mechanism may include a second slidable member supported by the housing so as to be movable in a plane orthogonal to the first sliding direction. When the second locking mechanism is in the second locking state, the second slidable member may be at a second locking position at which the second slidable member interferes with the first slidable member on a way from the first locking position to the first unlocked position. When the second locking mechanism is in the second unlocked state, the second slidable member may be at a second unlocked position at which the second slidable member does not interfere with the first slidable member on the way from the first locking position to the first unlocked position. In response to the second unlocking operation by the user, the second slidable member may move from the second locking position to the second unlocked position.

The above configuration can prevent the first unlocking operation from being performed on the first locking mechanism by the second locking mechanism with a simple configuration.

In one or more embodiments, the electric power tool may further comprise a switch member disposed on the housing. When the user performs an ON operation on the switch member, power may be supplied to the motor. When the user performs an OFF operation on the switch member, power supply to the motor may be stopped. The second locking mechanism may be configured to allow the ON operation on the switch member when the second slidable member is at the second locking position, and prohibit the ON operation on the switch member when the second slidable member is at the second unlocked position.

In the above configuration, when the second locking mechanism is in the second unlocked state, that is, when the cover could be detached from the housing, the ON operation on the switch member is prohibited, thus the user's safety can be improved.

In one or more embodiments, the electric power tool may further comprise a switch member disposed on the housing. When the user performs an ON operation on the switch member, power may be supplied to the motor. When the user performs an OFF operation on the switch member, power supply to the motor may be stopped. The second slidable member of the second locking mechanism may be mechanically connected to the switch member. The second unlocking operation may be performed via the switch member.

In the above configuration, the user can perform the second unlocking operation on the second locking mechanism via the switch member on which the user performs the ON operation and the OFF operation. The user's convenience can be improved.

In one or more embodiments, the second locking mechanism may include a second rotatable member rotatably supported by the first slidable member. When the second locking mechanism is in the second locking state, the second rotatable member may be at a second locking angle at which the second rotatable member interferes with the housing when the first slidable member moves from the first locking position to the first unlocked position. When the second locking mechanism is in the second unlocked state, the second rotatable member may be at a second unlocked angle at which the second rotatable member does not interfere with the housing when the first slidable member moves from the first locking position to the first unlocked position. In response to the second unlocking operation by the user, the second rotatable member rotates from the second locking angle to the second unlocked angle.

In the above configuration, the second locking mechanism is integrated with the first locking mechanism, thus the configurations of the first locking mechanism and the second locking mechanism can be further simplified.

In one or more embodiments, the first locking mechanism may be configured to prohibit the cover from rotating with respect to the housing and being detached from the housing in the first locking state, and allow the cover to rotate with respect to the housing and be detached from the housing in the first unlocked state. The second locking mechanism may be configured to prohibit the cover from being detached from the housing in the second locking state, and allow the cover to be detached from the housing in the second unlocked state.

The above configuration can reliably prevent the cover from being unintentionally detached from the housing as well as fix the rotational angle of the cover with respect to the housing.

In one or more embodiments, the cover may include a plurality of engaged portions arranged circumferentially about a rotation axis of the tip tool holder. The first locking mechanism may include a first slidable member supported by the housing so as to be movable in a first sliding direction that is substantially orthogonal to the rotation axis of the tip tool holder. The first slidable member may include an engagement portion configured to engage with any one of the engaged portions. When the first locking mechanism is in the first locking state, the first slidable member may be at a first locking position at which the engagement portion engages with one of the engaged portions. When the first locking mechanism is in the first unlocked state, the first slidable member may be at a first unlocked position at which the engagement portion does not engage with any of the engaged portions. In response to the first unlocking operation by the user, the first slidable member moves from the first locking position to the first unlocked position.

The above configuration enables the first locking mechanism with a simple configuration to realize both fixation of the rotational angle of the cover with respect to the housing and preventing of detachment of the cover from the housing.

In one or more embodiments, the first locking mechanism may further include a first biasing member configured to bias the first slidable member in a direction from the first unlocked position to the first locking position.

According to the above configuration, it is possible to automatically return the first locking mechanism to the first locking state when the first unlocking operation is not performed on the first locking mechanism. The configuration can reliably prevent the cover from being unintentionally detached from the housing.

In one or more embodiments, the first slidable member may include a base portion extending in the first sliding direction; a manipulatable portion disposed at one end of the base portion; an elongated hole located at the base portion and having a longitudinal direction in the first sliding direction; a support portion disposed at another end of the base portion and supporting the engagement portion; and a protrusion disposed at the base portion and configured to be biased by the first biasing member. The first slidable member may be supported by the housing via a support member penetrating the elongated hole.

According to the above configuration, the configuration of the first locking mechanism can be further simplified.

In one or more embodiments, the cover may include a band portion surrounding a part of the housing that is in a vicinity of the tip tool holder. The first locking mechanism may include a first rotatable member rotatably supported by the band portion. When the first locking mechanism is in the first locking state, the first rotatable member may be at a first locking angle at which the first rotatable member presses the band portion against the housing. When the first locking mechanism is in the first unlocked state, the first rotatable member may be at a first unlocked angle at which the first rotatable member does not press the band portion against the housing. In response to the first unlocking operation by the user, the first rotatable member may rotate from the first locking angle to the first unlocked angle.

The above configuration enables the first locking mechanism with the simple configuration to realize both fixation of the rotational angle of the cover with respect to the housing and prevention of detachment of the cover from the housing.

In one or more embodiments, the housing may include a plurality of engaged portions arranged circumferentially about a rotation axis of the tip tool holder. The first locking mechanism may include a first rotatable member rotatably supported by the cover. The first rotatable member may include an engagement portion configured to engage with any one of the engaged portions. When the first locking mechanism is in the first locking state, the first rotatable member may be at a first locking angle at which the engagement engages with one of the engaged portions. When the first locking mechanism is in the first unlocked state, the first rotatable member may be at a first unlocked angle at which the engagement portion does not engage with any of the engaged portions. In response to the first unlocking operation by the user, the first rotatable member may rotate from the first locking angle to the first unlocked angle.

The above configuration enables the first locking mechanism with the simple configuration to realize both fixation of the rotational angle of the cover with respect to the housing and prevention of detachment of the cover from the housing.

In one or more embodiments, the cover may include a plurality of engaged portions arranged circumferentially above a rotation axis of the tip tool holder. The first locking mechanism may include a first rotatable member rotatably supported by the housing. The first rotatable member may include an engagement portion configured to engage with any one of the engaged portions. When the first locking mechanism is in the first locking state, the first rotatable member may be at a first locking angle at which the engagement portion engages with one of the engaged portions. When the first locking mechanism is in the first unlocked state, the first rotatable member may be at a first unlocked angle at which the engagement portion does not engage with any of the engaged portions. In response to the first unlocking operation by the user, the first rotatable member may rotate from the first locking angle to the first unlocked angle.

The above configuration enables the first locking mechanism with the simple configuration to realize both fixation of the rotational angle of the cover with respect to the housing and prevention of detachment of the cover from the housing.

In one or more embodiments, the second locking mechanism may include a second rotatable member rotatably supported by the housing. When the second locking mechanism is in the second locking state, the second rotatable member may be at a second locking angle at which the second rotatable member engages with the cover. When the second locking mechanism is in the second unlocked state, the second rotatable member may be at a second unlocked angle at which the second rotatable member does not engage with the cover. In response to the second unlocking operation by the user, the second rotatable member may rotate from the second locking angle to the second unlocked angle.

The above-described configuration enables the second locking mechanism with a simple configuration to prevent the cover from being detached from the housing.

In one or more embodiments, the second rotatable member may be supported by the housing so as to be rotatable about a rotation axis extending in a direction substantially orthogonal to the rotation axis of the tip tool holder. The second locking mechanism may further include a second biasing member configured to bias the second rotatable member in a direction from the second unlocked angle to the second locking angle. The second rotatable member may include a protrusion configured to engage with the cover and a manipulatable portion integrally formed with the protrusion.

According to the above configuration, it is possible to automatically return the second locking mechanism to the second locking state when the second unlocking operation is not performed on the second locking mechanism. The configuration can reliably prevent the cover from being unintentionally detached from the housing. Further, according to the above configuration, the configuration of the second locking mechanism can be further simplified.

In one or more embodiments, the second locking mechanism may include a second slidable member supported by the cover so as to be movable in a second sliding direction that is substantially orthogonal to a rotation axis of the tip tool holder. The second slidable member may include an portion configured to engage with the housing. When the second locking mechanism is in the second locking state, the second slidable member may be at a second locking position at which the engagement portion of the second slidable member engages with the housing. When the second locking mechanism is in the second unlocked state, the second slidable member may be at a second unlocked position at which the engagement portion of the second slidable member does not engage with the housing. In response to the second unlocking operation by the user, the second slidable member may move from the second locking position to the second unlocked position.

The above-described configuration enables the second locking mechanism with the simple configuration to prevent the cover from being detached from the housing.

In one or more embodiments, the second locking mechanism may include a second slidable member supported by the cover so as be movable in a second sliding direction that is substantially parallel to a rotation axis of the tip tool holder; and a ball member supported by the second slidable member and configured to engage with the housing. When the second locking mechanism is in the second locking state, the second slidable member may be at a second locking position at which the ball member engages with the housing. When the second locking mechanism is in the second unlocked state, the second slidable member may be at a second unlocked position at which the ball member does not engage with the housing. In response to the second unlocking operation by the user, the second slidable member may move from the second locking position to the second unlocked position.

The above-described configuration enables the second locking mechanism with the simple configuration to prevent the cover from being detached from the housing.

In one or more embodiments, the second locking mechanism may include a second slidable member supported by the housing so as to be movable in a second sliding direction that is substantially orthogonal to a rotation axis of the tip tool holder. When the second locking mechanism is in the second locking state, the second slidable member may be at a second locking position at which the second slidable member engages with the cover. When the second locking mechanism is in the second unlocked state, the second slidable member may be at a second unlocked position at which the second slidable member does not engage with the cover. In response to the second unlocking operation by the user, the second slidable member may move from the second locking position to the second unlocked position.

The above-described configuration enables the second locking mechanism with the simple configuration to prevent the cover from being detached from the housing.

First Embodiment

As shown in FIG. 1, a grinder 2 according to the present embodiment includes a motor housing 4, a rear housing 6, a gear housing 8, a bearing box 10, and a wheel cover 12.

A motor 14 is housed inside the motor housing 4. The motor 14 includes an output shaft 16 extending in a front-rear direction. The output shaft 16 is rotatably supported by the motor housing 4 via a bearing 18.

The rear housing 6 is attached to a rear portion of the motor housing 4. A power circuit 20 is housed inside the rear housing 6. Power is supplied to the power circuit 20 from an external power source through a power cable 22. A paddle switch 24 is disposed on a lower surface of the motor housing 4. When a user pushes the paddle switch 24 upward, a link 26 contacts a drive switch 28 and power is supplied to the motor 14. The motor 14 rotates the output shaft 16 by the power supplied from the power circuit 20. When the user releases the paddle switch 24, the link 26 separates away from the drive switch 28 and the power supply to the motor 14 is stopped. A lock-off lever 30 is disposed at the paddle switch 24. The lock-off lever 30 switch be ween a state that allows a pushing operation on the paddle switch 24 and a state that prohibits the pushing operation on the paddle switch 24. In the state shown in FIG. 1, the pushing operation on the paddle switch 24 by the user is prohibited. When the lock-off lever 30 is rotated in a direction along which a lower end of the lock-off lever 30 moves rearward (counterclockwise in FIG. 1), the pushing operation on the paddle switch 24 by the user is allowed.

Figure 2:
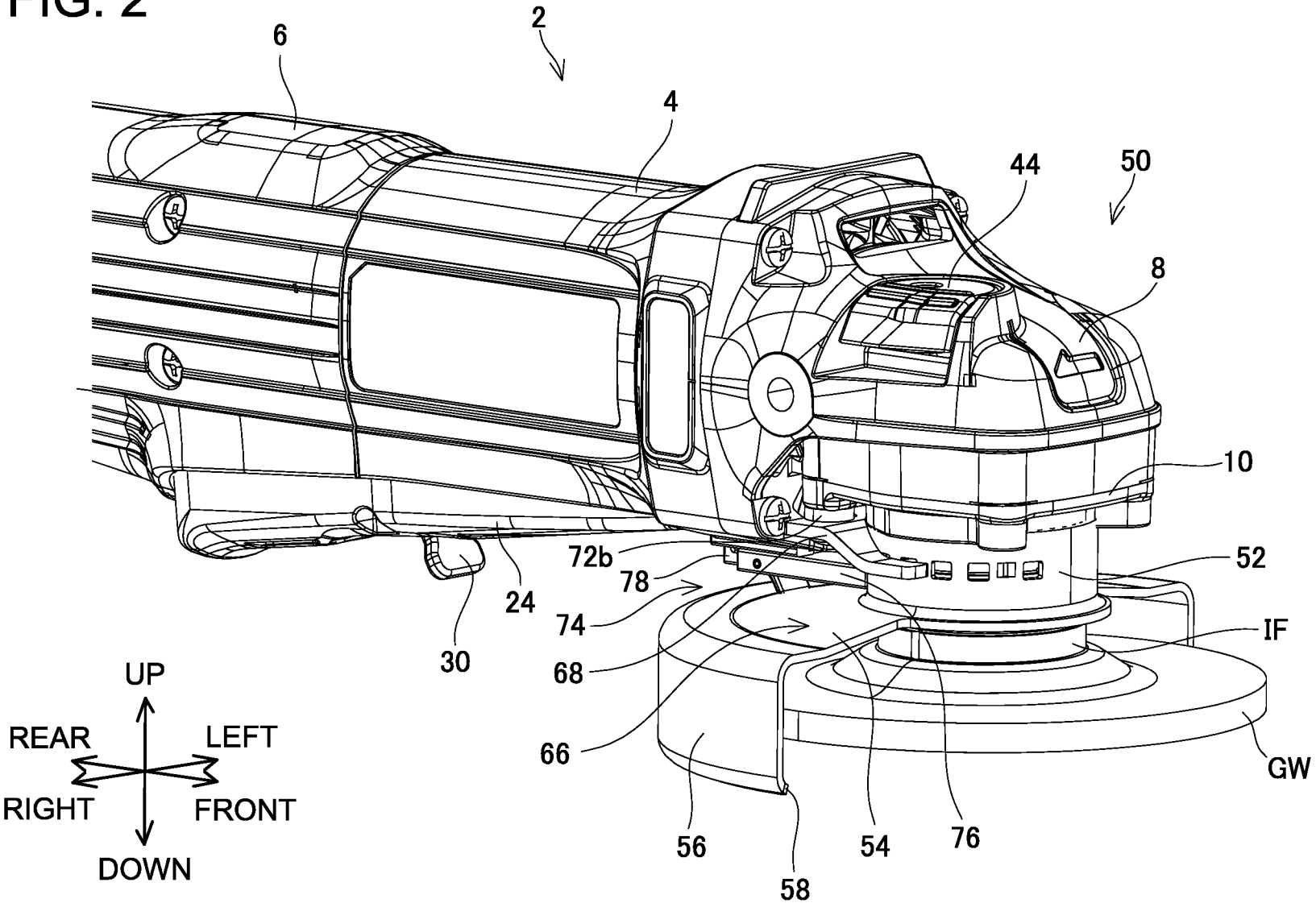
FIG. 2 is a perspective view of a front portion of the grinder 2 according to the first embodiment, when seen from front-upper-right side.

The gear housing 8 is attached to a front portion of the motor housing 4. The gear housing 8 supports the output shaft 16 via a bearing 32 such that the output shaft 16 is rotatable. A first bevel gear 34 and a second bevel gear 36 meshing with each other are disposed inside the gear housing 8. The first bevel gear 34 is secured to a front end of the output shaft 16. The second bevel gear 36 is secured to an upper end of a spindle 38 extending in an up-down direction. Hereinafter, the first bevel gear 34 and the second bevel gear 36 may be collectively referred to simply as bevel gear 40. The bevel gear 40 is a power transmission mechanism configured to reduce the rotational speed of the motor 14 and transmit it to the spindle 38. The gear housing 8 holds the upper end of the spindle 38 via a bearing 42. As shown in FIG. 2, a shaft lock 44 is disposed on an upper surface of the gear housing 8. When the user pushes the shaft lock 44 downward, the rotation of the second bevel gear 36 is thereby prohibited, as a result of which the rotation of the spindle 38 is prohibited.

As shown in FIG. 1, the bearing box 10 is attached to a lower portion of the gear housing 8. The bearing box 10 is secured to the gear housing 8 by screws 46*a*, 46*b*, 46*c*. and 46*d* extending in the up-down direction (see FIGS. 2, 4, 5, etc.). The bearing box 10 holds the spindle 38 via a bearing 8. The spindle 38 is rotatable about a rotation axis along the up-down direction with respect to the bearing box 10. A grinding wheel GW can be attached to near a lower end of the spindle 38 via an inner flange IF and an outer flange OF. In the grinder 2, the rotation of the motor 14 causes the spindle 38 and the grinding wheel GW to rotate about the rotation axis, by which a workpiece can be ground. The spindle 38 can be considered as a tip tool holder configured to hold the grinding wheel GW, which is a tool. In the following description, the motor housing 4, the rear housing 6, the gear housing 8, and the bearing box 10 may be collectively referred to simply as housing 50.

The wheel cover 12 is attached to the bearing box 10. The wheel cover 12 has a shape that covers at least a part of the grinding wheel GW. In the present embodiment, the wheel cover 12 has a shape that covers substantially a half of the circumference of the grinding wheel GW. In the state shown in FIGS. 1 and 2, wheel cover 12 is located to cover a rear portion of the grinding wheel GW. The wheel cover 12 can prevent chips from flying toward the user from the grinding wheel GW while the grinder 2 is used. The wheel cover 12 can be considered as covering at least a part of the spindle 38.

Figure 3:
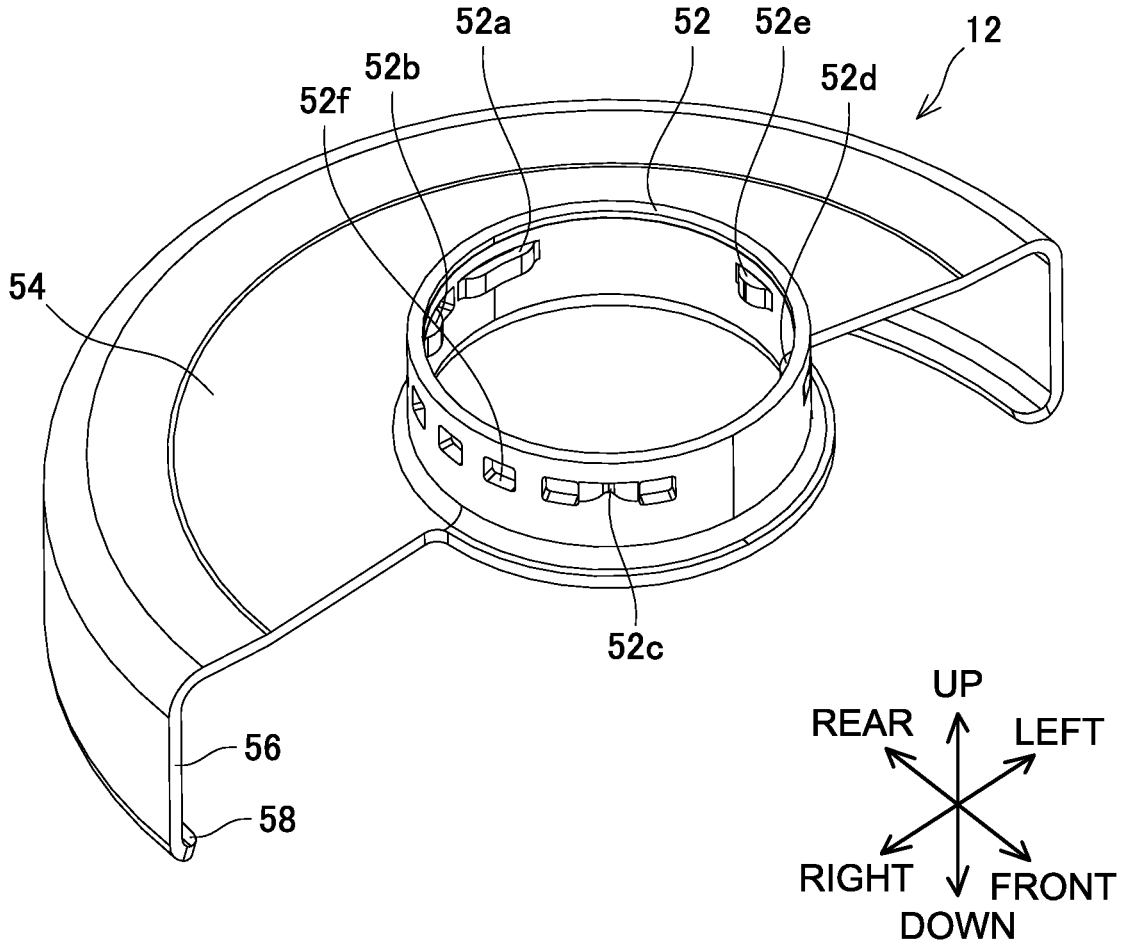
FIG. 3 is a perspective view of a wheel cover 12 of the grinder 2 according to the first embodiment.

As shown in FIG. 3, the wheel cover 12 includes a band portion 52, an upper surface portion 54, a side surface portion 56, and a narrowing portion 58. The band portion 52 has a substantially cylindrical shape extending in the up-down direction. Engagement ribs 52*a*, 52*b*, 52*c*, 52*d*, and 52*e* that protrude inward and have their longitudinal directions in the circumferential direction are disposed on an inner surface of the band portion 52. Further, a plurality of through holes 52*f* is formed in the band portion 52 within a predetermined angular range. The engagement ribs 52*a*, 52*b*, 52*c*, 52*d*, and 52*e* are at the same height in the up-down direction. The through holes 52*f* are the same height in the up-down direction. The upper surface portion 54 extends outward from a lower end of the band portion 52 and has a partially cut-out truncated cone shape. The side surface portion 56 has a substantially semi-cylindrical shape extending downward from an outer end of the upper surface portion 54. The narrowing portion 58 is bent inward from a lower end of the side surface portion 56.

Figure 4:
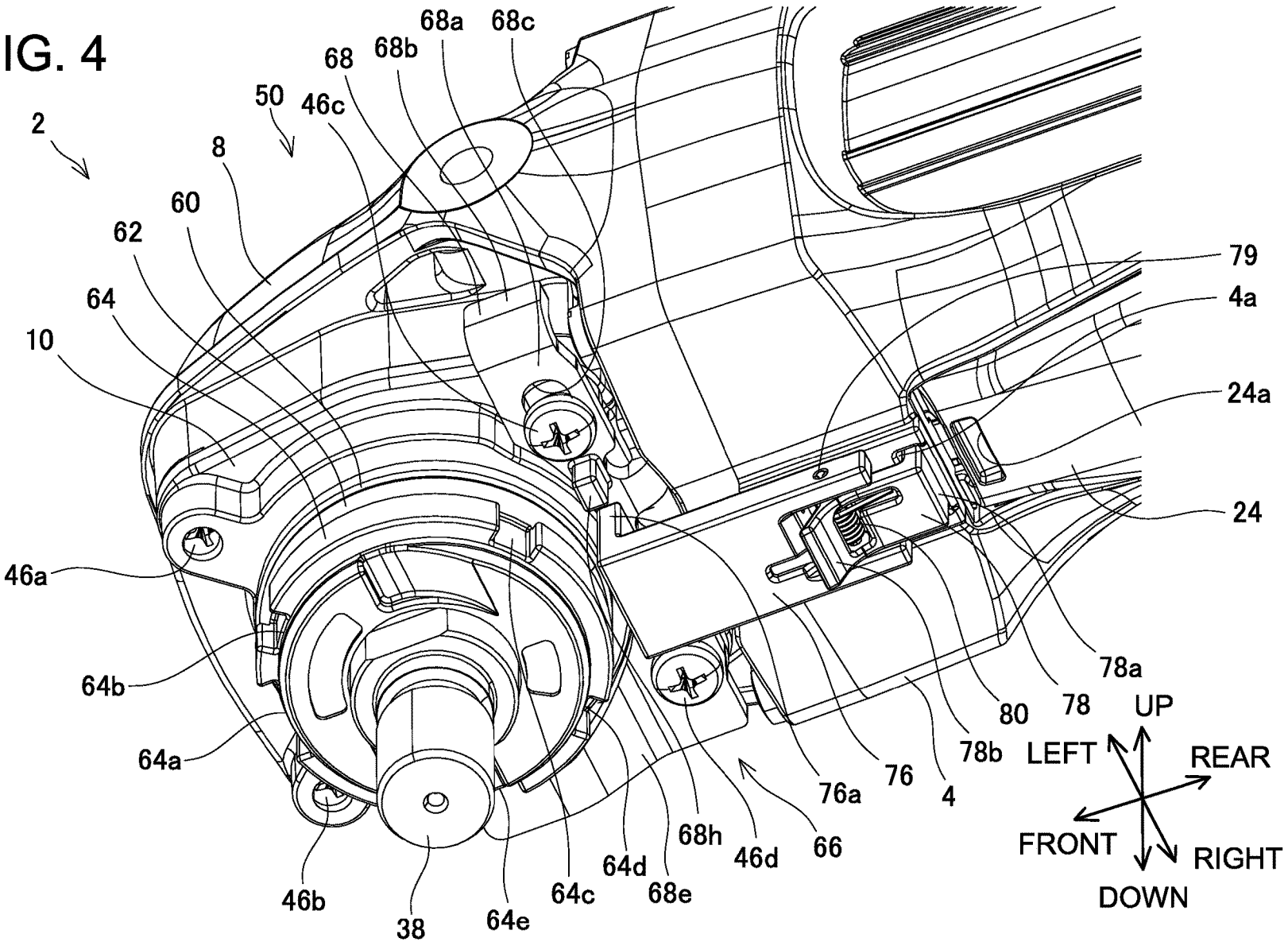
FIG. 4 is a perspective view of a structure around a cover mounting portion 60 of the grinder 2 according to the first embodiment, when seen from rear-lower-left side.

As shown in FIG. 4, a substantially cylindrical cover mounting portion 60 that protrudes downward along the rotation axis direction of the spindle 38 (i.e., the up-down direction) is disposed at the bearing box 10. An annular guide groove 62 is formed in an outer surface of the cover mounting portion 60, and a flange 64 that protrudes radially outward is located below the guide groove 62. Notches 64*a*, 64*b*, 64*c*, 64*d*, and 64*e* are formed in the flange 64, corresponding to the engagement ribs 52*a*, 52*b*, 52*c*, 52*d*, and 52*e* of the wheel cover 12.

Figure 5:
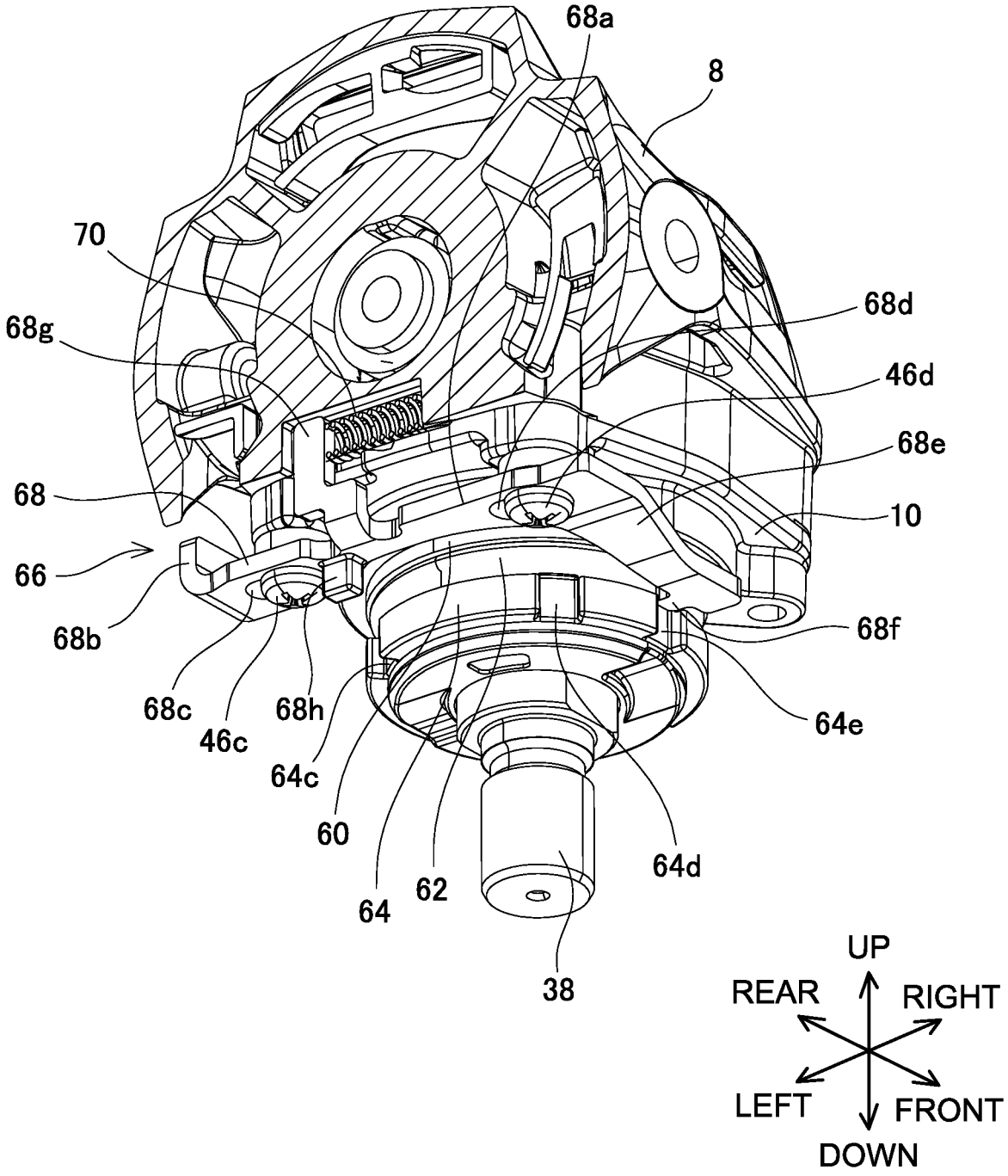
FIG. 5 is a perspective cross-sectional view of a structure of a first locking mechanism 66 of the grinder 2 according to the first embodiment, when seen from rear-lower-right side.

As shown in FIG. 5, a first locking mechanism 66 is attached to a rear portion of the bearing box 10. The first locking mechanism 66 includes a slide plate 68 and a compression spring 70.

Figure 6:
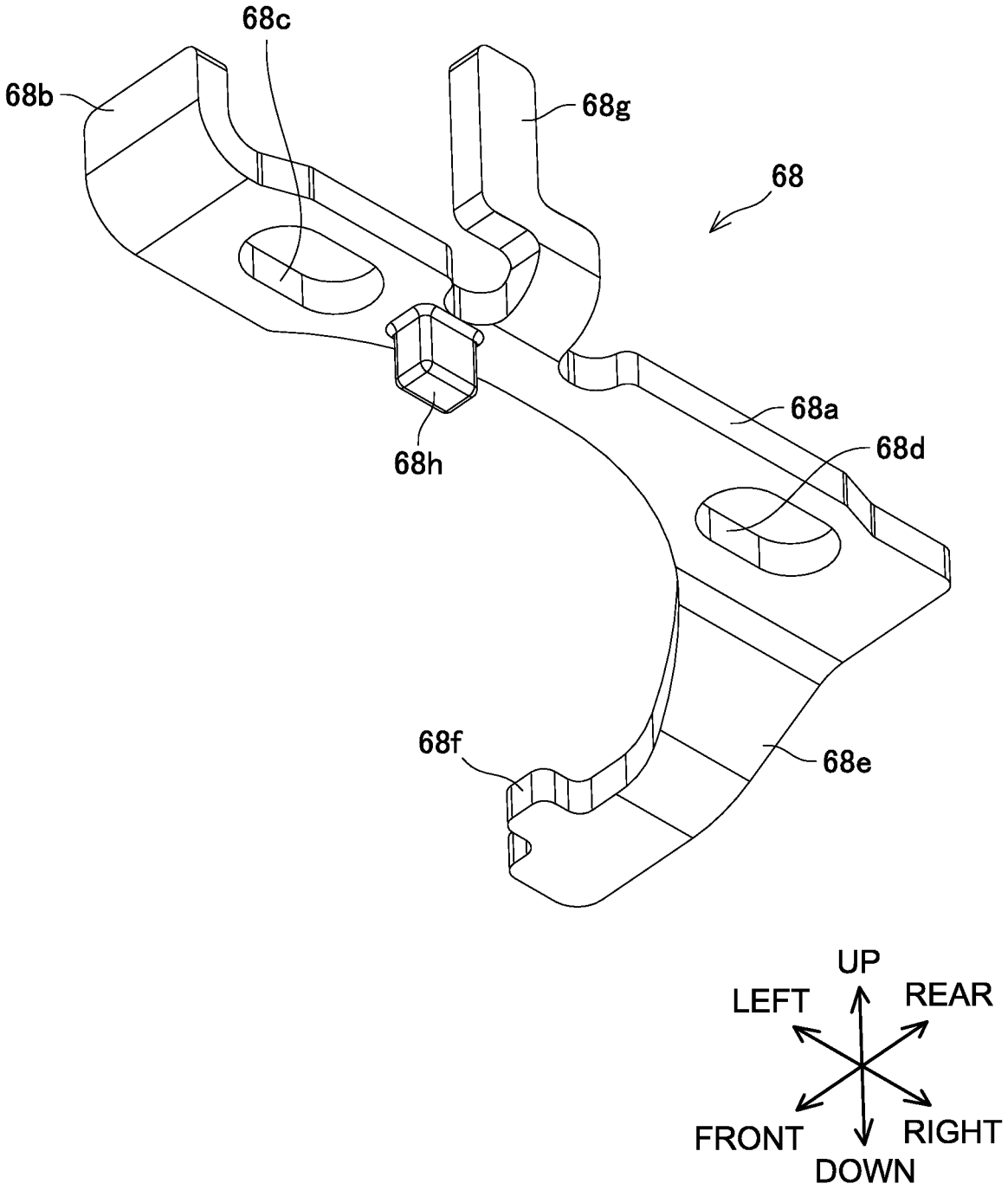
FIG. 6 is a perspective view of a slide plate 68 of the grinder 2 according to the first embodiment.

As shown in FIG. 6, the slide plate 68 includes a flat plate-shaped base portion 68*a* that extends in a right-left direction without interfering with the gear housing 8 nor the bearing box 10, a manipulatable portion 68*b* that extends upward from a left end of the base portion 68*a*, elongated holes 68*c* and 68*d* that are formed in the base portion 68*a* and have their longitudinal directions in the right-left direction ,a support portion 68*e* that extends downward and forward from a right end of the base portion 68*a*, a lock portion 68*f* that protrudes leftward from near a front end of the support portion 68*e*, an upward protrusion 68*g* that protrudes upward between the elongated holes 68*c* and 68*d* of the base portion 68*a*, and a downward protrusion 68*h* that protrudes downward between the elongated holes 68*c* and 68*d* of the base portion 68*a*.

As shown in FIG. 5, the slide plate 68 is attached to the rear-left screw 46*c* and the rear-right 46*d* among the screws 46*a*, 46*b*, 46*c*, and 46*d* securing the bearing box 10 to the gear housing 8. The screw 46*c* passes through the elongated hole 68*c* of the slide plate 68 and further passes through a height adjusting sleeve 72*a* to fasten the bearing box 10 with the gear housing 8. The screw 46*d* passes through the elongated hole 68*d* of the slide plate 68 and further passes through a height adjusting sleeve 72*b* to fasten the bearing box 10 with the gear housing 8. The slide plate 68 is supported by the bearing box 10 such that the slide plate 68 is movable in the right-left direction.

A through hole 10*a* through which the upward protrusion 68*g* of the slide plate 68 penetrates is formed in the bearing box 10. The upward protrusion 68*g* of the slide plate 68 enters the inside of the gear housing 8 through the through hole 10*a*. The compression spring 70 is housed inside the gear housing 8 and biases the upward protrusion 68*g* of the slide plate 68 leftward with respect to the gear housing 8. That is, the compression spring 70 biases the slide plate 68 leftward with respect to the bearing box 10, that is, it biases the lock portion 68*f* toward the cover mounting portion 60.

As shown in FIG. 4, a second locking mechanism 74 is attached to the motor housing 4. The second locking mechanism 74 includes a slidable member 76, a lock-off member 78, a hinge pin 79, and a torsion spring 80.

Figure 7:
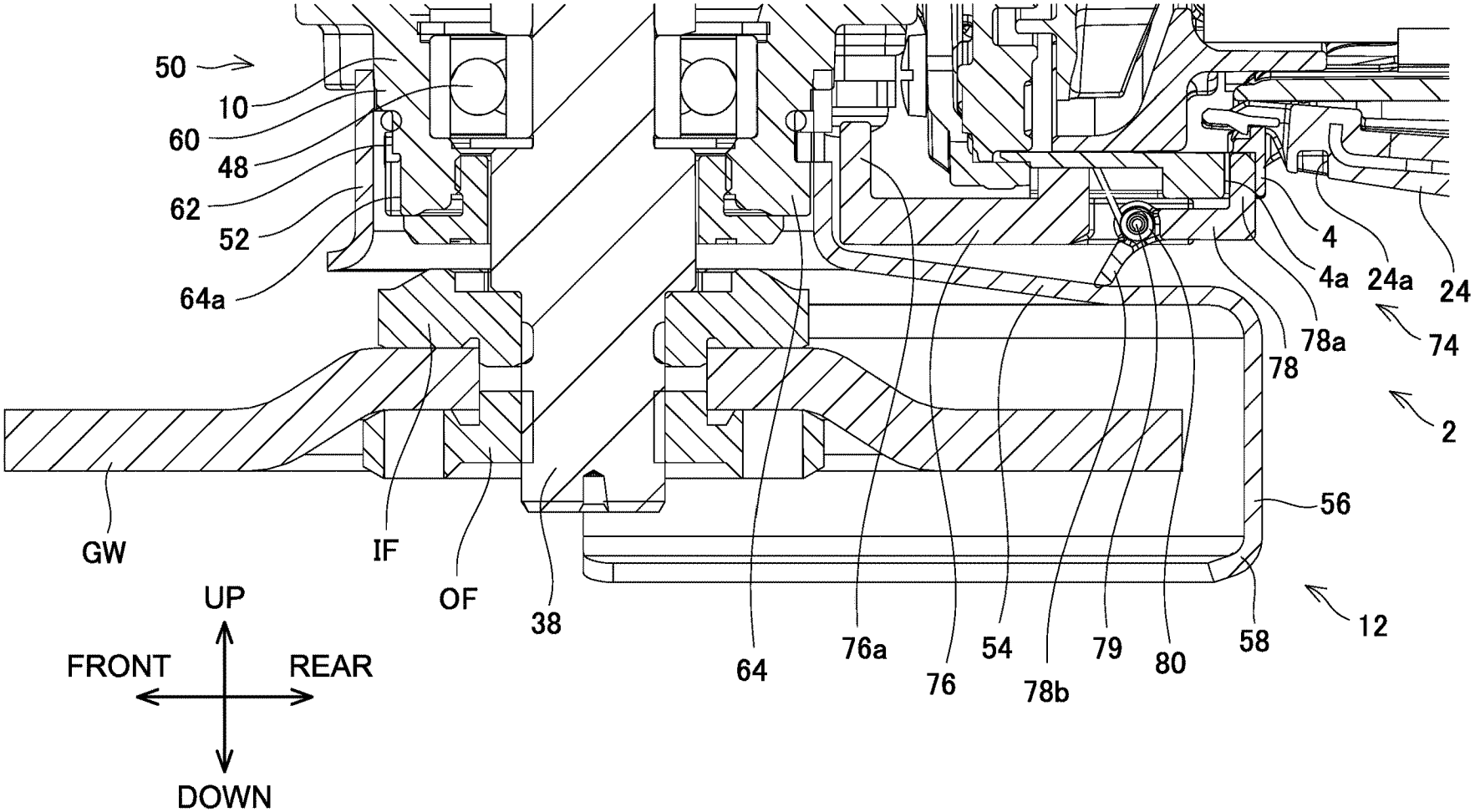
FIG. 7 is a longitudinal sectional view of the front portion of the grinder 2 according to the first embodiment.
Figure 8:
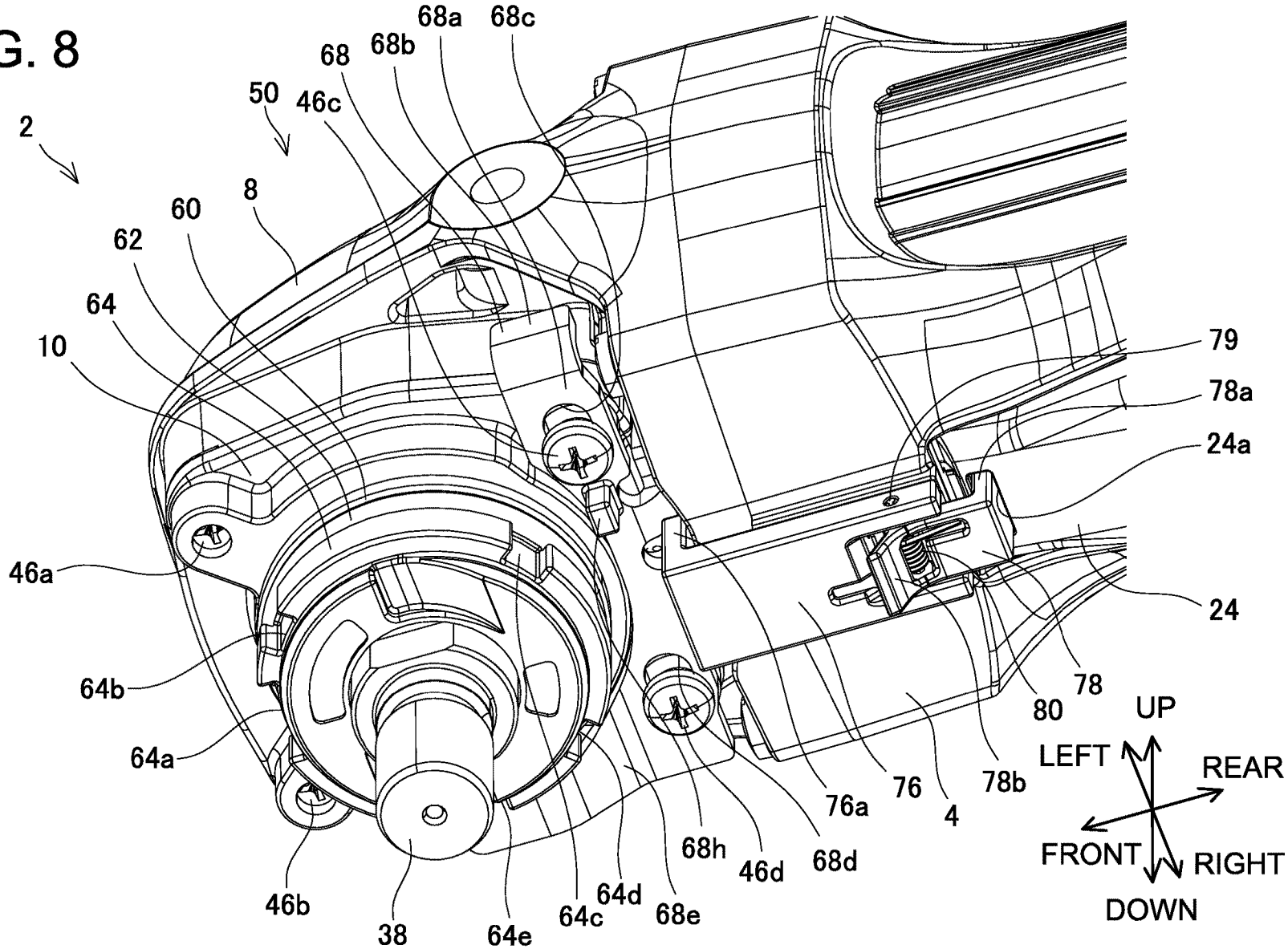
FIG. 8 is a perspective view of the structure around the cover mounting portion 60 of the grinder 2 according to the first embodiment in the state where a slidable member 76 is at a retracted position, when seen from rear-lower-left side.
Figure 9:
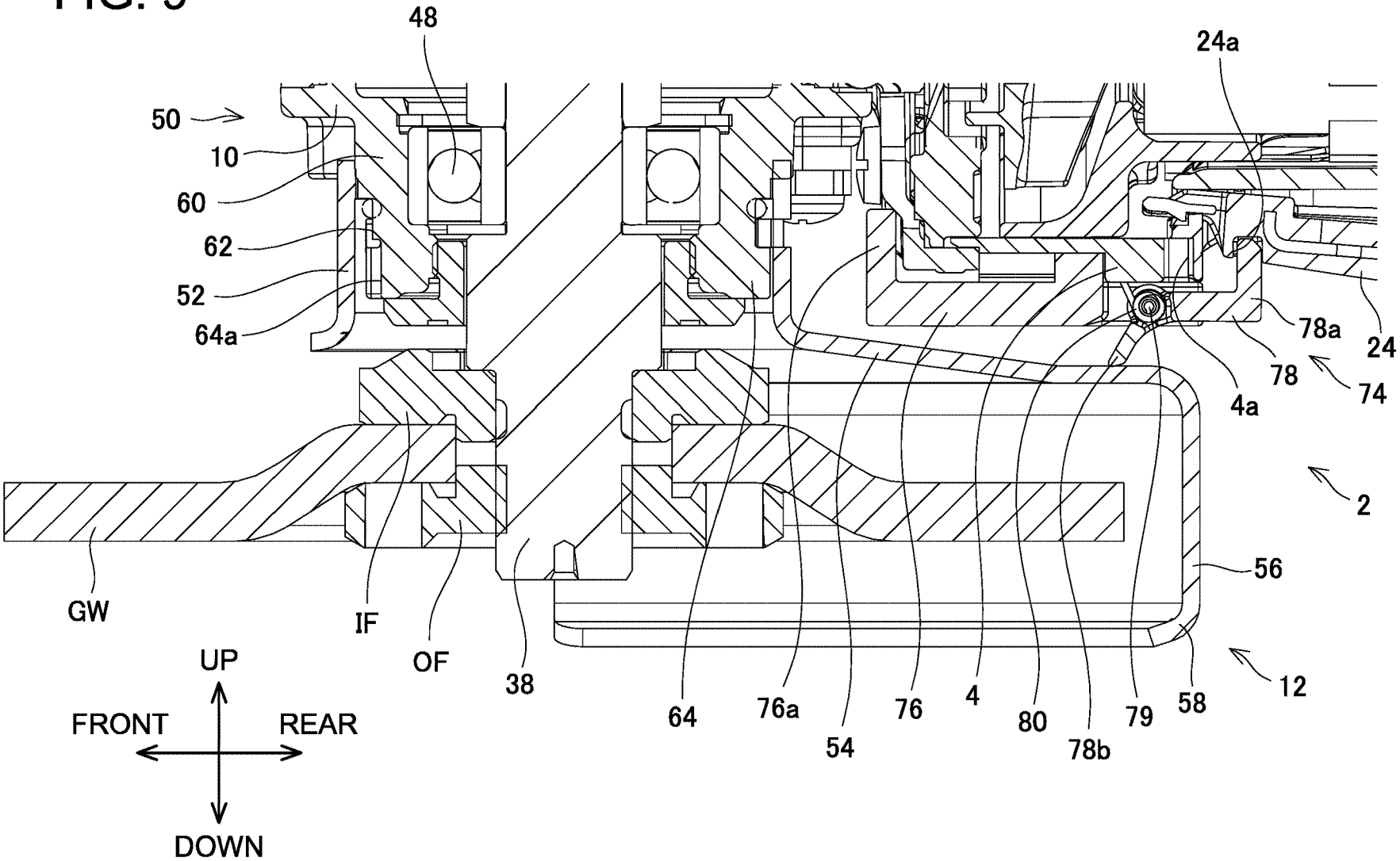
FIG. 9 is a longitudinal sectional view of the front portion of the grinder 2 according to the first embodiment in the state where the slidable member 76 is at the retracted position.

The slidable member 76 is attached to a lower surface of the motor housing 4 so as to be slidable in the front-rear direction. The lock-off member 78 is rotatably attached to a rear portion of the slidable member 76 via the hinge pin 79 having a longitudinal direction in the right-left direction. The lock-off member 78 includes an engagement portion 78*a* and a manipulatable portion 78*b*. The torsion spring 80 biases the lock-off member 78 with respect to the slidable member 76 in a rotation direction along which the engagement portion 78*a* moves upward. When the slidable member 76 is at a position advanced with respect to the motor housing 4 (also referred to as an advanced position) as shown in FIGS. 4 and 7, the engagement portion 78*a* of the lock-off member 78 is fitted in a mating groove 4*a* formed near the front end of the motor housing 4, by the biasing force of the torsion spring 80. When the slidable member 76 is at a position retracted with respect to the motor housing 4 (also referred to as a retracted position) as shown in FIGS. 8 and 9, the engagement portion 78*a* of the lock-off member 78 is fitted in a mating groove 24*a* formed near the front end of the paddle switch 24, by the biasing force of the torsion spring 80. In the state where be lock-off member 78 is fitted in the mating groove 24*a* of the paddle switch 24, the pushing operation on the paddle switch 24 by the user is prohibited. The user rotates the lock-off member 78 by pushing the manipulatable portion 78*b* of the lock-off member 78 to disengage the engagement portion 78*a* from the mating groove 4*a* or the mating groove 24*a*, such that the user can move the slidable member 76 in the front-rear direction.

A stopper portion 76*a* is disposed at the front end of the slidable member 76. When the slidable member 76 is at the advanced position as shown in FIGS. 4 and 7, the stopper portion 76*a* is located to interfere with the downward protrusion 68*h* when the slide plate 68 moves rightward. Therefore, when the slidable member 76 is at the advanced position, an operation of pushing the slide plate 68 rightward by the user is prohibited. When the slidable member 76 is at the retracted position as shown in FIGS. 8 and 9, the stopper portion 76*a* is located not to interfere with the downward protrusion 68*h* when the slide plate 68 moves rightward. Therefore, when the slidable member 76 is at the retracted position, the operation of pushing the slide plate 68 rightward by the user is allowed.

When the wheel cover 12 is to be attached to the cover mounting portion 60, the user moves the slidable member 76 to the retracted position and inserts the engagement portion 78*a* of the lock-off member 78 into the mating groove 24*a* as shown in FIGS. 8 and 9 such that the user can perform the operation of pushing the slide plate 68 rightward. Further, the user aligns the engagement ribs 52*a*, 52*b*, 52*c*, 52*d*, and 52*e* of the wheel cover 12 with the notches 64*a*, 64*b*, 64*c*, 64*d*, and 64*e* of the cover mounting portion 60. Then, the user pushes the manipulatable portion 68*b* of the slide plate 68 rightward to separate the lock portion 68*f* away from the cover mounting portion 60 and slides the wheel cover 12 upward with respect to the bearing box 10 such that the cover mounting portion 60 is located inside the band portion 52. In this way, the wheel cover 12 is attached to the cover mounting portion 60. Hereinafter, the position of the wheel cover 12 after attached to the bearing box 10 in the state where the engagement ribs 52*a*, 52*b*, 52*c*, 52*d*, and 52*e* are aligned with the notches 64*a*, 64*b*, 64*c*, 64*d*, and 64*e* may be referred to as a detachable position.

The wheel cover 12 attached to the bearing box 10 is rotatable about the cover mounting portion 60. In other words, the wheel cover 12 is rotatable about the rotation axis direction of the spindle 38 (i.e., the up-down direction) with respect to the bearing box 10. When the wheel cover 12 is rotated from the detachable position with respect to the bearing box 10, the engagement ribs 52*a*, 52*b*, 52*c*, 52*d*, and 52*e* slide in the guide groove 62. In the state where the wheel cover 12 is rotated from t e detachable position with respect to the bearing box 10, the flange 64 is engaged with the engagement ribs 52*a*, 52*b*, 52*c*, 52*d*, and 52*e*, by which the downward slide of the wheel cover 12 with respect to the bearing box 10 is prohibited. In this case, the wheel cover 12 cannot be detached from the bearing box 10.

When the user rotates the wheel cover 12 with respect to the bearing box 10 to align the lock portion 68*f* of the slide plate 68 with one of the through holes 52*f* of the band portion 52 and releases the hand from the manipulatable portion 68*b* of the slide plate 68, the lock portion 68*f* is pushed into the trough hole 52*f* by the biasing force of the compression spring 70. In this state, the wheel cover 12 is engaged with the slide plate 68, thus the rotation of the wheel cover 12 with respect to the bearing box 10 is prohibited and the wheel cover 12 is fixed to the bearing box 10. To change the rotational angle of the wheel cover 12 with respect to the bearing box 10, the user pushes the manipulatable portion 68*b* of the slide plate 68 to disengage the lock portion 68*f* from the through hole 52*f*, as a result of which the user can rotate the wheel cover 12 with respect to the bearing box 10. By appropriately selecting which through hole 52*f* the lock portion 68*f* is to be inserted into, it is possible to select a rotational angle at which the wheel cover 12 is fixed to the bearing box 10.

After the wheel cover 12 has been fixed to the bearing box 10 by engaging the slide plate 68 with the wheel cover 12, the slidable member 76 is moved to the advanced position and the engagement portion 78*a* of the lock-off member 78 is fitted into the mating groove 4*a*, such that the operation of pushing the slide plate 68 rightward is prohibited as shown in FIGS. 4 and 7. As above, it is possible to prevent the wheel cover 12 from becoming rotatable with respect to the bearing box 10 due to the slide plate 68 being unintentionally pushed rightward.

When the wheel cover 12 is to be detached from the cover mounting portion 60, the user moves the slidable member 76 to the retracted position and inserts the engagement portion 78*a* of the lock-off member 78 into the mating groove 24*a*, such that the operation of pushing the slide plate 68 rightward is allowed as shown in FIGS. 8 and 9. Then, the user pushes the manipulatable portion 68*b* of the slide plate 68 to disengage the lock portion 68*f* from the through hole 52*f* to make the wheel cover 12 become rotatable with respect to the bearing box 10. After rotating the wheel cover 12 to the detachable position with respect to the bearing box 10, the user slides the wheel cover 12 downward with respect to the bearing box 10. The engagement ribs 52*a*, 52*b*, 52*c*, 52*d*, and 52*e* of the wheel cover 12 passes through the notches 64*a*, 64*b*, 64*c*, 64*d*, and 64*e* of the cover mounting portion 60, as a result of which the wheel cover 12 can be detached from the cover mounting portion 60.

In the present embodiment, the grinder 2 (an example of the electric power tool) comprises the motor 14; the bevel gear 40 (an example of the power transmission mechanism) connected to the motor 14; the housing 50 that houses the motor 14 and the bevel gear 40; the spindle 38 (an example of the tip tool holder) connected to the bevel gear 40; the wheel cover 12 (an example of the cover) covering at least a part of the spindle 38; the first locking mechanism 66 configured to switch between a first locking state and a first unlocked state, wherein the first locking mechanism 66 switches from the first locking state to the first unlocked state in response to a first unlocking operation by the user; and the second locking mechanism 74 configured to switch between a second locking state and a second unlocked state, wherein the second locking mechanism 74 switches from the second locking state to the second unlocked state in response to a second unlocking operation by the user. In the grinder 2, the wheel cover 12 becomes detachable from the housing 50 when the user performs the second unlocking operation on the second locking mechanism 74 and the first unlocking operation on the first locking mechanism 66.

According the above configuration, the wheel cover 12 will not be detached from the housing 50 unless the first unlocking operation is performed on the first locking mechanism 66 and the second unlocking operation is performed on the second locking mechanism 74. Therefore, even when the first unlocking operation is accidentally performed on the first locking mechanism 66, the wheel cover 12 cannot be detached from the housing 50 unless the second unlocking operation is performed on the second locking mechanism 74. On the contrary, even when the second unlocking operation is accidentally performed on the second locking mechanism 74, the wheel cover 12 cannot be detached from the housing 50 unless the first unlocking operation is performed on the first locking mechanism 66. According to the above configuration, it is possible to reliably prevent the wheel cover 12 from being unintentionally detached from the housing 50.

In the present embodiment, the first locking mechanism 66 is configured to prohibit the wheel cover 12 from being detached from the housing 50 in the first locking state, and allow the wheel cover 12 to be detached from the housing 50 in the first unlocked state. The second locking mechanism 74 is configured to prohibit the first locking mechanism 66 from switching from the first locking state to the first unlocked state in the second locking state, and allow the first locking mechanism 66 to switch from the first locking state to the first unlocked state in the second unlocked state.

According to the above configuration, the first unlocking operation cannot be performed on the first locking mechanism 66 unless the second unlocking operation is performed on the second locking mechanism 74. Further, even when the second unlocking operation is performed on the second locking mechanism 74, the wheel cover 12 cannot de detached from the housing 50 unless the first unlocking operation is performed on the first locking mechanism 66. According to the above configuration, it is possible to reliably prevent the wheel cover 12 from being unintentionally detached from the housing 50.

In the present embodiment, the first locking mechanism 66 includes the slide plate 68 (an example of the first slidable member) supported by the housing 50 so as to be movable in a first sliding direction (e.g., the right-left direction) that is substantially orthogonal to the rotation axis of the spindle 38. When the first locking mechanism 66 is in the first locking state, the slide plate 68 is at a first looking position at which the slide plate 68 engages with the wheel cover 12. When the first locking mechanism 66 is in the first unlocked state, the slide plate 68 is at a first unlocked position at which the slide plate 68 does not engage with the wheel cover 12. In response to the first unlocking operation by the user, the slide plate 68 moves from the first locking position to the first unlocked position. The second locking mechanism 74 is configured to prohibit the slide plate 68 from moving from the first locking position to the first unlocked position in the second locking state, and allow the slide plate 68 to move from the first locking position to the first unlocked position in the second unlocked state.

According to the above-described configuration, it is possible to prevent the wheel cover 12 from being detached from the housing 50 by the first locking mechanism 66 with a simple configuration.

In the present embodiment, the wheel cover 12 includes the plurality of through holes **52*f* (example of the engaged portions) arranged circumferentially about the rotation axis of the spindle 38. The slide plate 68 includes the lock portion 68*f* (an example of the engagement portion) configured to engage with any one of the through holes 52*f*. When the first locking mechanism 66 is in the first locking state, the slide plate 68 is at the first locking position at which the lock portion 68*f* engages with one of the through holes 52*f*. When the first locking mechanism 66 is in the first unlocked state, the slide plate 68 is at the first unlocked position at which the lock portion 68*f* does not engage with any of the through holes 52*f*. In response to the first unlocking operation by the user, the slide plate 68** moves from the first locking position to the first unlocked position.

The above configuration can realize fixation of the rotational angle of the wheel cover 12 with respect to the housing 50 as well as prevention of detachment of the wheel cover 12 from the housing 50, by the first locking mechanism 66 with a simple configuration.

In the present embodiment, the second locking mechanism 74 includes the slidable member 76 (an example of the second slidable member) supported by the housing 50 so as to be movable in a plane (e.g., a plane including the up-down direction and the front-rear direction) orthogonal to the first sliding direction (e.g., the right-left direction). When the second locking mechanism 74 is in the second locking state, the slidable member 76 is at a second locking position at which the slidable member 76 interferes with the slide plate 68 on a way from the first locking position to the first unlocked position. When the second locking mechanism 74 is in the second unlocked state, the slidable member 76 is at a second unlocked position at which the slidable member 76 does not interfere with the slide plate 68 on the way from the first locking position to the first unlocked position. In response to the second unlocking operation by the user, the slidable member 76 moves from the second locking position to the second unlocked position.

The above configuration can prevent the first unlocking operation from being performed on the first locking mechanism 66 by the second locking mechanism 74 with a simple configuration.

In the present embodiment, the grinder 2 further comprises the paddle switch 24 (an example of the switch member) disposed on the housing 50. When the user performs an ON operation on the paddle switch 24, power is supplied to the motor 14. When the user performs an OFF operation on the paddle switch 24, power supply to the motor 14 is stopped. The second locking mechanism 74 is configured to allow the ON operation on the paddle switch 24 when the slidable member 76 is at the second locking position, and prohibit the ON operation on the paddle switch 24 when the slidable member 76 is at the second unlocked position.

In the above configuration, when the second locking mechanism 74 is in the second unlocked state, that is, when the wheel cover 12 could be detached from the housing 50, the ON operation on the paddle switch 24 is prohibited, thus the user's safety can be improved.

Second Embodiment

Figure 10:
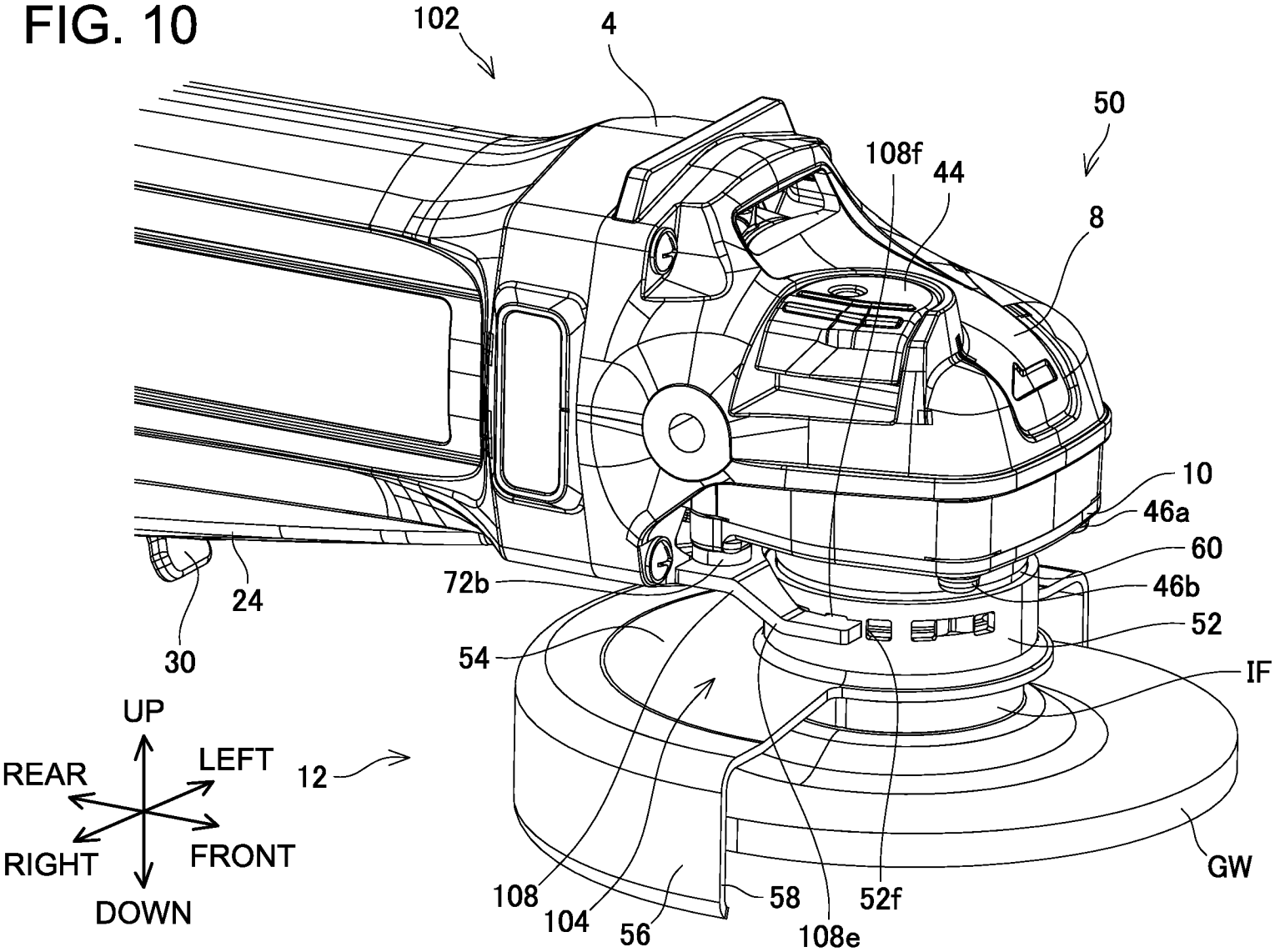
FIG. 10 is a perspective view of a front portion of a grinder 102 according to a second embodiment, when seen from front-upper-right side.
Figure 11:
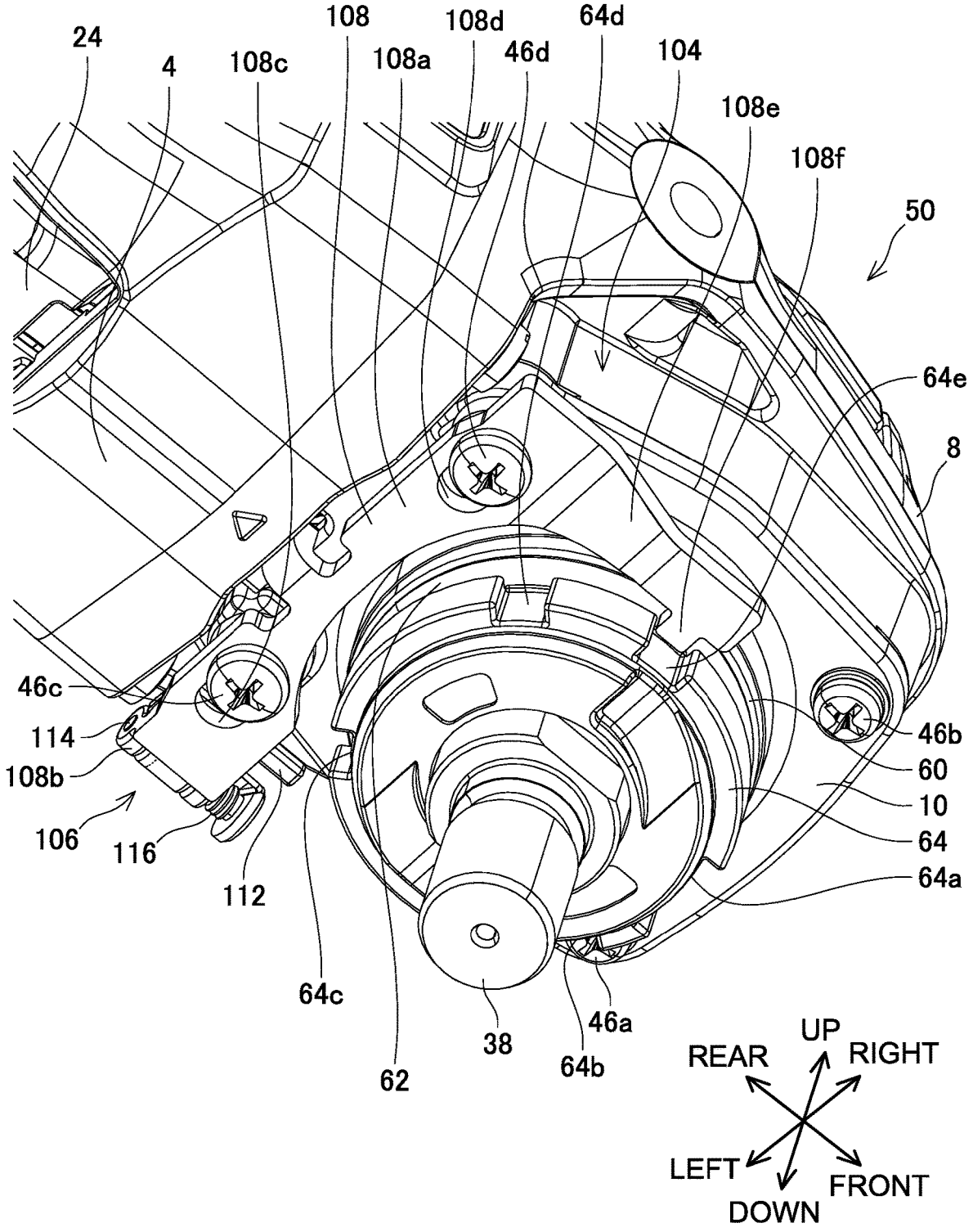
FIG. 11 is a perspective view of a structure around the cover mounting portion 60 of the grinder 102 according to the second embodiment, when seen from rear-lower-right side.

As shown in FIG. 10, a grinder 102 according to the present embodiment has substantially the same configuration as the grinder 2 according to the first embodiment. Hereinafter, regarding the grinder 102 according to the present embodiment, differences from the grinder 2 according to the first embodiment will be described. As shown in FIG. 11, the grinder 102 includes a first locking mechanism 104 instead of the first locking mechanism 66, and a second locking mechanism 106 instead of the second locking mechanism 74.

Figure 12:
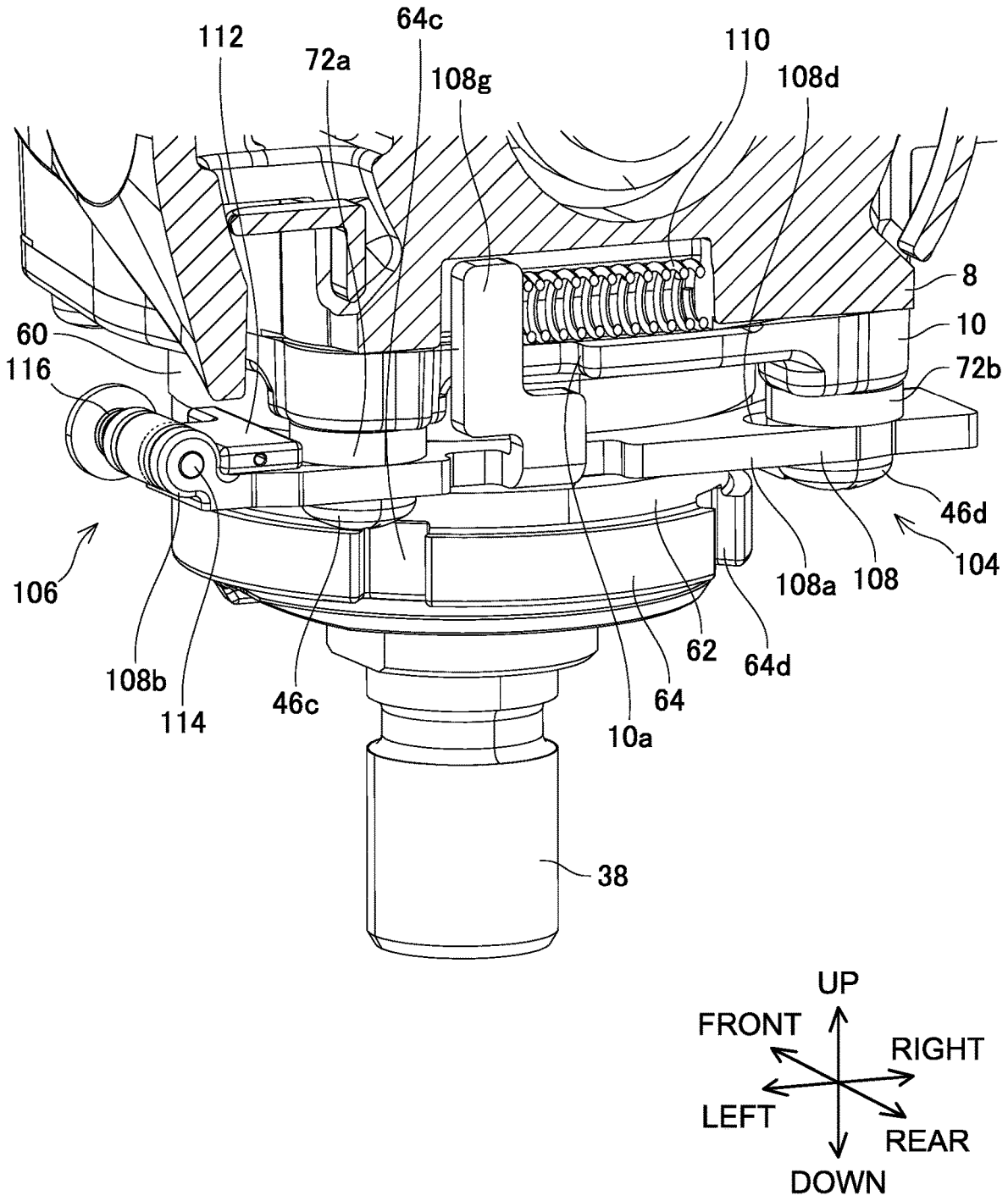
FIG. 12 is perspective cross-sectional view of structures of a first locking mechanism 104 and a second locking mechanism 106 of the grinder 102 according to the second embodiment, when seen from rear-upper-left side.

As shown in FIG. 12, the first locking mechanism 104 is attached to the rear portion of the bearing box 10. The first locking mechanism 104 includes a slide plate 108 and a compression spring 110.

Figure 13:
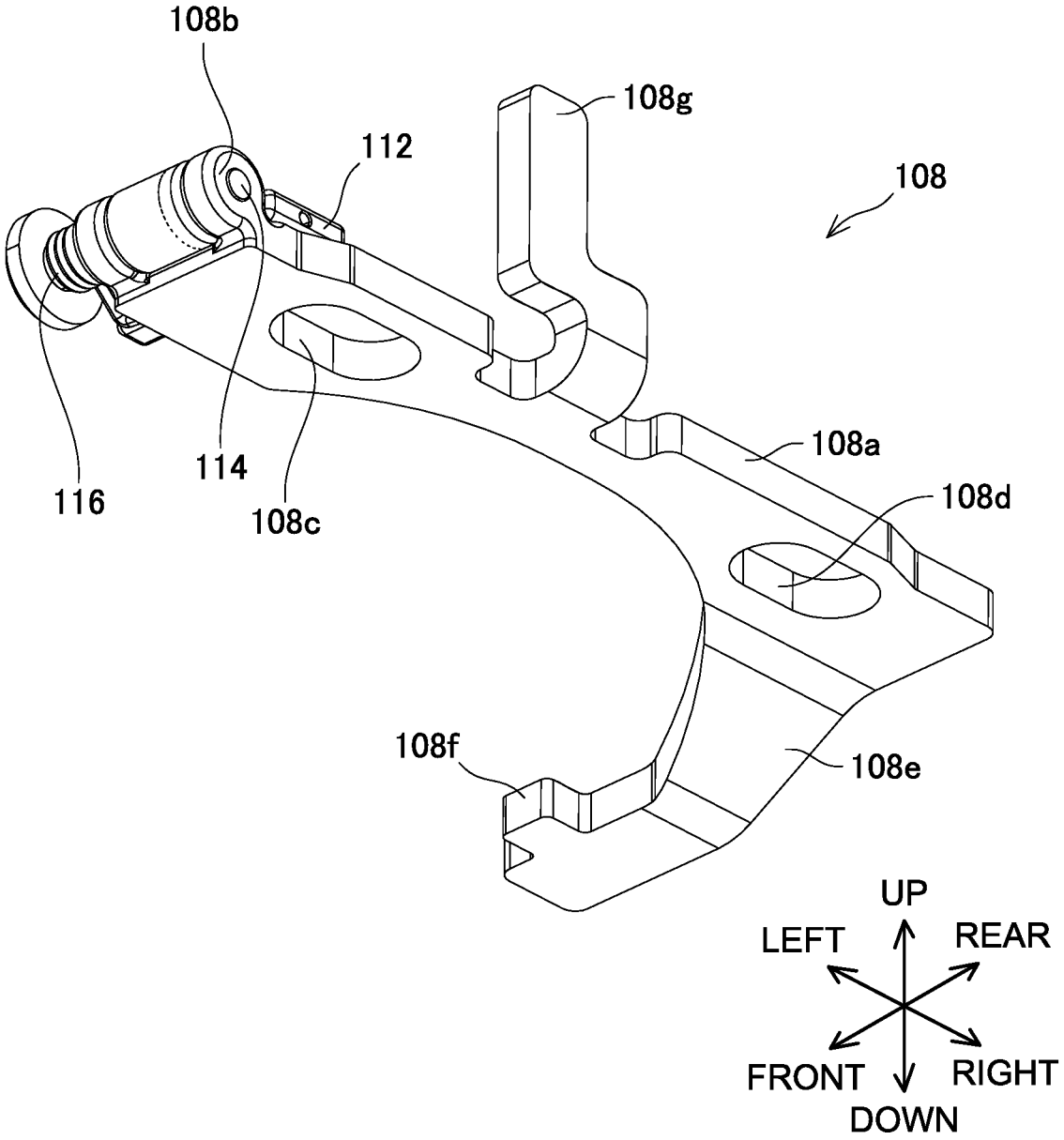
FIG. 13 is a perspective view of a slide plate 108 of the grinder 102 according to the second embodiment.

As shown in FIG. 13, the slide plate 108 includes a flat plate-shaped base portion 108*a* that extends in the right-left direction so as not to interfere with the gear housing 8 and the bearing box 10, a bearing portion 108*b* located at a left end of the base portion 108*a*, elongated holes 108*c* and 108*d* that are formed in the portion 108*a* and have their longitudinal directions in the right-left direction, a support portion 108*c* that extends forward and downward from a right end of the base portion 108*a*, a lock portion 108*f* that protrudes leftward from near a front end of the support portion 108*e*, and an upward protrusion 108*g* that protrudes upward between the elongated holes 108*c* and 108*d* of the base portion 108*a*.

As shown in FIG. 12, the slide plate 108 is attached to the rear-left screw 46*c* and the rear-right screw 46*d* among the screws 46*a*, 46*b*, 46*c*, and 46*d* securing the bearing box 10 to the gear housing 8. The screw 46*c* passes through the elongated hole 108*c* of the slide plate 108 and further passes through the height adjusting sleeve 72*a* to fasten the bearing box 10 with the gear housing 8. The screw 46*d* passes through the elongated hole 108*d* of the slide plate 108 and further passes through the height adjusting sleeve 72*b* to fasten the bearing box 10 with the gear housing 8. The slide plate 108 is supported by the bearing box 10 such that it is movable in the right-left direction.

The through hole 10*a* through which the upward protrusion 108*g* of the slide plate 108 passes is formed in the bearing box 10. The upward protrusion 108*g* of the slide plate 108 enters the inside of the gear housing 8 via the through hole 10*a*. The compression spring 110 is housed inside the gear housing 8 and biases the upward protrusion 108*g* of the slide plate 108 leftward with respect to the gear housing 8. That is, the compression spring 110 biases the slide plate 108 leftward with respect to the bearing box 10, that is, it biases the lock portion 108*f* toward the cover mounting portion 60.

The second locking mechanism 106 is attached to the bearing portion 108*b* of the slide plate 108. The second locking mechanism 106 include a stopper member 112, a hinge pin 114, and a torsion spring 116. The stopper member 112 is rotatably supported by the bearing portion 108*b* of the slide plate 108 via the hinge pin 114 having a longitudinal direction in the front-rear direction. Therefore, the stopper member 112 is rotatable about a rotation axis extending in the front-rear direction with respect to the slide plate 108. The torsion spring 116 biases the stopper member 112 with respect to the slide plate 108 in a rotation direction along which the stopper member 112 approaches an upper surface of the base portion 108*a* of the slide plate 108. Therefore, in the state where the user does not touch the stopper member 112, the stopper member 112 is in contact with the upper surface of the base portion 108*a* of the slide plate 108 as shown in FIG. 12. In this state, the stopper member 112 interferes with the sleeve 72*a* of the bearing box 10 when the slide plate 108 is moved rightward with respect to the bearing box 10, by which the rightward movement of the slide plate 108 is prohibited.

Figure 14:
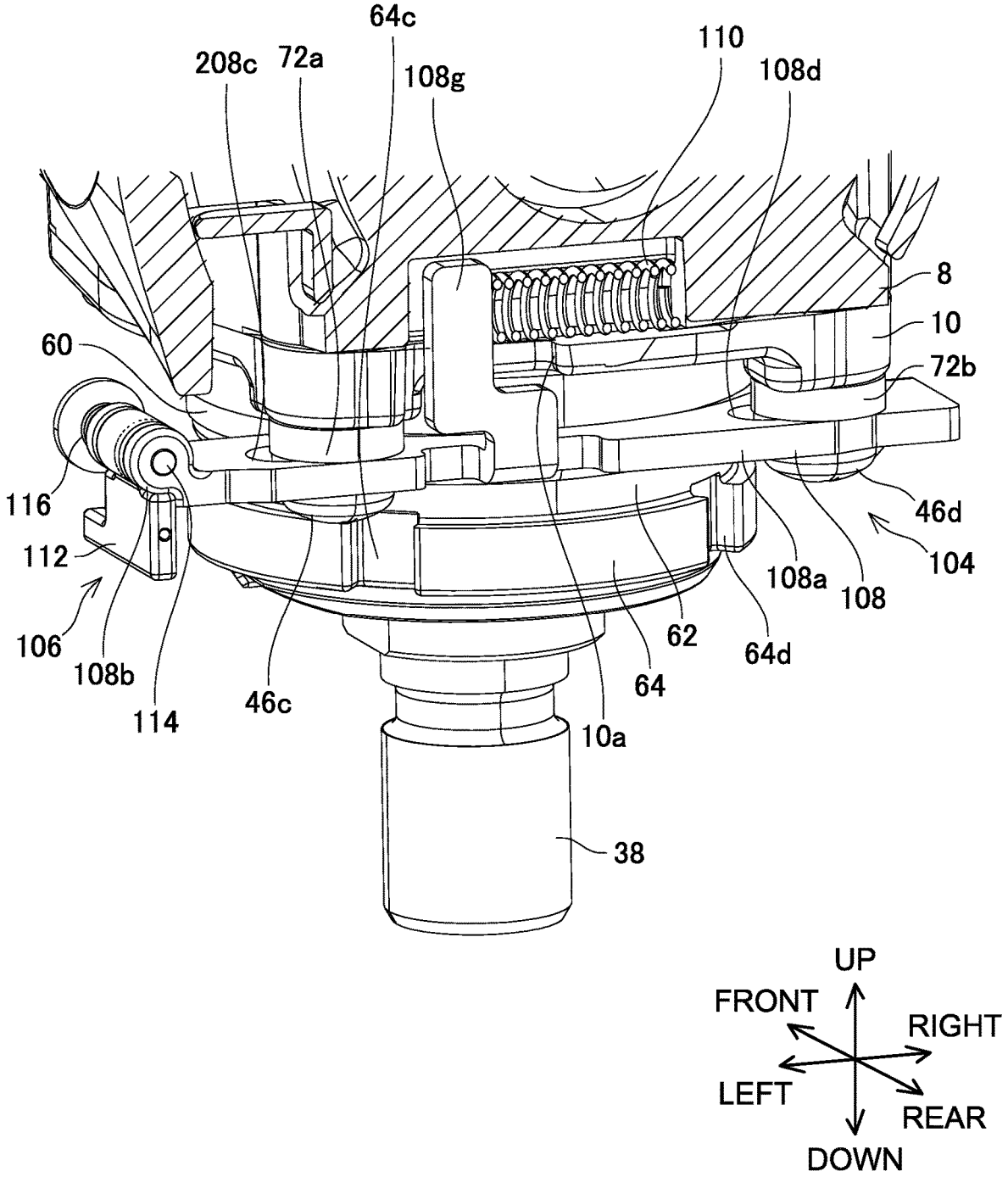
FIG. 14 is a perspective cross-sectional view of the structures of the first locking mechanism 104 and the second locking mechanism 106 of the grinder 102 according to the second embodiment in the state where a stopper member 112 is rotated outward, when seen from rear-upper-left side.

As shown in FIG. 14, the stopper member 112 separates away from the upper surface of the base portion 108*a* of the slide plate 108 when the user rotates the topper member 112 outward. In this state, the stopper member 112 does not interfere with the sleeve 72*a* of the bearing box 10 when the slide plate 108 is moved rightward with respect to the bearing box 10, by which the rightward movement of the slide plate 108 is allowed.

When the wheel cover 12 is to be attached to the cover mounting portion 60, the user aligns the engagement ribs 52*a*, 52*b*, 52*c*, 52*d*, and 52*e* of the wheel cover 12 with the notches 64*a*, 64*b*, 64*c*, 64*d*, and 64*e* of the cover mounting portion 60. Then, as shown in FIG. 14, the user pushes the slide plate 108 rightward while rotating the stopper member 112 outward to separate the lock portion 108*f* away from the cover mounting portion 60 and slides the wheel cover 12 upward with respect to the bearing box 10 such that the cover mounting portion 60 is located inside the band portion 52. In this way, the wheel cover 12 is attached to the cover mounting portion 60.

Thereafter, when the user rotates the wheel cover 12 with respect to the bearing box 10 to align the lock portion 108*f* of the slide plate 108 with one of the plurality of through holes 52*f* of the band portion 52 and releases the hand from the slide plate 108, the slide plate 108 is moved leftward by the biasing force of the compression spring 110, the lock portion 108*f* engages with the through hole 52*f*, and the stopper member 112 is rotated inward such that it contacts the upper surface of the base portion 108*a* as shown in FIG. 12. In this state, the wheel cover 12 is engaged with the slide plate 108, thus the rotation of the wheel cover 12 with respect to the bearing box 10 is prohibited and the wheel cover 12 is fixed to the bearing box 10. To change the rotational angle of the wheel cover 12 with respect to the bearing box 10, the user pushes the slide plate 108 rightward while rotating the stopper member 112 outward to disengage the lock portion 108*f* from the through hole 52*f*, as a result of which the wheel cover 12 can be rotated with respect to the bearing box 10. By appropriately selecting which through hole 52*f* the lock portion 108*f* is to be inserted into, a rotational angle at which the wheel cover 12 is fixed to the bearing box 10 can be selected.

When the wheel cover 12 is to be detached from the cover mounting portion 60, the user pushes the slide plate 108 rightward while rotating the stopper member 112 outward to disengage the lock portion 108*f* from the through hole 52*f*, as a result of which the wheel cover 12 becomes rotatable with respect to the bearing box 10 as shown in FIG. 14. Then, after rotating the wheel cover 12 to the detachable position with respect to the bearing box 10, the user slides the wheel cover 12 downward with respect to the bearing box 10. The engagement ribs 52*a*, 52*b*, 52*c*, 52*d*, and 52*e* of the wheel cover 12 pass through the notches 64*a*, 64*b*, 64*c*, 64*d*, and 64*e* of the cover mounting portion 60, as a result of which the wheel cover 12 can be detached from the cover mounting portion 60.

In the present embodiment, the grinder 102 (an example of the electric power tool) comprises the motor 14; the bevel gear 40 (an example of the power transmission mechanism) connected to the motor 14; the housing 50 that houses the motor 14 and the bevel gear 40; the spindle 38 (an example of the tip tool holder) connected to the bevel gear 40; the wheel cover 12 (an example of the cover) covering at least a part of the spindle 38, the first locking mechanism 104 configured to switch between a first locking state and a first unlocked state, wherein the first locking mechanism 104 switches from the first locking state to the first unlocked state in response to a first unlocking operation by the user; and the second locking mechanism 106 configured to switch between a second locking state and a second unlocked state, wherein the second locking mechanism 106 switches from the second locking state to the second unlocked state in response to a second unlocking operation by the user. In the grinder 102, the wheel cover 12 becomes detachable from the housing 50 when the user performs the second unlocking operation on the second locking mechanism 106 and the first unlocking operation on the first locking mechanism 104.

According to the above configuration, the wheel cover 12 will not be detached from the housing 50 unless the first unlocking operation is performed on the first locking mechanism 104 and the second unlocking operation is performed on the second locking mechanism 106. Therefore, even when the first unlocking operation is accidentally performed on the first locking mechanism 104, the wheel cover 12 cannot be detached from the housing 50 unless the second unlocking operation is performed on the second locking mechanism 106. On the contrary, even when the second unlocking operation is accidentally perfumed on the second locking mechanism 106, the wheel cover 12 cannot be detached from the housing 50 unless the first unlocking operation is performed on the first locking mechanism 104. According to the above configuration, it is possible to reliably prevent the wheel cover 12 from being unintentionally detached from the housing 50.

In the present embodiment, the first locking mechanism 104 is configured to prohibit the wheel cover 12 from being detached from the housing 50 in the first locking state, and allow the wheel cover 12 to be detached from the housing 50 in the first unlocked state. The second locking mechanism 106 is configured to prohibit the first locking mechanism 104 from switching from the first locking state to the first unlocked state in the second locking state, and allow the first locking mechanism 104 to switch from the first locking state to the first unlocked state in the second unlocked state.

According to the above configuration, the first unlocking operation cannot be performed on the first locking mechanism 104 unless the second unlocking operation is performed on the second locking mechanism 106. Further, even when the second unlocking operation is performed on the second locking mechanism 106, the wheel cover 12 cannot de detached from the housing 50 unless the first unlocking operation is performed on the first locking mechanism 104. According to the above configuration, it is possible to reliably prevent the wheel cover 12 from being unintentionally detached from the housing 50.

In the present embodiment, the first locking mechanism 104 includes the slide plate 108 (an example of the first slidable member) supported by the housing 50 so as to be movable in a first sliding direction (e.g., the right-left direction) that is substantially orthogonal to the rotation axis of the spindle 38. When the first locking mechanism 104 is in the first locking state, the slide plate 108 is at a first locking position at which the slide plate 108 engages with the wheel cover 12. When the first locking mechanism 104 is in the first unlocked state, the slide plate 108 is at a first unlocked position at which the slide plate 108 does not engage with the wheel cover 12. In response to the first unlocking operation by the user, the slide plate 108 moves from the first locking position to the first unlocked position. The second locking mechanism 106 is configured to prohibit the slide plate 108 from moving from the first locking position to the first unlocked position in the second locking state, and allow the slide plate 108 to move from the first locking position to the first unlocked position in the second unlocked state.

According to the above-described configuration, it is possible to prevent the wheel cover 12 from being detached from the housing 50 by the first locking mechanism 104 with a simple configuration.

In the present embodiment, the wheel cover 12 includes the plurality of through holes **52*f* (example of the engaged portions) arranged circumferentially about the rotation axis of the spindle 38. The slide plate 108 includes the lock portion 108*f* (an example of the engagement portion) configured to engage with any one of the through holes 52*f*. When the first locking mechanism 104 is in the first locking state, the slide plate 108 is at the first locking position at which the lock portion 108*f* engages with one of the through holes 52*f*. When the first locking mechanism 104 is in the first unlocked state, the slide plate 108 is at the first unlocked position at which the lock portion 108*f* does not engage with any of the through holes 52*f*. In response to the first unlocking operation by the user, the slide plate 108** moves from the first locking position to the first unlocked position.

The above configuration can realize fixation of the rotational angle of the wheel cover 12 with respect to the housing 50 as well as prevention of detachment of the wheel cover 12 from the housing 50, by the first locking mechanism 104 with a simple configuration.

In the present embodiment, the second locking mechanism 106 includes the stopper member 112 (an example of the second rotatable member) rotatably supported by the slide plate 108. When the second locking mechanism 106 is in the second locking state, the stopper member 112 is at a second locking angle at which the stopper member 112 interferes with the housing 50 when the slide plate 108 moves from the first locking position to the first unlocked position. When the second locking mechanism 106 is in the second unlocked state, the stopper member 112 is at a second unlocked angle at which the stopper member 112 does not interfere with the housing 50 when the slide plate 108 moves from the first locking position to the first unlocked position. In response to the second unlocking operation by the user, the stopper member 112 rotates from the second locking angle to the second unlocked angle.

In the above configuration, the second locking mechanism 106 is integrated with the first locking mechanism 104, thus the configurations of the first locking mechanism 104 and the second locking mechanism 106 can be further simplified.

Third Embodiment

Figure 15:
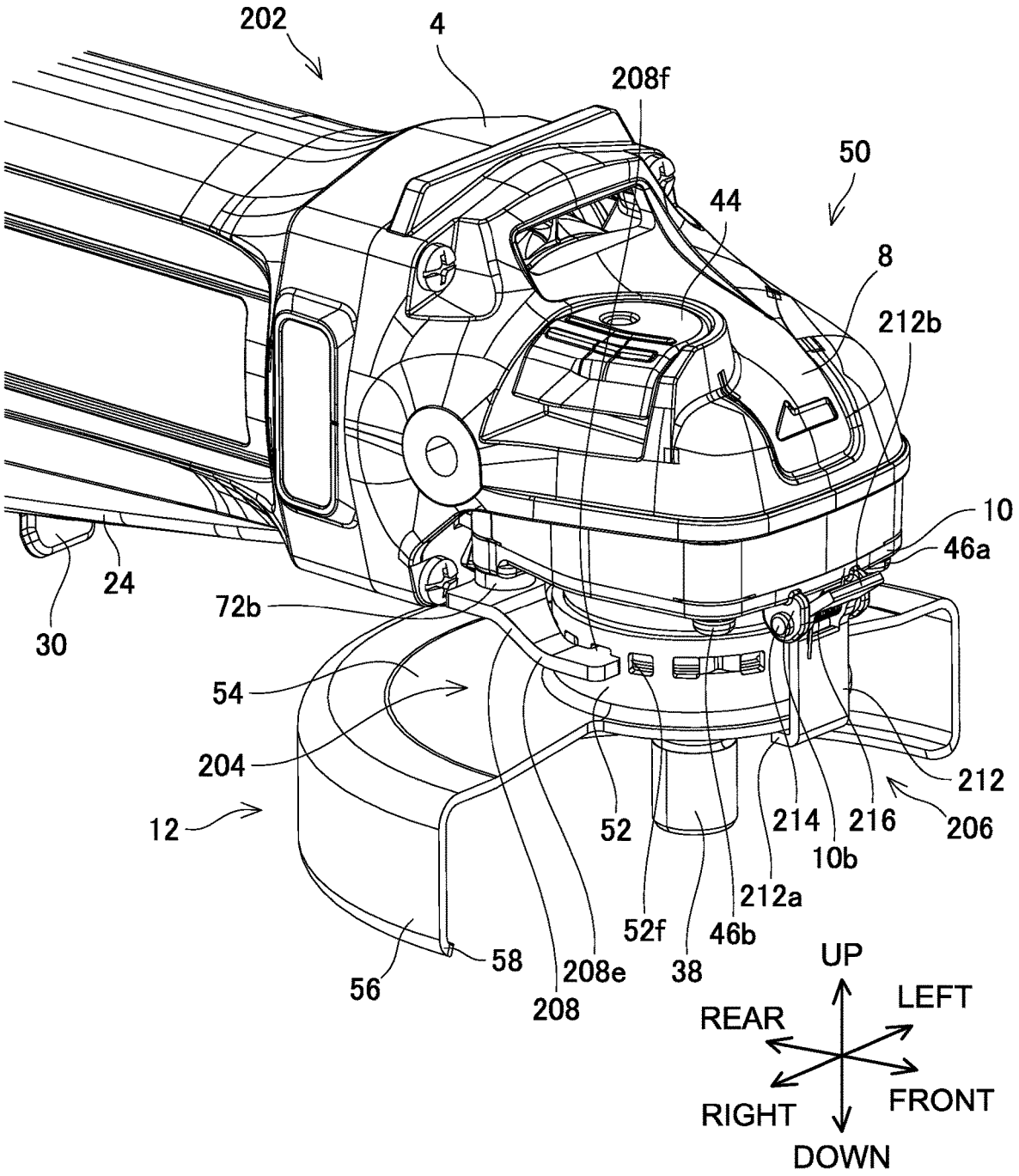
FIG. 15 is a perspective view of a front portion of a grinder 202 according to a third embodiment, when seen from front-upper-right side.
Figure 16:
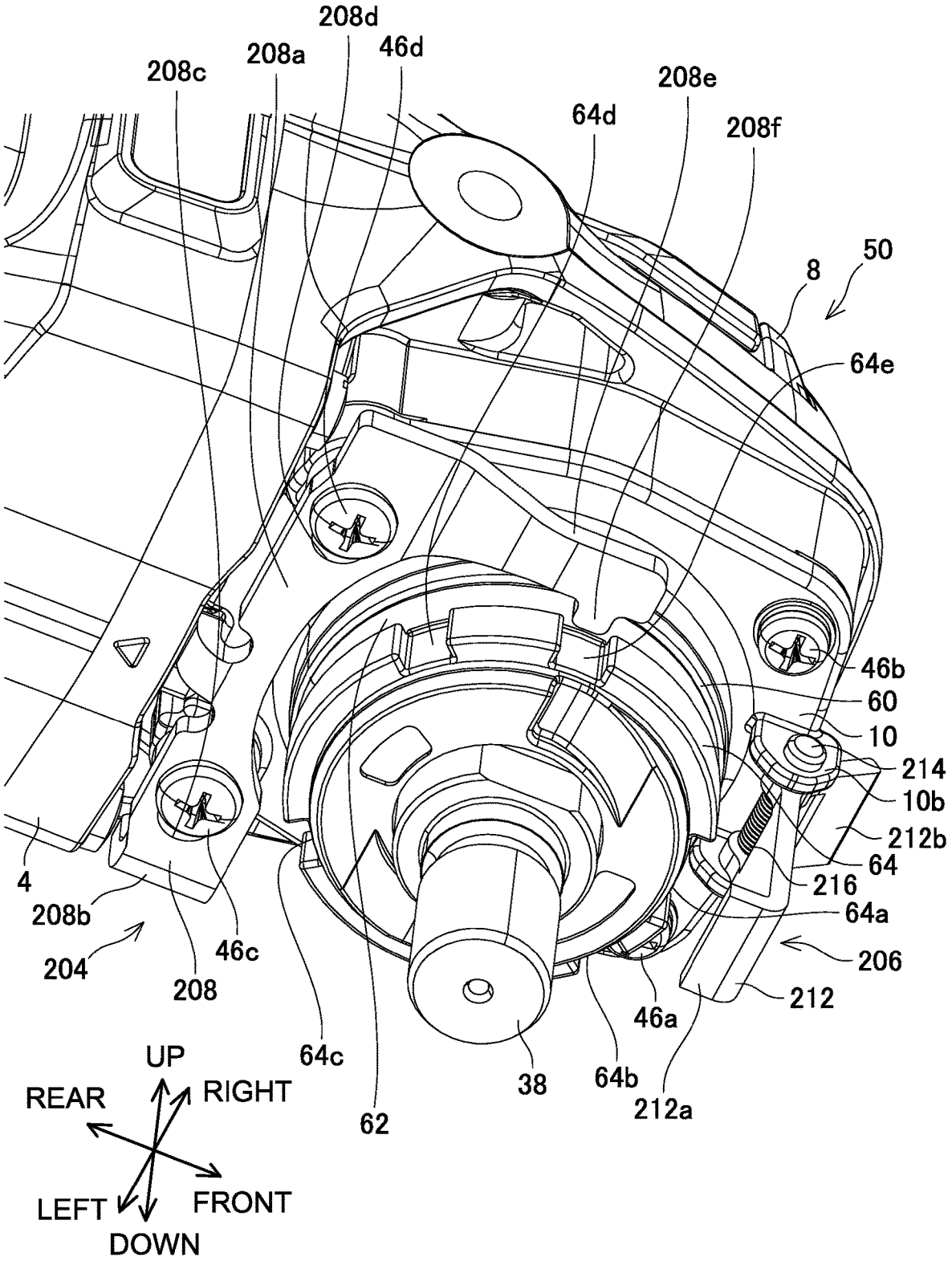
FIG. 16 is a perspective view of a structure around the cover mounting portion 60 of the grinder 202 according to the third embodiment, when seen from rear-lower-right side.

As shown in FIG. 15, a grinder 202 according to the present embodiment has substantially the same configuration as the grinder 2 according to the first embodiment. Hereinafter, regarding the grinder 202 according to the present embodiment, differences from the grinder 2 according to the first embodiment will be described. As shown in FIG. 16, the grinder 202 includes a first locking mechanism 204 instead of the first locking mechanism 66, and a second locking mechanism 206 instead of the second locking mechanism 74.

Figure 17:
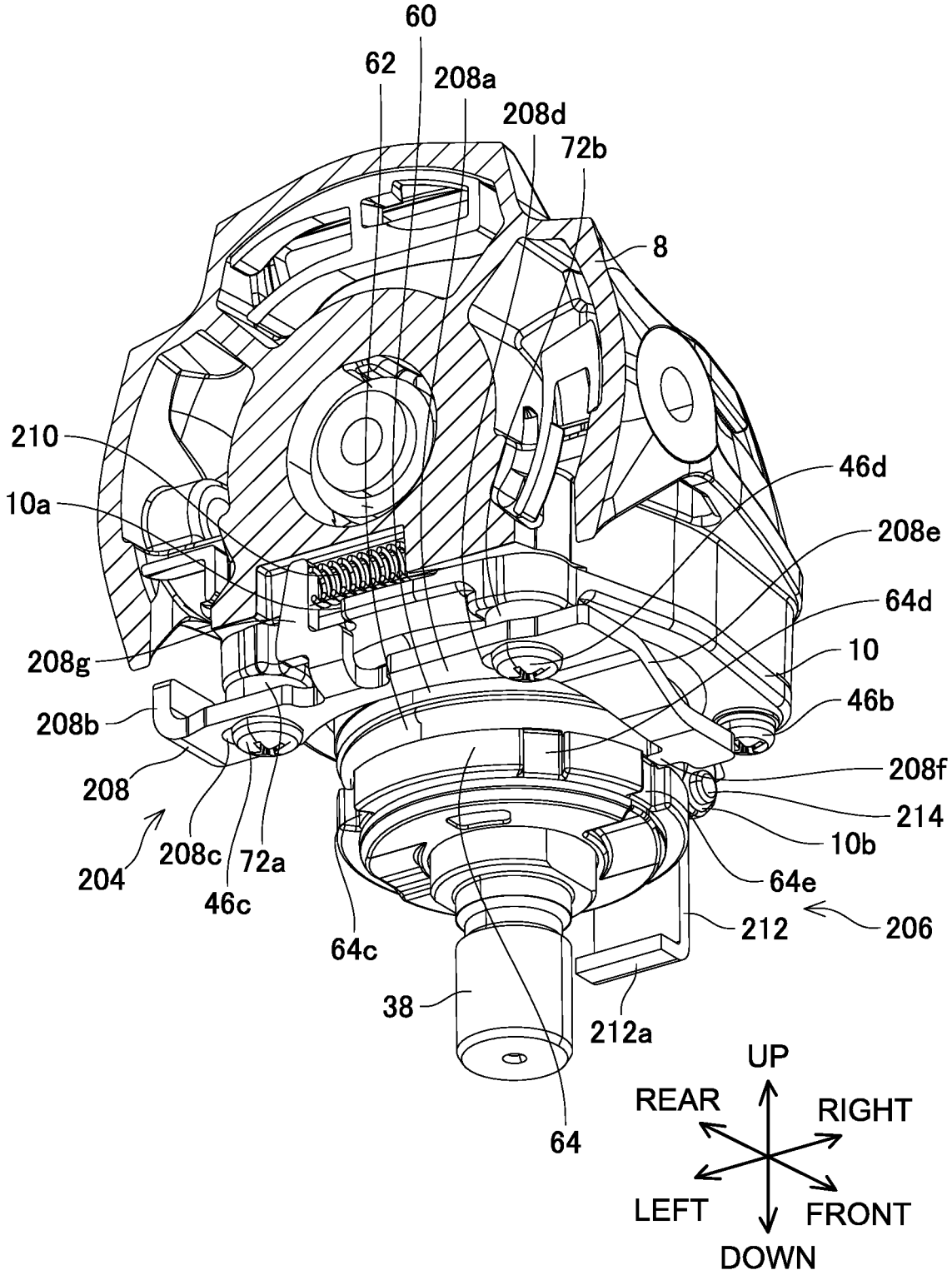
FIG. 17 is a perspective cross-sectional view of a structure of a first locking mechanism 204 of the grinder 202 according to the third embodiment, when seen from rear-lower-right side.

As shown in FIG. 17, the first locking mechanism 204 is attached to the rear portion of the bearing box 10. The first locking mechanism 204 includes a slide plate 208 and a compression spring 210.

Figure 18:
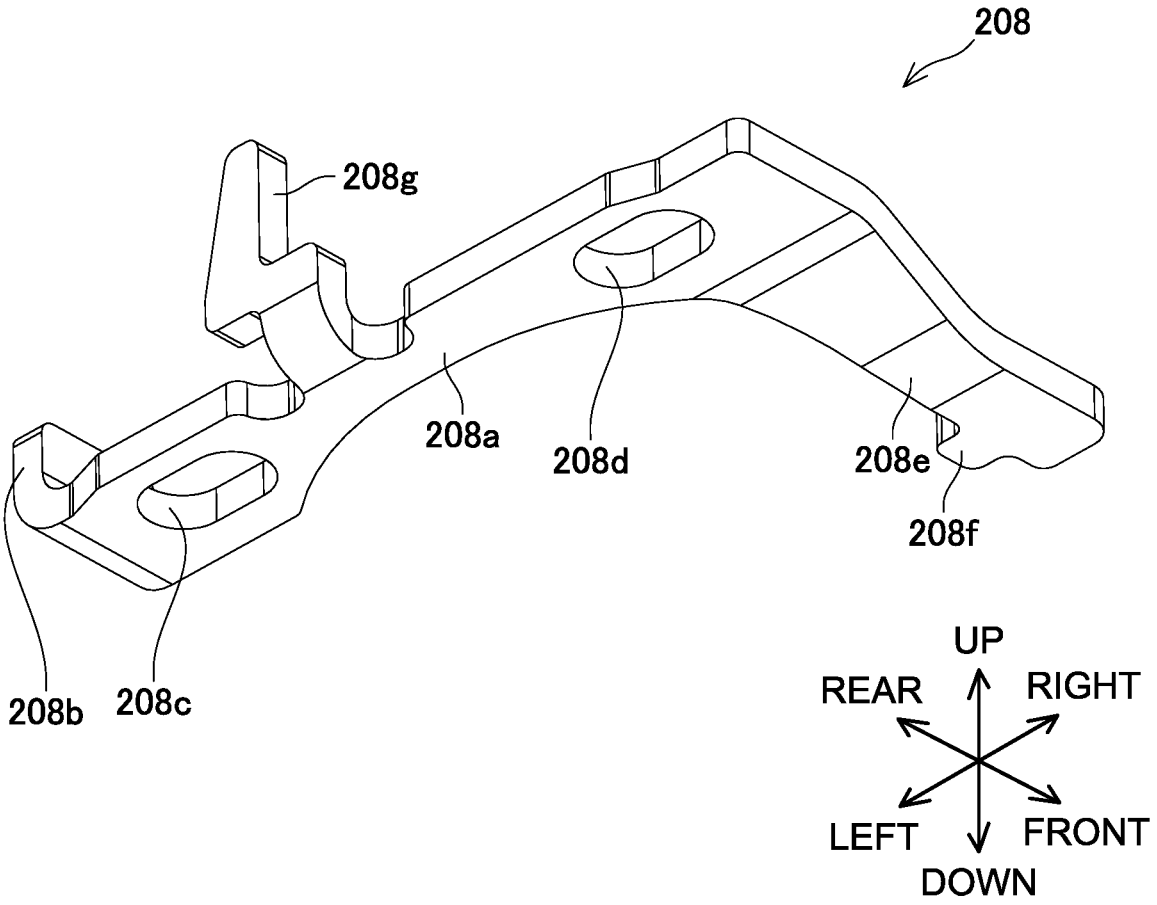
FIG. 18 is a perspective view of a slide plate 208 of the grinder 202 according to the third embodiment.

As shown in FIG. 18, the slide plate 208 includes a flat plate-shaped base portion **208*a* that extends in the right-left direction without interfering with the gear housing 8 nor the bearing box 10, a manipulatable portion 208*b* that extends upward from a left end of the base portion 208*a*, elongated holes 208*c* and 208*d* that are formed in the base portion 208*a* and have their longitudinal directions in the right-left direction, a support portion 208*e* that extends forward and downward from a right end of the base portion 208*a*, a lock portion 208*f* that protrudes leftward from near a front end of the support portion 208*e*, and an upward protrusion 208*g* that protrudes upward between the elongated holes 208*c* and 208*d* of the base portion 208*a***.

As shown in FIG. 17, the slide plate 208 is attached to the rear-left screw **46*c* and the rear right screw 46*d* among the screws 46***a*, 46*b*, 46*c*, and 46*d* securing the bearing box 10 to the gear housing 8. The s screw 46*c* passes through the elongated hole 208*c* of the slide plate 208 and further passes through the height adjusting sleeve 72*a* to fasten the bearing box 10 with the gear housing 8. The screw 46*d* passes through the elongated hole 208*d* of the slide plate 208 and further passes through the height adjusting sleeve 72*b* to fasten the bearing box 10 with the gear housing 8. The slide plate 208 is supported by the bearing box 10 such that it is movable in the right-left direction.

The through hole 10*a* through which the upward protrusion 208*g* of the slide plate 208 passes is formed in the bearing box 10. The upward protrusion 208*g* of the slide plate 208 enters the inside of the gear housing 8 via the through bole 10*a*. The compression spring 210 is housed inside the gear housing 8 and biases the upward protrusion 208*g* of the slide plate 208 leftward with respect to the gear housing 8. That is, the compression spring 210 biases the slide plate 208 leftward with respect to the bearing box 10, that is, it biases the lock portion 208*f* toward the cover mounting portion 60.

Figure 19:
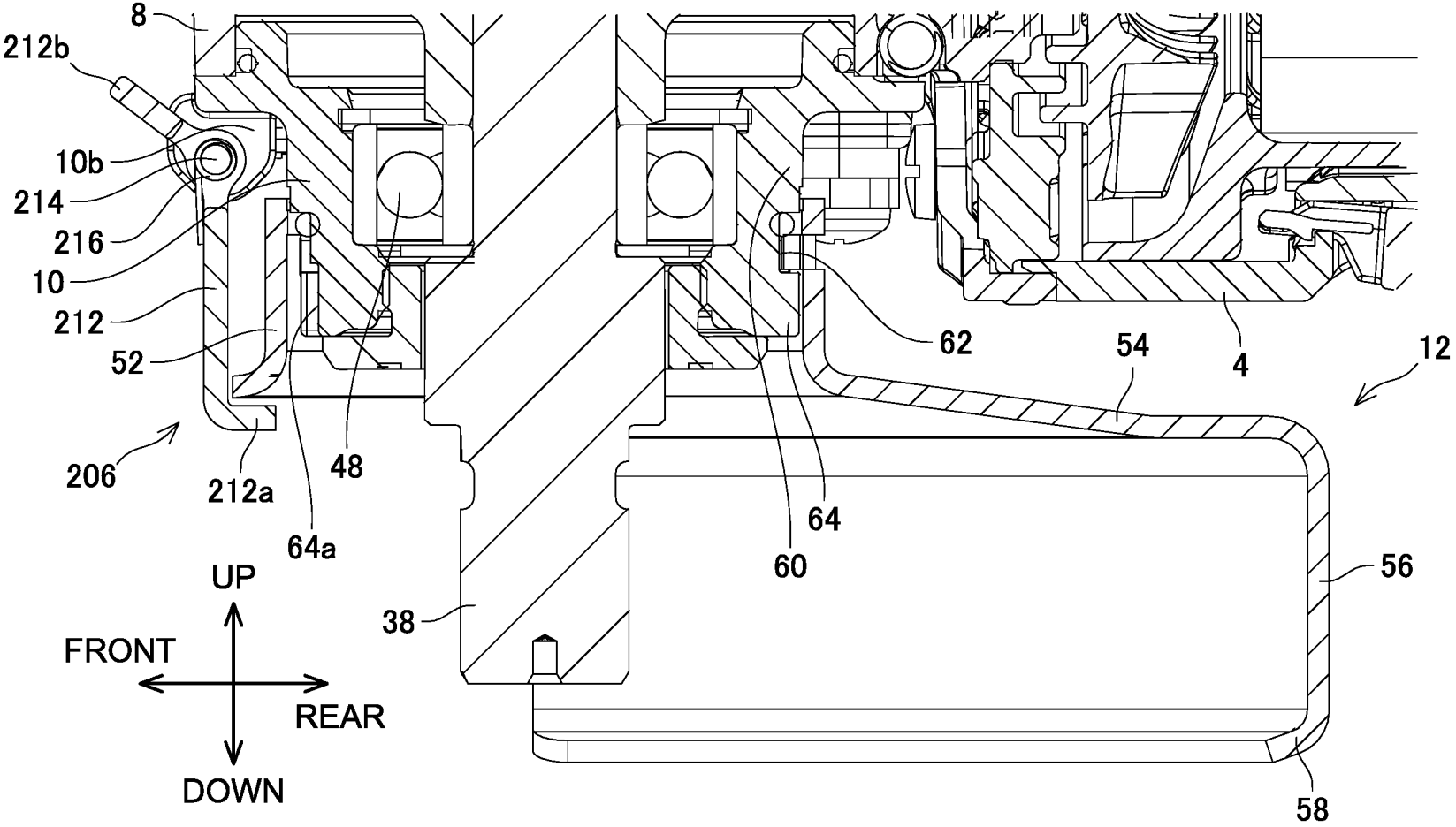
FIG. 19 is a longitudinal sectional view of the front portion of the grinder 202 according to the third embodiment.

As shown in FIG. 15, the second locking mechanism 206 is attached to the front portion of the bearing box 10. The second locking mechanism 206 includes a rotatable member 212, a hinge pin 214, and a torsion spring 216. The rotatable member 212 is rotatably supported by a bearing portion 10*b* of the bearing box 10 via the hinge pin 214 having a longitudinal direction in the right-left direction. Therefore, the rotatable member 212 is rotatable about a rotation axis extending in the right-left direction with respect to the bearing box 10. The rotatable member 212 includes a protrusion 212*a* and a manipulatable portion 212*b*. The protrusion 212*a* protrudes rearward from a lower end of the rotatable member 212. The torsion spring 216 biases the rotatable member 212 with respect to the bearing box 10 in a rotation direction along which the protrusion 212*a* approaches the cover mounting portion 60. Therefore, in the state where the user does not touch the rotatable member 212, the protrusion 212*a* is located below the band portion 52 and the upper surface portion 54 of the wheel cover 12 as shown in FIG. 19. In this state, the protrusion 212*a* of the rotatable member 212 interferes with the wheel cover 12 when the wheel cover 12 is slid downward with respect to the bearing box 10, by which the downward slide of the wheel cover 12 is prohibited.

When the user rotates the rotatable member 212 by pushing the manipulatable portion 212*b* of the rotatable member 212 upward, the protrusion 212*a* moves to separate away from the cover mounting portion 60. In this state, the protrusion 212*a* of the rotatable member 212 does not interfere with the wheel cover 12 when the wheel cover 12 is slid downward with respect to the bearing box 10, by which the downward slide of the wheel cover 12 is allowed.

Figure 20:
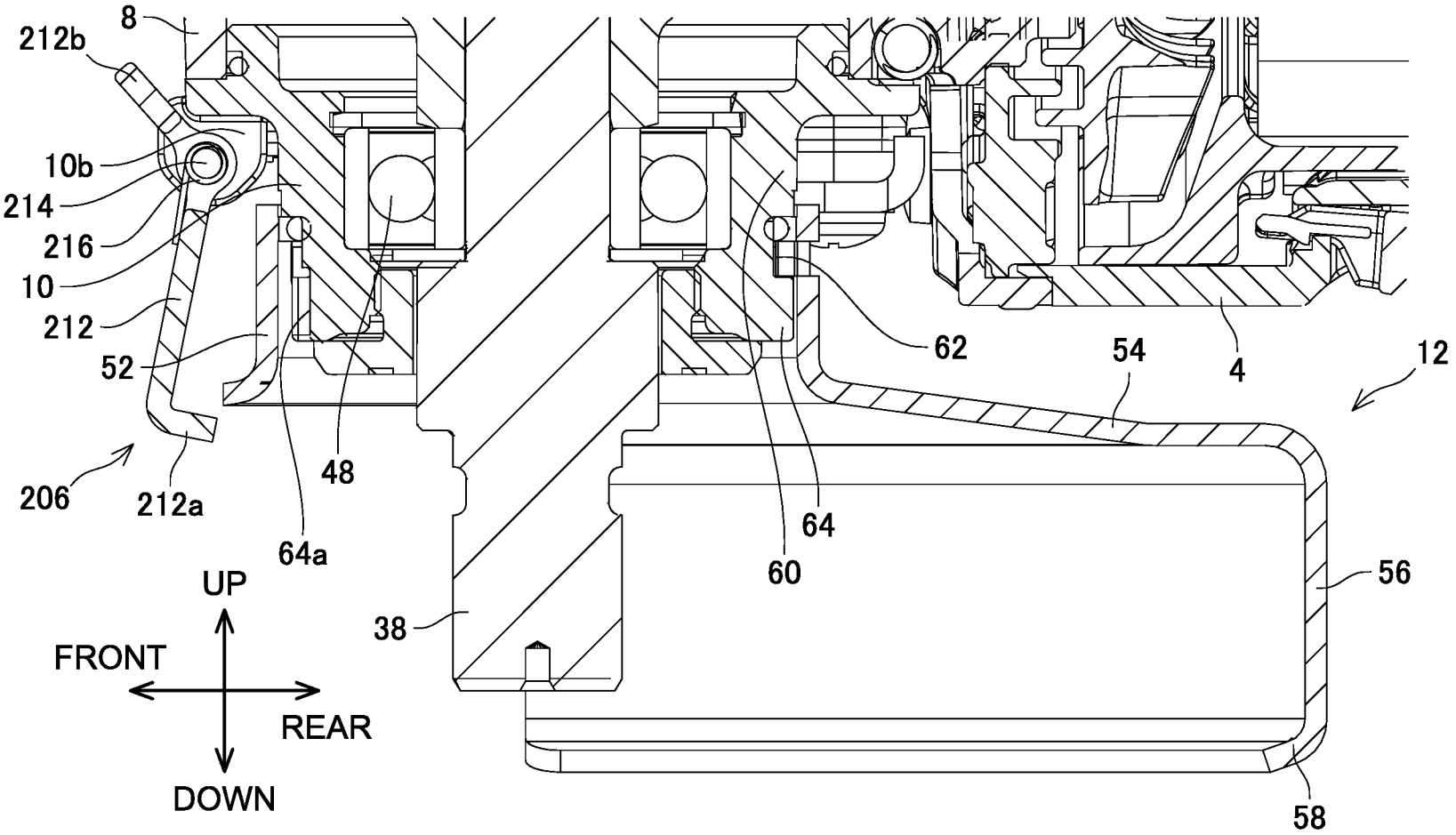
FIG. 20 is a longitudinal sectional view of the front portion of the grinder 202 according to the third embodiment in a state where rotatable member 212 is rotated.

When the wheel cover 12 is to be attached. to the cover mounting portion 60, the user aligns the engagement ribs 52*a*, 52*b*, 52*c*, 52*d*, and 52*e* of the wheel cover 12 with the notches 64*a*, 64*b*, 64*c*, 64*d*, and 64*e* of the cover mounting portion 60. Then, as shown in FIG. 20, the user pushes the slide plate 208 rightward while rotating the rotatable member 212 by pushing the manipulatable portion 212*b* of the rotatable member 212 upward to separate the lock portion 208*f* away from the cover mounting portion 60 and slides the wheel cover 12 upward with respect to the bearing box 10 such that the cover mounting portion 60 is located inside the band portion 52. In this way, the wheel cover 12 is attached to the cover mounting portion 60. Thereafter, when the user releases the hand from the rotatable member 212, the protrusion 212*a* of the rotatable member 212 is located below the band portion 52 and the upper surface portion 54 of the wheel cover 12 as shown in FIG. 19. The downward slide of the wheel cover 12 is thereby prohibited. Even when the wheel cover 12 is at the detachable position, the wheel cover 12 cannot be detached from the bearing box 10.

Thereafter, when the user rotates the wheel cover 12 with respect to the bearing box 10 to align the lock portion 208*f* of the slide plate 208 with one of the plurality of through holes 52*f* of the band portion 52 and releases the hand from the slide plate 208, the slide plate: 208 is moved leftward by the biasing force of the compression spring 210 and the lock portion 208*f* engages with the through hole 52*f*. In this state, the wheel cover 12 is engaged with the slide plate 208, thus the rotation of the wheel cover 12 with respect to the bearing box 10 is prohibited and the wheel cover 12 is fixed to the bearing box 10. To change the rotational angle of the wheel cover 12 with respect to the bearing box 10, the user pushes the slide plate 208 rightward to disengage the lock portion 208*f* from the through hole 52*f*, as a result of which the wheel cover 12 can be rotated with respect to the bearing box 10. By appropriately selecting which through hole 52*f* the lock portion 208*f* is to be inserted into, a rotational angle at which the wheel cover 12 is fixed to the bearing box 10 can be selected.

When the wheel cover 12 is to be detached from the cover mounting portion 60, the user pushes the slide plate 208 rightward to disengage the lock portion 208*f* from the through hole 52*f*, such that the wheel cover 12 becomes rotatable with respect to the bearing box 10. Then, as shown in FIG. 20, after rotating the wheel cover 12 to the detachable position with respect to the bearing box 10, the user slides the wheel cover 12 downward with respect to the bearing box 10 while pushing the manipulatable portion 212*b* of the rotatable member 212 upward to rotate the rotatable member 212. The engagement ribs 52*a*, 52*b*, 52*c*, 52*d*, and 52*e* of the wheel cover 12 passes through the notches 64*a*, 64*b*, 64*c*, 64*d*, and 64*e* of the cover mounting portion 60, as a result of which the wheel cover 12 can be detached from the cover mounting portion 60.

In the present embodiment, the grinder 202 (an example of the electric power tool) comprises the motor 14; the bevel gear 40 (an example of the power transmission mechanism) connected to the motor 14; the housing 50 that houses the motor 14 and the bevel gear 40; the spindle 38 (an example of the tip tool holder) connected to the bevel gear 40; the wheel cover 12 (an example of the cover) covering at least a part of the spindle 38; the first locking mechanism 204 configured to switch between a first locking state and a first unlocked state, wherein the first locking mechanism 204 switches from the first locking state to the first unlocked state in response to a first unlocking operation by the user; and the second locking mechanism 206 configured to switch between a second locking state and a second unlocked state, wherein the second locking mechanism 206 switches from the second locking state to the second unlocked state in response to a second unlocking operation by the user. In the grinder 202, the wheel cover 12 becomes detachable from the housing 50 when the user performs the second unlocking operation on the second locking mechanism 206 and the first unlocking operation on the first locking mechanism 204.

According to the above configuration, the wheel cover 12 will not be detached from the housing 50 unless the first unlocking operation is performed on the first locking mechanism 204 and the second unlocking operation is performed on the second locking mechanism 206. Therefore, even when the first unlocking operation is accidentally performed on the first locking mechanism 204, the wheel cover 12 cannot be detached from the housing 50 unless the second unlocking operation is performed on the second locking mechanism 206. On the contrary, even when the second unlocking operation is accidentally performed on the second locking mechanism 206, the wheel cover 12 cannot be detached from the housing 50 unless the first unlocking operation us performed on the first locking mechanism 204. According to the above configuration, it is possible to reliably prevent the wheel cover 12 from being unintentionally detached from the housing 50.

In the present embodiment, the first locking mechanism 204 is configured to prohibit the wheel cover 12 from rotating with respect to the housing 50 and being detached from the housing 50 in the first locking state, and allow the wheel cover 12 to rotate with respect to the housing 50 and be detached from the housing 50 in the first unlocked state. The second locking mechanism 206 is configured to prohibit the wheel cover 12 from being detached from the housing 50 in the second locking state, and allow the wheel cover 12 to be detached from the housing 50 in the second unlocked state.

The above configuration can reliably prevent the wheel cover 12 from being unintentionally detached from the housing 50 as well as fix the rotational angle of the wheel cover 12 with respect to the housing 50.

In the present embodiment, the wheel cover 12 includes the plurality of through holes. 52*f* (example of the engaged portions) arranged circumferentially about the rotation axis of the spindle 38. The first locking mechanism 204 includes the slide plate 208 (an example of the first slidable member) supported by the housing 50 so as to be movable in a first sliding direction (e.g., the right-left direction) that is substantially orthogonal to the rotation axis of the spindle 38. The slide plate 208 includes the lock portion 208*f* (an example of the engagement portion) configured to engage with any one of the through holes 52*f*. When the first locking mechanism 204 is in the first locking state, the slide plate 208 is at a first locking position at which the lock portion 208*f* engages with one of the through holes 52*f*. When the first locking mechanism 204 is in the first unlocked state, the slide plate 208 is at a first unlocked position at which the lock portion 208*f* does not engage with any of the through holes 52*f*. In response to the first unlocking operation by the user, the slide plate 208 moves from the first locking position to the first unlocked position.

The above configuration enables the first locking mechanism 204 with a simple configuration to realize both fixation of the rotational angle of the wheel cover 12 with respect to the housing 50 and preventing of detachment of the wheel cover 12 from the housing 50.

In the present embodiment, the first locking mechanism 204 further includes the compression spring 210 (an example of the first biasing member) configured to bias the slide plate 208 in a direction from the first unlocked position to the first locking position.

According to the above configuration, it is possible to automatically return the first locking mechanism 204 to the first locking state when the first unlocking operation is not performed on the first locking mechanism 204. The configuration can reliably prevent the wheel cover 12 from being unintentionally detached from the housing 50.

In the present embodiment, the slide plate 208 includes the base portion 208*a* extending in the first sliding direction, the manipulatable portion 208*b* disposed at one end of the base portion 208*a*, the elongated holes 208*c* and 208*d* formed in the base portion 208*a* and having their longitudinal directions in the first sliding direction, the support portion 208*e* disposed at another end of the base portion 208*a* and supporting the lock portion 208*f*, and the upward protrusion 208*g* (an example of the protrusion) disposed at the base portion 208*a* and configured to be biased by the compression spring 210. The slide plate 208 is supported by the housing 50 via the screws 46*c* and 46*d* (an example of the support member) penetrating the elongated holes 208*c* and 208*d*.

According to the above configuration, the configuration of the first locking mechanism 204 can be further simplified.

In the present embodiment, the second locking mechanism 206 includes the rotatable member 212 (an example of the second rotatable member) rotatably supported by the housing 50. When the second locking mechanism 206 is in the second locking state, the rotatable member 212 is at a second locking angle at which the rotatable member 212 engages with the wheel cover 12. When the second locking mechanism 206 is in the second unlocked state, the rotatable member 212 is at a second unlocked angle at which the rotatable member 212 does not engage with the wheel cover 12. In response to the second unlocking operation by the user, the rotatable member 212 rotates from the second locking angle to the second unlocked angle.

The above-described configuration enables the second locking mechanism 206 with a simple configuration to prevent the wheel cover 12 from being detached from the housing 50.

In the present embodiment, the rotatable member 212 is supported by the housing 50 so as to be rotatable about the rotation axis extending in a direction (e.g., the right-left direction) substantially orthogonal to the rotation axis of the spindle 38. The second locking mechanism 206 further includes the torsion spring 216 (an example of the second biasing member) configured to bias the rotatable member 212 in a direction from the second unlocked angle to the second locking angle. The rotatable member 212 includes the protrusion 212*a* configured to engage with the wheel cover 12 and the manipulatable portion 212*b* integrally formed with the protrusion 212*a*.

According to the above configuration, it is possible to automatically return the second. locking mechanism 206 to the second locking state when the second unlocking operation is not performed on the second locking mechanism 206. The configuration can reliably prevent the wheel cover 12 from being unintentionally detached from the housing 50. Further, according to the above configuration, the configuration of the second locking mechanism 206 can be further simplified.

Fourth Embodiment

Figure 21:
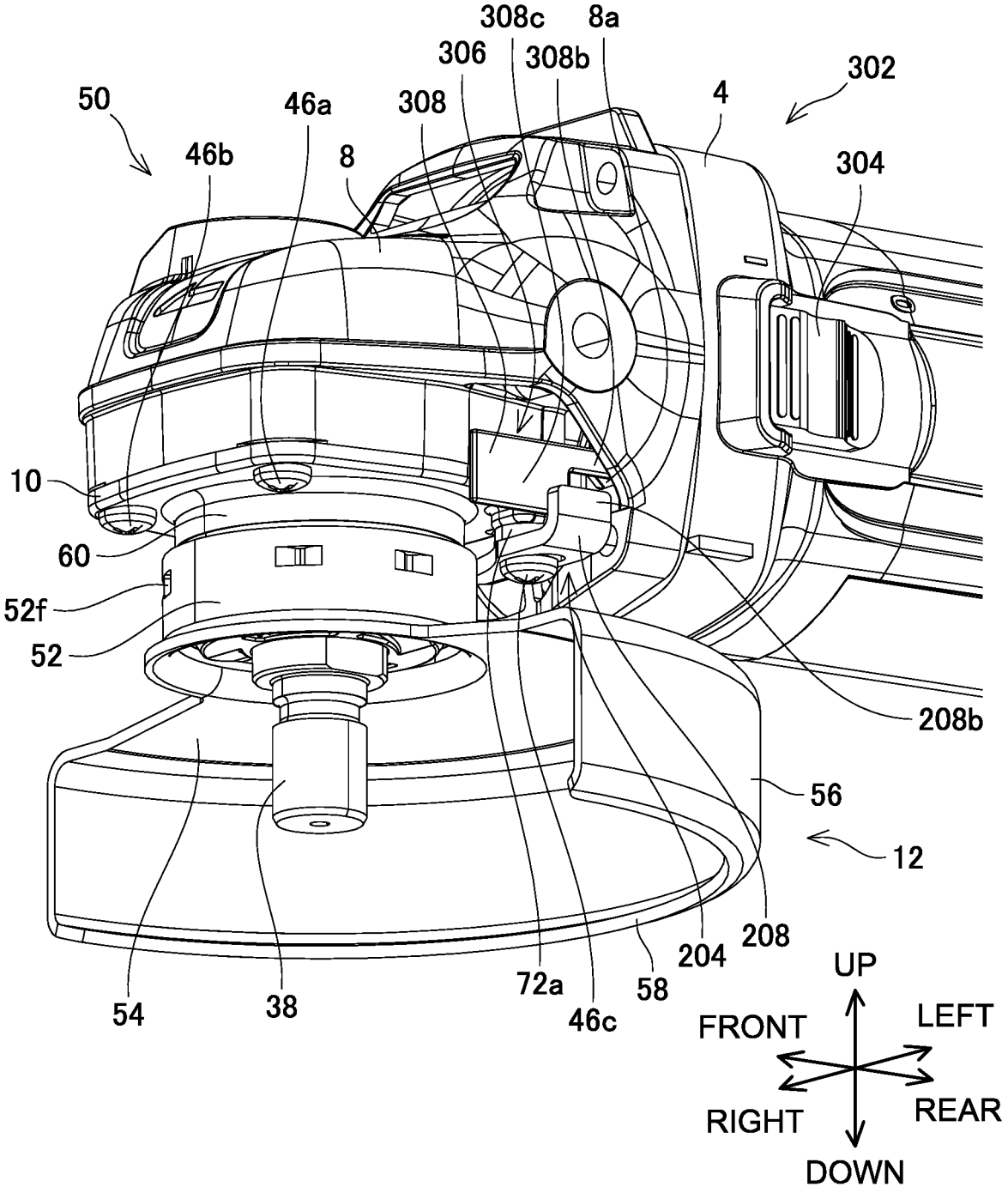
FIG. 21 is a perspective view of a front portion of a grinder 302 according to a fourth embodiment, when seen from front-lower-left side.
Figure 22:
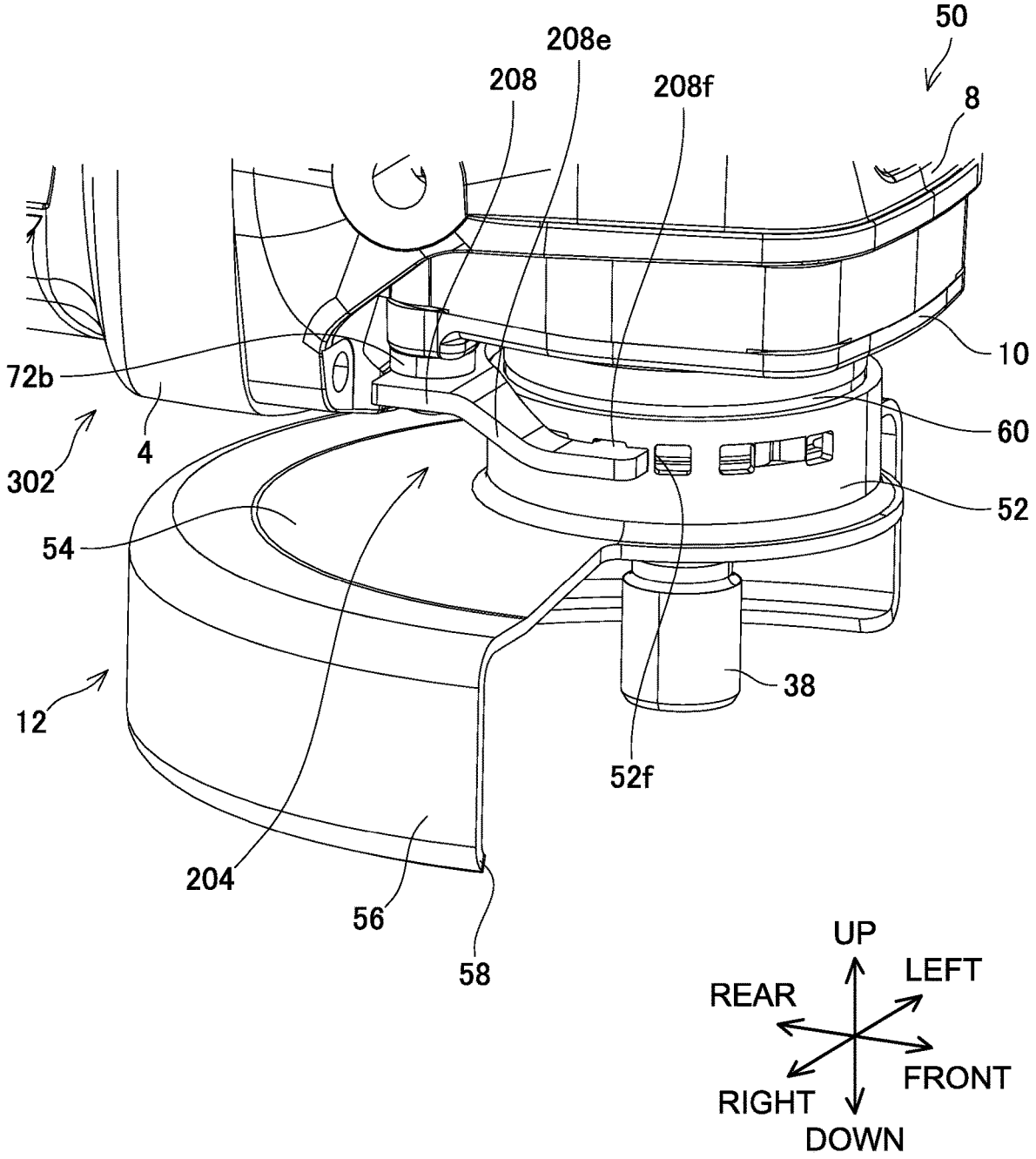
FIG. 22 is a perspective view of the front portion of the grinder 302 according to the fourth embodiment, when seen from front-upper-right side.
Figure 23:
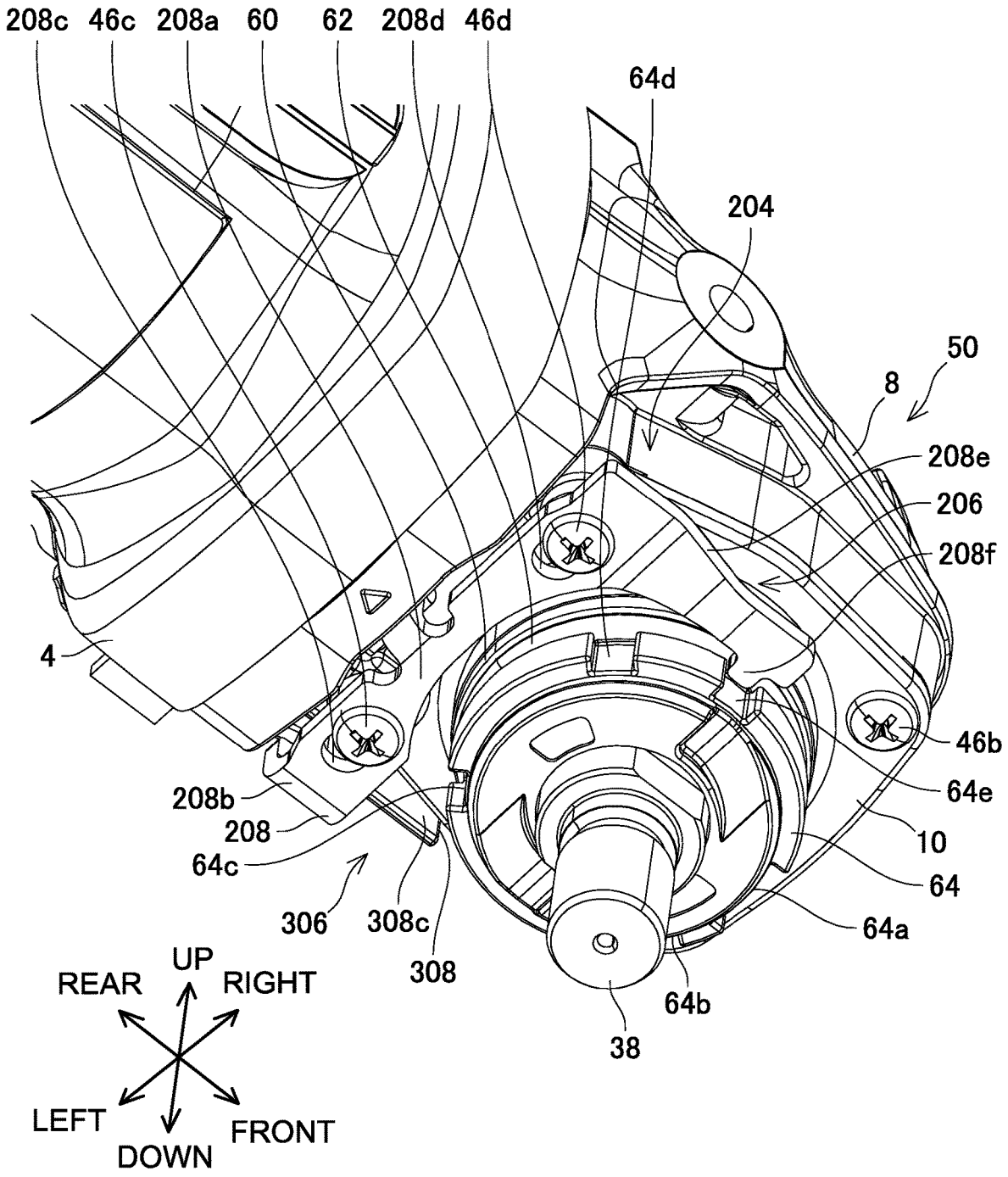
FIG. 23 is a perspective view of a structure around the cover mounting portion 60 of the grinder 302 according to the fourth embodiment., when seen from rear-lower-right side.

As shown in FIGS. 21 to 23, a grinder 302 according to the present embodiment has substantially the same configuration as the grinder 202 according to the third embodiment. Hereinafter, regarding the grinder 302 according to the present embodiment, differences from the grinder 202 according to the third embodiment will be described. As shown in FIG. 21, the grinder 302 includes a slide switch 304 instead of the paddle switch 24. The slide switch 304 is disposed on a left surface of the motor housing 4. The slide switch 304 is slidable in the front-rear direction with respect to the motor housing 4 between an advanced position and a retracted position located rearward of the advanced position. Further, the slide switch 304 is slidable in the up-down direction with respect to the motor housing 4 between the retracted position and an unlocked position located above the retracted position. When the user moves the slide switch 304 to the advanced position, a link (not shown) contacts the drive switch 28 (see FIG. 1) and the power is supplied to the motor 14 (see FIG. 1). When the user moves the slide switch 304 to the retracted position or the unlocked position, the link (not shown) separates away from the drive switch 28 and the power supply to the motor 14 is stopped.

The grinder 302 according to the present embodiment includes a second locking mechanism 306 instead of the second locking mechanism 206. The second locking mechanism 306 is attached to the motor housing 4. The second locking mechanism 306 includes a slidable member 308.

Figure 24:
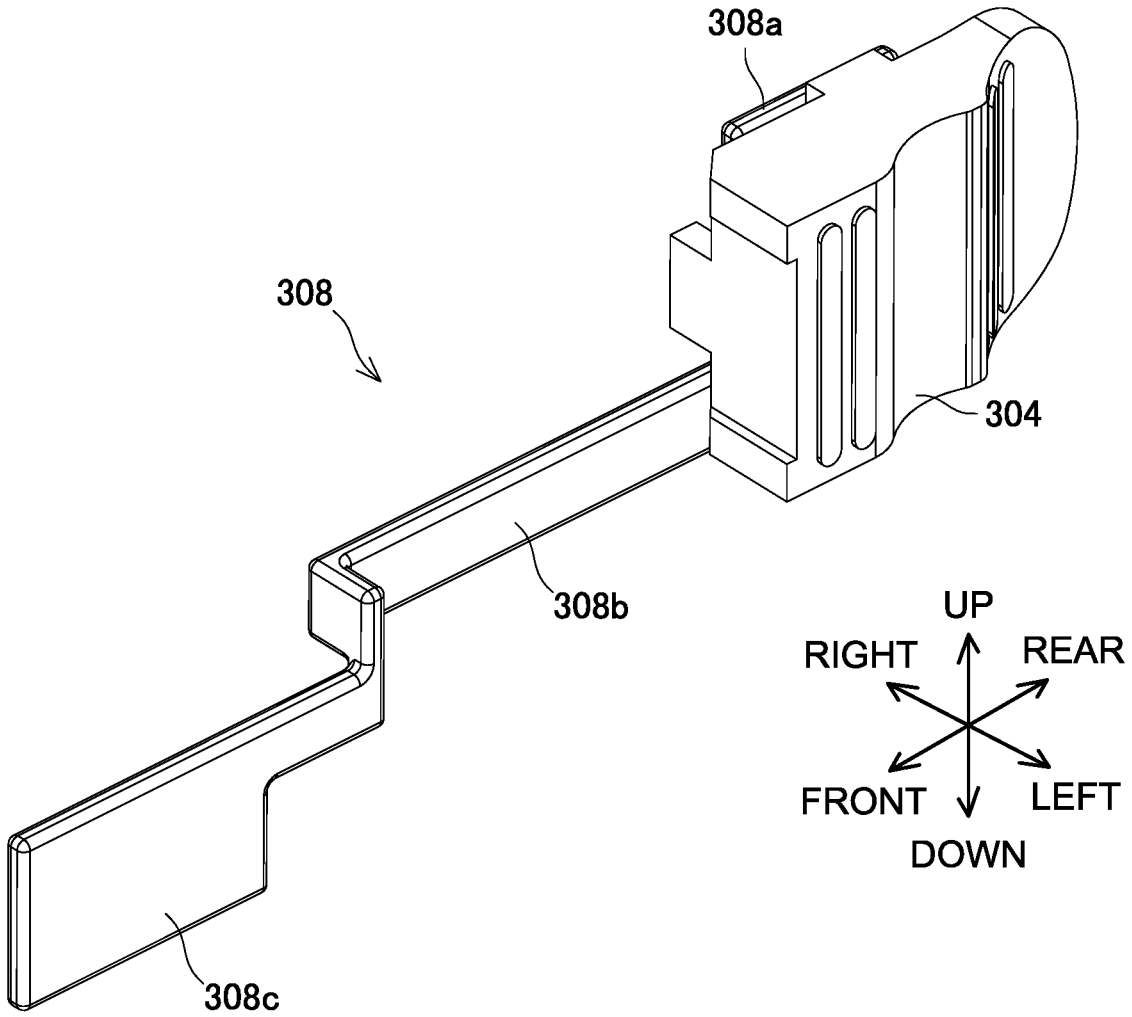
FIG. 24 is a perspective view of a slidable member 308 of the grinder 302 according to the fourth embodiment.

As shown in FIG. 24, the slidable member 308 includes a base portion 308*a*, a connection portion 308*b* that extends forward from the base portion 308*a*, and a stopper portion 308*c* that is disposed at a front end of the connection portion 308*b*. As shown in FIG. 21, the slidable member 308 is located such that the connection portion 308*b* penetrates through a through hole 8*a* formed in the gear housing 8. The base portion 308*a* is secured to the slide switch 304 inside the motor housing 4. Therefore, when the slide switch 304 slides in the front-rear direction or the up-down direction, the slidable member 308 also slides in the front-rear direction or the up-down direction accordingly. The stopper portion 308*c* has a rectangular flat plate shape that has a longitudinal direction in the front-rear direction and a lateral direction in the up-down direction.

As shown in FIG. 21, when the slide switch 304 is at the advanced position, the stopper portion 308*c* of the slidable member 308 is located such that it separates the manipulatable portion 208*b* of the slide plate 208 and the bearing box 10. In this state, the manipulatable portion 208*b* interferes with the stopper portion 308*c* of the slidable member 308 when the slide plate 208 is moved rightward with respect to the bearing box 10, by which the rightward movement of the slide plate 208 is prohibited.

Figure 25:
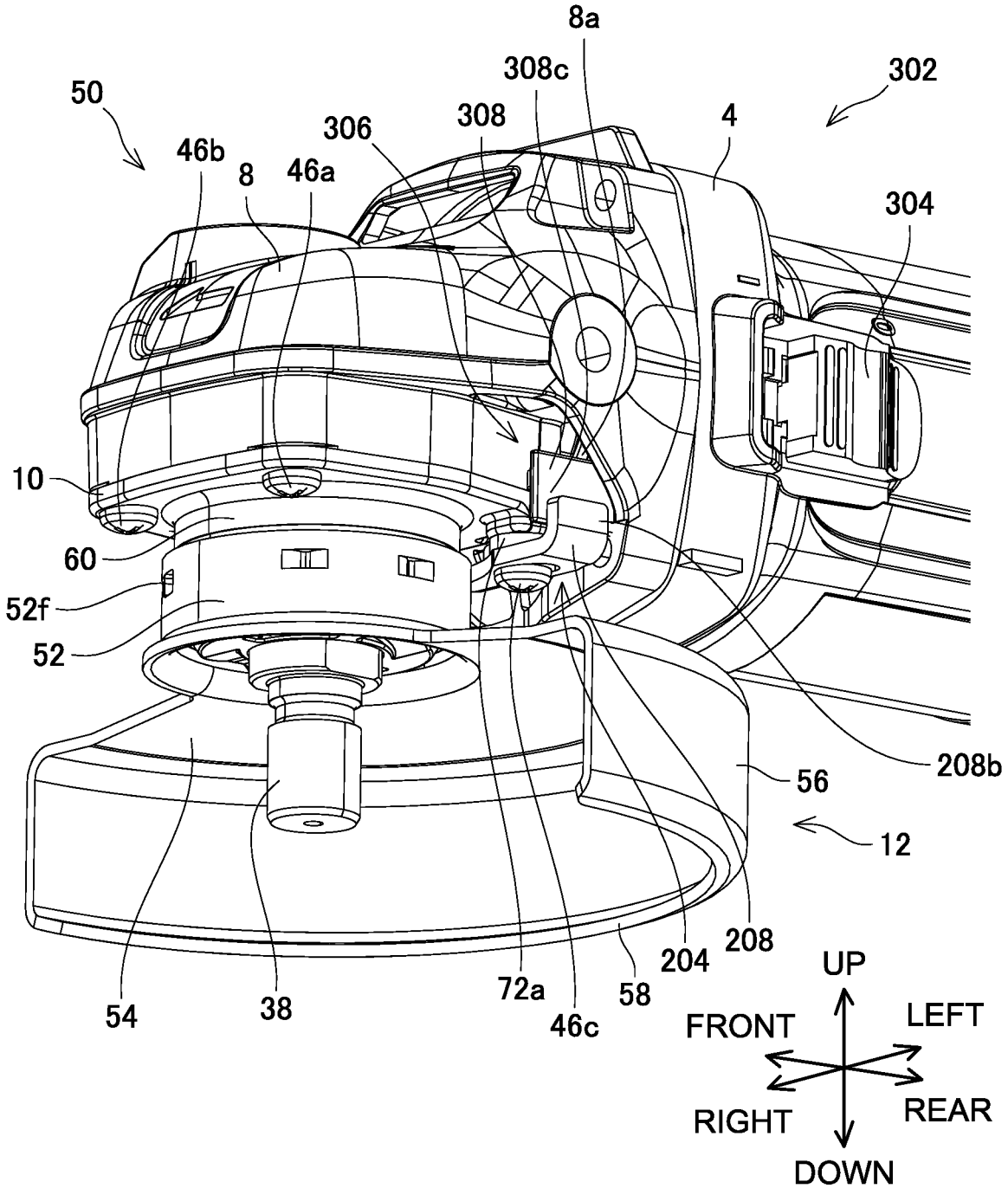
FIG. 25 is a perspective view of the front portion of the grinder 302 according to the fourth embodiment in the state where a slide switch 304 is at a retracted position, when seen from front-lower-left side.

When the slide switch 304 is moved from the advanced position to the retracted position as shown in FIG. 25, the stopper portion 308*c* of the slidable member 308 is moved rearward, but still separates the manipulatable portion 208*b* of the slide plate 208 and the bearing box 10. In this state as well, the manipulatable portion 208*b* interferes with the stopper portion 308*c* of the slidable member 308 when the slide plate 208 is moved rightward with respect to the bearing box 10, by which the rightward movement of the slide plate 208 is prohibited.

Figure 26:
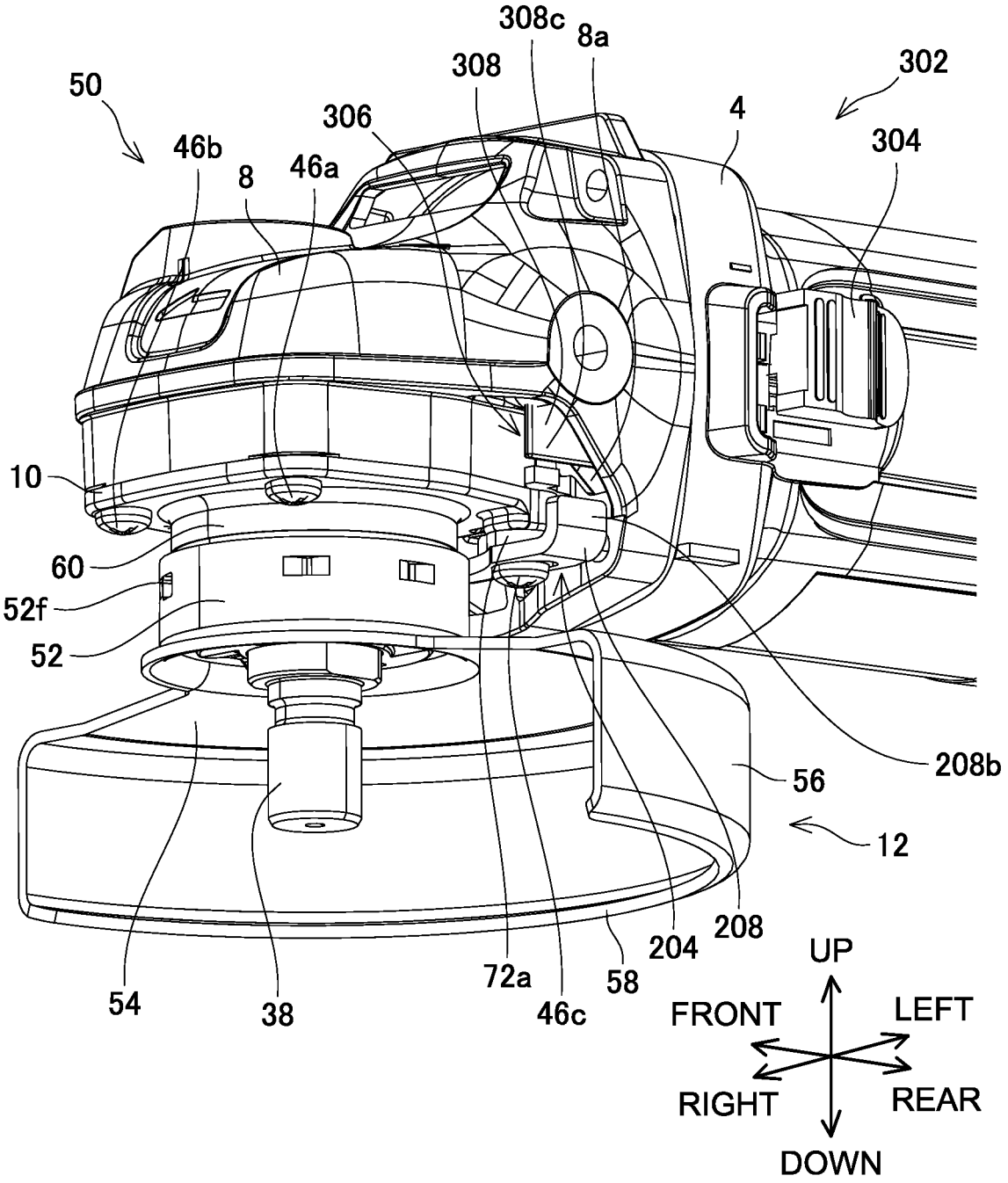
FIG. 26 is a perspective view of the front portion of the grinder 302 according to the fourth embodiment in the state where the slide switch 304 is at an unlocked position, when seen from front-lower-left side.

As shown in FIG. 26, when the slide switch 304 is moved from the retracted position to the unlocked position, the stopper portion 308*c* of the slidable member 308 is moved upward such that it is located not to separate the manipulatable portion 208*b* of the slide plate 208 and the bearing box 10. In this state, the manipulatable portion 208*b* does not interfere with the stopper portion 308*c* of the slidable member 308 when the slide plate 208 is moved rightward with respect to the bearing box 10, by which the rightward movement of the slide plate 208 is allowed.

When the wheel cover 12 is to be attached to the cover mounting portion 60, the user moves the slide switch 304 to the unlocked position as shown in FIG. 26 to move the stopper portion 308*c* of the slidable member 308 to the position at which the stopper portion 38*c* does not separate the manipulatable portion 208*b* of the slide plate 208 and the bearing box 10. Then, the user aligns the engagement ribs 52*a*, 52*b*, 52*c*, 52*d*, and 52*e* of the wheel cover 12 with the notches 64*a*, 64*b*, 64*c*, 64*d*, and 64*e* of the cover mounting portion 60. Next, the user pushes the slide plate 208 rightward to separate the lock portion 208*f* away from the cover mounting portion 60 and slides the wheel cover 12 upward with respect to the bearing box 10 such that the cover mounting portion 60 is located inside the band portion 52. In this way, the wheel cover 12 is attached to the cover mounting portion 60.

Thereafter, when the user rotates the wheel cover 12 with respect to the bearing box 10 to align the lock portion 208*f* of the slide plate 208 with one of the plurality of through holes 52*f* of the band portion 52 and releases the hand from the slide plate 208, the slide plate 208 is moved leftward by the biasing force of the compression spring 210 and the lock portion 208*f* engages with the through hole 52*f*. In this state, the wheel cover 12 is engaged with the slide plate 208, thus the rotation of the wheel cover 12 with respect to the bearing box 10 is prohibited and the wheel cover 12 is fixed to the bearing box 10. To change the rotational angle of the wheel cover 12 with respect to the bearing box 10, the user pushes the slide plate 208 rightward to disengage the lock portion 208*f* from the through hole 52*f*, as a result of which the wheel cover 12 can be rotated with respect to the bearing box 10. By appropriately selecting which through hole 52*f* the lock portion 208*f* is to be inserted into, a rotational angle at which the wheel cover 12 is fixed to the bearing box 10 can be selected. Thereafter, the user moves the slide switch 304 to the retracted position as shown in FIG. 25 such that the stopper portion 308*c* of the slidable member 308 is moved to the position where it separates the manipulatable portion 208*b* of the slide plate 208 and the bearing box 10. The operation of pushing the slide plate 208 rightward is thereby prohibited. Even when the slide switch 304 is moved to the advanced position, as shown in FIG. 21, to drive the motor 14, the stopper portion 308*c* of the slidable member 308 is located at the position where the stopper portion 308*c* separates the manipulatable portion 208*b* of the slide plate 208 and the bearing box 10, thus the operation of pushing the slide plate 208 rightward is prohibited.

When the cover 12 is to be detached from the cover mounting portion 60, the user moves the slide switch 304 to be unlocked position as shown in FIG. 26 to move the stopper portion 308*c* of the slidable member 308 to the position where it does not separate the manipulatable portion 208*b* of the slide plate 208 and the bearing box 10. Then, the user pushes the slide plate 208 rightward to disengage the lock portion 208*f* from the through hole 52*f*, as a result of which the wheel cover 12 becomes rotatable with respect to the bearing box 10. After rotating the wheel cover 12 to the detachable position with respect to the bearing box 10, the user slides the wheel cover 12 downward with respect to the bearing box 10. The engagement ribs 52*a*, 52*b*, 52*c*, 52*d*, and 52*e* of the wheel cover 12 pass through the notches 64*a*, 64*b*, 64*c*, 64*d*, and 64*e* of the cover mounting portion 60, as a result of which the wheel cover 12 can be detached from the cover mounting portion 60.

In the present embodiment, the grinder 302 (an example the electric power tool) comprises the motor 14; the bevel gear 40 (an example of the power transmission mechanism) connected to the motor 14; the housing 50 that houses the motor 14 and the bevel gear 40; the spindle 38 (an example of the tip tool holder) connected to the bevel gear 40; the wheel cover 12 (an example of the cover) covering at least a part of the spindle 38; the first locking mechanism 204 configured to switch between a first locking state and a first unlocked state, wherein the first locking mechanism 204 switches from the first locking state to the first unlocked state in response to a first unlocking operation by the user; and the second locking mechanism 306 configured to switch between a second locking state and a second unlocked state, wherein the second locking mechanism 306 switches from the second locking state to the second unlocked state in response to a second unlocking operation by the user. In the grinder 302, the wheel cover 12 becomes detachable from the housing 50 when the user performs the second unlocking operation on the second locking mechanism 306 and the first unlocking operation on the first locking mechanism 204.

According to the above configuration, the wheel cover 12 will not be detached from the housing 50 unless the first unlocking operation is performed on the first locking mechanism 204 and the second unlocking operation is performed on the second locking mechanism 306. Therefore, even when the first unlocking operation is accidentally performed on the first locking mechanism 204, the wheel cover 12 cannot be detached from the housing 50 unless the second unlocking operation is performed on the second locking mechanism 306. On the contrary, even when the second unlocking operation is accidentally performed on the second locking mechanism 306, the wheel cover 12 cannot be detached from the housing 50 unless the first unlocking operation is performed on the first locking mechanism 204. According to the above configuration, it is possible to reliably prevent the wheel cover 12 from being unintentionally detached from the housing 50.

In the present embodiment, the first locking mechanism 204 is configured to prohibit the wheel cover 12 from being detached from the housing 50 in the first locking state, and allow the wheel cover 12 to be detached from the housing 50 in the first unlocked state. The second locking mechanism 306 is configured to prohibit the first locking mechanism 204 from switching from the first locking state to the first unlocked state in the second locking state, and allow the first locking mechanism 204 to switch from the first locking state to the first unlocked state in the second unlocked state.

According to the above configuration, the first unlocking operation cannot be performed on the first locking mechanism 204 unless the second unlocking operation is performed on the second locking mechanism 306. Further, even when the second unlocking operation is performed on the second locking mechanism 306, the wheel cover 12 cannot de detached from the housing 50 unless the first unlocking operation is performed on the first locking mechanism 204. According to the above configuration, it is possible to reliably prevent the wheel cover 12 from being unintentionally detached from the housing 50.

In the present embodiment, the first locking mechanism 204 includes the slide plate 208 (an example of the first slidable member) supported by the housing 50 so as be movable in a first sliding direction (e.g., the right-left direction) that is substantially orthogonal to the rotation axis of the spindle 38. When the first locking mechanism 204 is in the first locking state, the slide plate 208 is at a first locking position at which the slide plate 208 engages with the wheel cover 12. When the first locking mechanism 204 is in the first unlocked state, the slide plate 208 is at a first unlocked position at which the slide plate 208 does not engage with the wheel cover 12. In response to the first unlocking operation by the user, the slide plate 208 moves from the first locking position to the first unlocked position. The second locking mechanism 306 is configured to prohibit the slide plate 208 from moving from the first locking position to the first unlocked position in the second locking state, and allow the slide plate 208 to move from the first locking position to the first unlocked position in the second unlocked state:

According to the above-described configuration, it is possible to prevent the wheel cover 12 from being detached from the housing 50 by the first locking mechanism 204 with a simple configuration.

In the present embodiment, the wheel cover 12 includes the plurality of through holes **52*f* (example of the engaged portions) arranged circumferentially about the rotation axis of the spindle 38. The slide plate 208 includes the lock portion 208*f* (an example of the engagement portion) configured to engage with any one of the through holes 52*f*. When the first locking mechanism 204 is in the first locking state, the slide plate 208 is at the first locking position at which the lock portion 208 engages with one of the through holes 52*f*. When the first locking mechanism 204 is in the first unlocked state, the slide plate 208 is at the first unlocked position at which the lock portion 208*f* does not engage with any of the through holes 52*f*. In response to the first unlocking operation by the user, the slide plate 208** moves from the first locking position to the first unlocked position.

The above configuration can realize fixation of the rotational angle of the wheel cover 12 with respect to the housing 50 as well as prevention of detachment of the wheel cover 12 from the housing 50, by the first locking mechanism 204 with a simple configuration.

In the present embodiment, the second locking mechanism 306 includes the slidable member 308 (an example of the second slidable member) supported by the housing 50 so as to be movable in a plane (e.g., a plane including the up-down direction and the front-rear direction) orthogonal to the first sliding direction (e.g., the right-left direction). When the second locking mechanism 306 is in the second locking state, the slidable member 308 is at a second locking position at which the slidable member 308 interferes with the slide plate 308 on a way from the first locking position to the first unlocked position. When the second locking mechanism 306 is in the second unlocked state, the slidable member 308 is at a second unlocked position at which the slidable member 308 does not interfere with the slide plate 208 on the way from the first locking position to the first unlocked position. In response to the second unlocking operation by the user, the slidable member 308 moves from the second locking position to the second unlocked position.

The above configuration can prevent the first unlocking operation from being performed on the first locking mechanism 204 by the second locking mechanism 306 with a simple configuration.

In the present embodiment, the grinder 302 further comprises the slide switch 304 (an example of the switch member) disposed on the housing 50. When the user performs an ON operation on the slide switch 304, power is supplied to the motor 14. When the user performs an OFF operation on the slide switch 304, power supply to the motor 14 is stopped. The second slidable member 308 of the second locking mechanism 306 is mechanically connected to the slide switch 304. The second unlocking operation is performed via the slide switch 304.

In the above configuration, the user can perform the second unlocking operation on the second locking mechanism 306 via the slide switch 304 on which the user performs the ON operation and the OFF operation. The user's convenience can be improved.

Fifth Embodiment

Figure 27:
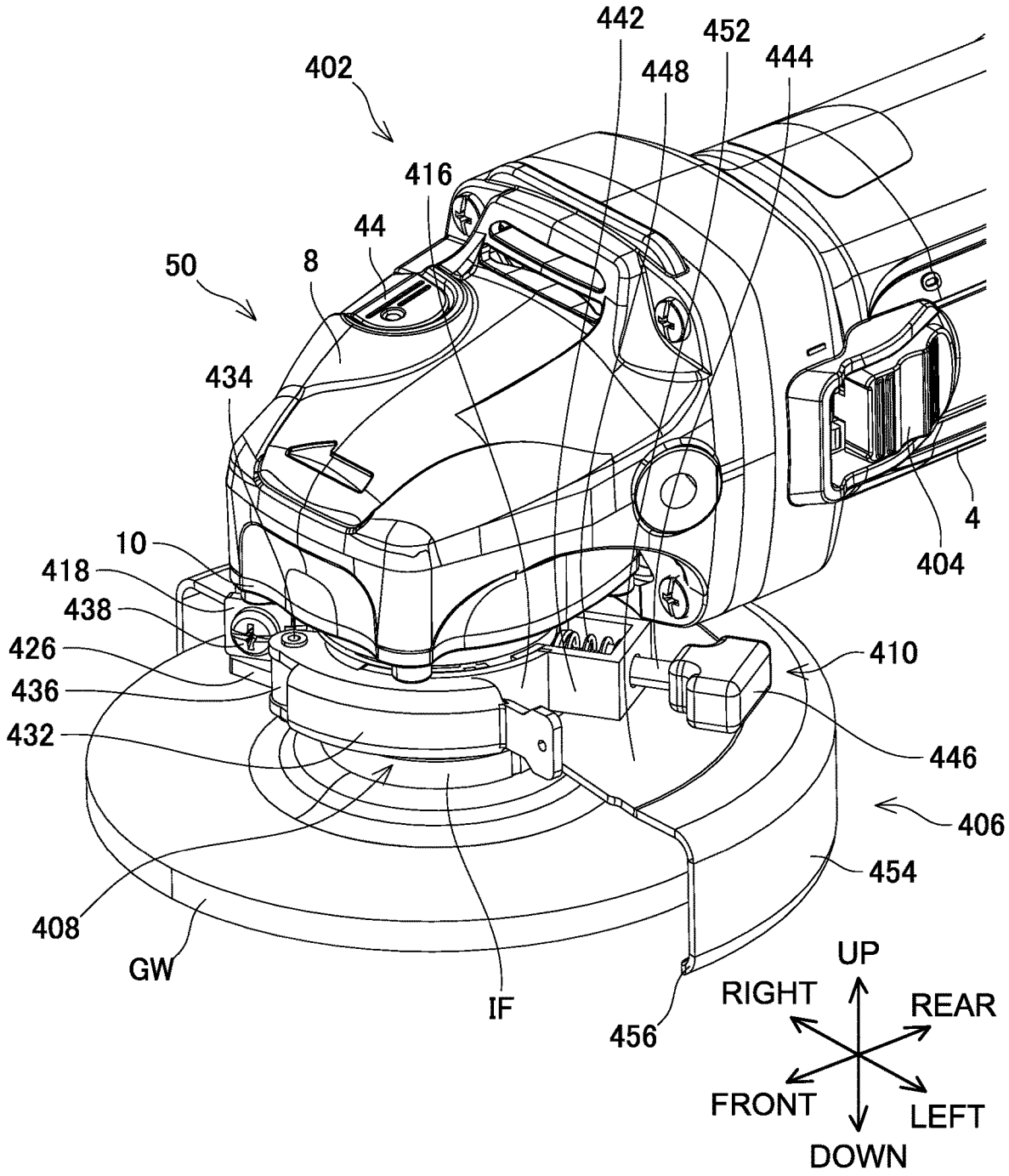
FIG. 27 is a perspective view of a front portion of a grinder 402 according to a fifth embodiment, when seen from front-upper-left side.

As shown in FIG. 27, a grinder 402 according to the present embodiment has substantially the same configuration as the grinder 2 according to the first embodiment.

Hereinafter, regarding the grinder 402 according to the present embodiment, differences from the grinder 2 according to the first embodiment will be described. The grinder 402 includes a slide switch 404 instead of the paddle switch 24. The slide switch 404 is disposed on the left surface of the motor housing 4. The slide switch 404 is slidable in the front-rear direction with respect to the motor housing 4 between an advanced position and a retracted position located rearward of the advanced position. When the user moves the slide switch 404 to the advanced position, a link (not shown) contacts the drive switch 28 (see FIG. 1) and the power is supplied to the motor 14 (see FIG. 1). When the user moves the slide switch 404 to the retracted position, the link (not shown) separates away from the drive switch 28 and the power supply to the motor 14 is stopped.

The grinder 402 according to the present embodiment includes a wheel cover 406 instead of the wheel cover 12. Further, the grinder 402 according to the present embodiment includes a first locking mechanism 408 instead of the first locking mechanism 66, and a second locking mechanism 410 instead of the second locking mechanism 74.

Figure 28:
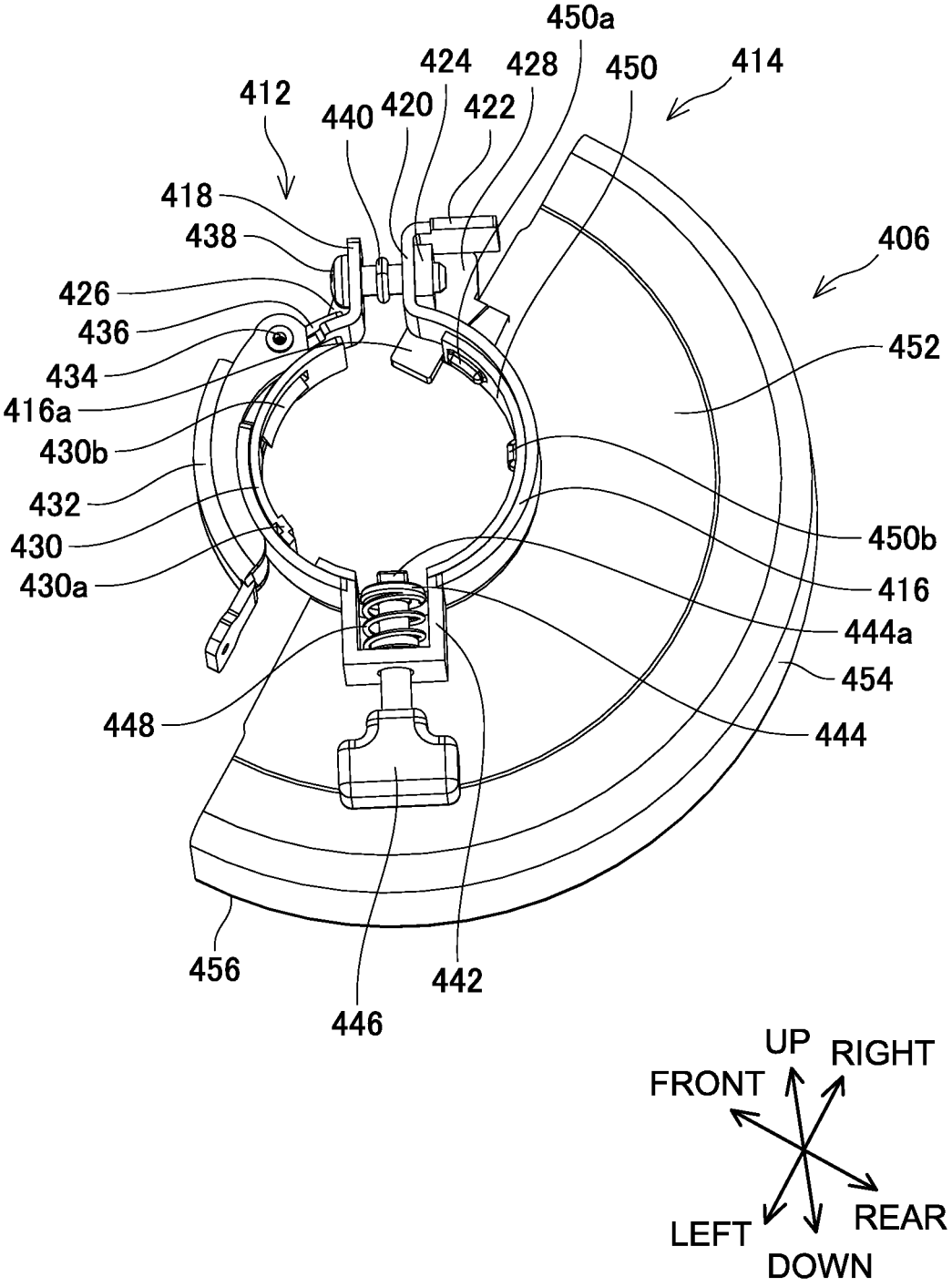
FIG. 28 is a perspective view of a wheel cover 406 of the grinder 402 according to the fifth embodiment.

As shown in FIG. 28, the wheel cover 406 includes a band portion 412 and a cover portion 414. The band portion 412 includes a curved portion 416 formed by curving a belt-shaped flat plate into a cylindrical shape; a pair of flat plate portions 418 and 420 that extend outward respectively from both ends of the curved portion 416 and substantially parallel to each other and each have a through hole in the center; an outer wall portion 422 bending from an end of the flat plate portion 420; a nut 424 welded to an outer surface of the flat plate portion 420, a substantially triangular shaped first reinforcing plate 426 welded to a lower surface of the flat plate portion 418 and a lower surface of an end of the curved portion 416 that is proximate to the flat plate portion 418; a second reinforcing plate 428 welded to a lower surface of the outer wall portion 422, a lower surface of the flat plate portion 420, and a lower surface of an end of the curved portion 416 that is proximate to the flat plate portion 420; a pressing plate 430 extending along an inner surface of the curved portion 416, one end of which is a fixed end welded to the inner surface of the curved portion 416, and the other end of which is a free end; a lever 432 having a box-shaped cross sectional shape covering upper, outer, and lower surfaces of the curved portion 416 and configured to push the free end of the pressing plate 430 inward according to the rotational angle; a hinge pin 434 supporting the lever 432 such that the lever 432 is rotatable; a support plate 436 welded to the outer surface of the curved portion 416 and supporting the hinge pin 434; an adjustment screw 438 screwed into the nut 424 via the flat plate portions 418 and 420; a stop ring 440 attached to the adjustment screw 438 between the flat plate portions 418 and 420; an accommodation portion 442 formed by protruding a part of the curved portion 416 radially outward in a U shape; a lock pin 444 penetrating a through hole formed in the center of an outer surface of the accommodation portion 442; a knob 446 secured to an outer end of the lock pin 444 outside the accommodation portion 442; and a compression spring 448 biasing the lock pin 444 radially inward. A lock portion 444*a* is disposed at an inner end of the lock pin 444. In the state where the knob 446 is not pulled outward, the lock portion 444*a* of the lock pin 444 is located inward of the inner surface of the curved portion 416. In the state where the knob 446 is pulled outward, the lock portion 444*a* of the lock pin 444 is moved outward of the inner surface of the curved portion 416. There is an opening between the flat plate portions 418 and 420 of the band portion 412. A contact portion 416*a* protruding inward beyond the inner surface of the curved portion 416 is disposed at the second reinforcing plate 428. A pressing rib 430*a* that protrudes inward and has a longitudinal direction in the up-down direction and an engagement rib 430*b* that protrudes inward and has a longitudinal direction in the circumferential direction are disposed on an inner surface of the pressing plate 430. The lever 432 pushes the free end of the pressing plate 430 inward by a larger degree as its rotational angle with respect to the curved portion 416 is smaller. Therefore, when the lever 432 is open with respect to the curved portion 416, it pushes the free end of the pressing plate 430 inward by a smaller degree, whereas when the lever 432 is closed with respect to the curved portion 416, it pushes the free end of the pressing plate 430 inward by a larger degree. The stop ring 440 is a rubber ring having a smaller diameter than the outer diameter of the adjustment screw 438 and is attached to the adjustment screw 438 with its diameter enlarged. Even when the adjustment screw 438 disengages from the nut 424, the adjustment screw 438 is prevented from falling off from the flat plate portion 418 because the stop ring 440 is attached to the adjustment screw 438.

The cover portion 414 of the wheel cover 406 includes an inner cylindrical portion 450, a truncated cone portion 452, an outer cylindrical portion 454, and a narrowing portion 456. The inner cylindrical portion 450 and the outer cylindrical portion 454 each have a cylindrical shape having a substantially semi-circular cross section. The truncated cone portion 452 has a truncated cone shape connecting a lower end of the inner cylindrical portion 450 to an upper end of the outer cylindrical portion 454. The narrowing portion 456 is bent inward from a lower end of the outer cylindrical portion 454. Engagement ribs 450*a* and 450*b* that protrude inward and have their longitudinal directions in the circumferential direction are disposed on an inner surface of the inner cylindrical portion 450. The band portion 412 is secured to the cover portion 414 by welding the inner surface of curved portion 416 to the outer surface of inner cylindrical portion 450. In the wheel cover 406, the engagement rib 430*b* of the pressing plate 430, the engagement ribs 450*a* and 450*b* of the inner cylindrical portion 450, and the lock portion 444*a* of the lock pin 444 are at the same height in the up-down direction.

In the grinder 402 according to the present embodiment, the pressing plate 430, the lever 432, the hinge pin 434, and the support plate 436 of the wheel cover 406 constitute a first locking mechanism 408, while the accommodation portion 442, the lock pin 444, the knob 446, and the compression spring 448 of the wheel cover 406 constitute a second locking mechanism 410.

Figure 29:
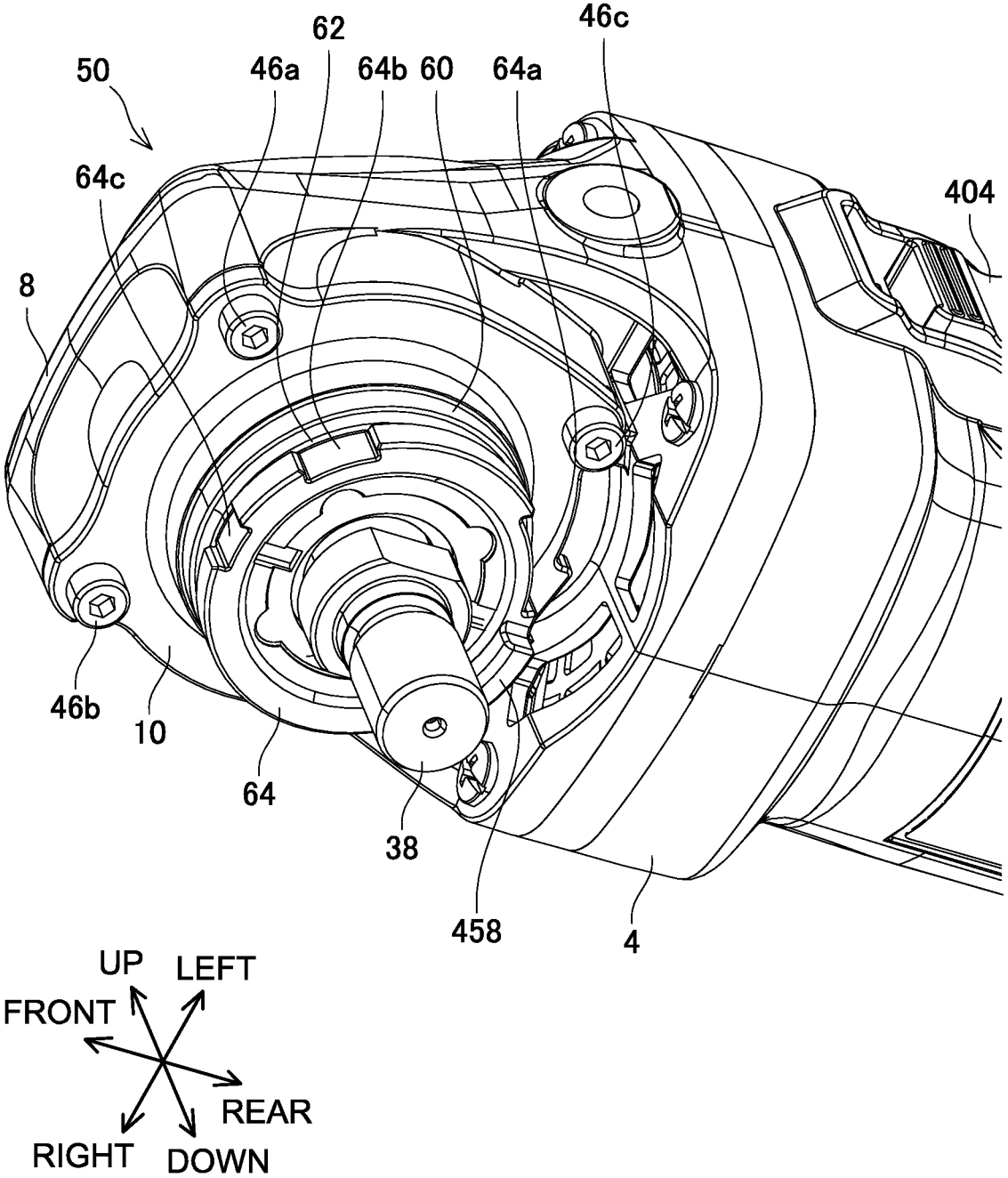
FIG. 29 is a perspective view of a structure around the cover mounting portion 60 of the grinder 402 according to the fifth embodiment, when seen from front-lower-left side.

As shown in FIG. 29, in the grinder 402 according to the present embodiment, notches 64*a*, 64*b*, and 64*c* are formed in the flange 64 of the cover mounting portion 60 of the bearing box 10, corresponding to the engagement ribs 430*b*, 450*a*, and 450*b* of the wheel cover 406. The notches 64*a*, 64*b*, and 64*c* extend in the up-down direction and communicate with the guide groove 62. Further, a contact piece 458 protruding downward is disposed on the lower surface of the cover mounting portion 60. The contact piece 458 is configured to contact the contact portion 416*a* of the wheel cover 406 to restrict the rotatable angle of the wheel cover 406. In the grinder 402 according to the present embodiment, the screws 46*c* and 46*d* for securing the bearing box 10 to the gear housing 8 fasten the bearing box 10 with the gear housing 8 without passing through the sleeve 72*a* and 72*b*.

Figure 30:
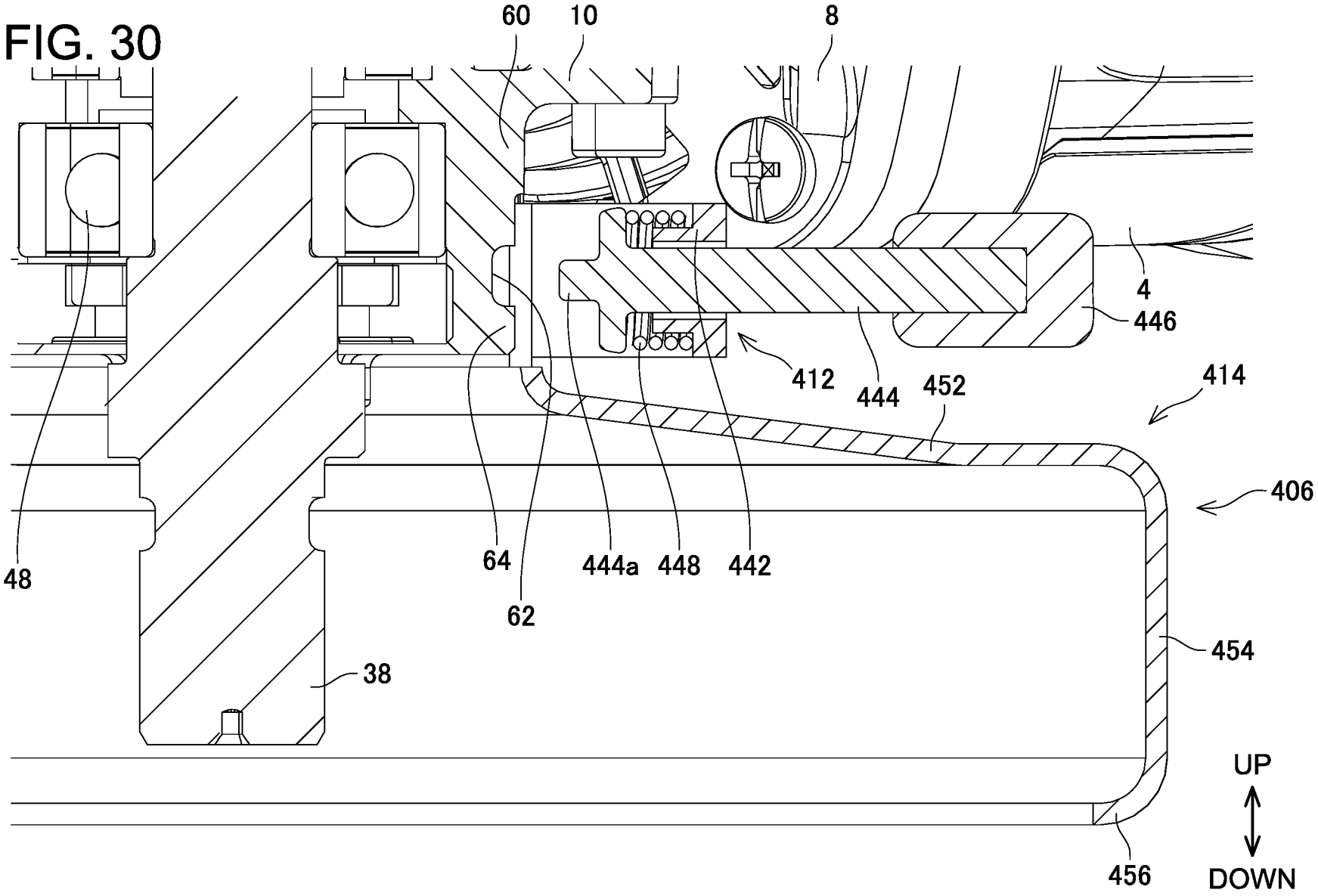
FIG. 30 is a longitudinal sectional view of a second locking mechanism 410 of the grinder 402 according to the fifth embodiment in the state where a lock pin 444 is out of a guide groove 62.
Figure 31:
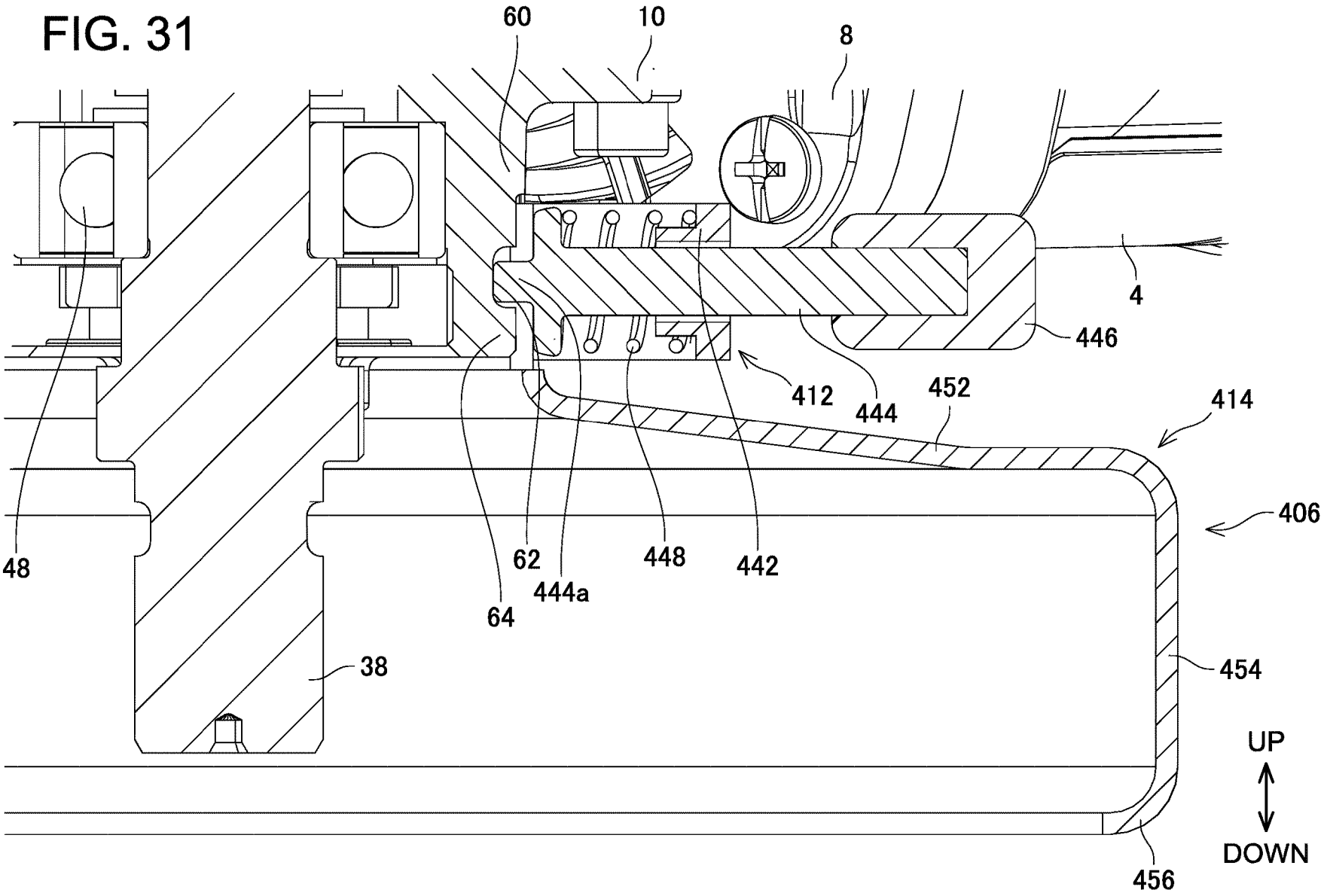
FIG. 31 is a longitudinal sectional view of the second locking mechanism 410 of the grinder 402 according to the fifth embodiment in the state where the lock pin 444 is in the guide groove 62.

When the wheel cover 406 is to be attached to the cover mounting portion 60, the user opens the lever 432 of the wheel cover 406 with respect to the curved portion 416 and pulls the lock pin 444 outward by pinching the knob 446. Then, the user aligns the engagement ribs 430*b*, 450*a*, and 450*b* of the wheel cover 406 with the notches 64*a*, 64*b*, and 64*c* of the cover mounting portion 60 and slides the wheel cover 406 upward with respect to the bearing box 10 such that the cover mounting portion 60 is located inside the band portion 412. In this way, as shown in FIG. 30, the wheel cover 406 is attached to the cover mounting portion 60. The position of the wheel cover 406 attached to the bearing box 10 in the state where the engagement ribs 430*b*, 450*a*, and 450*b* are aligned with the notches 64*a*, 64*b*, and 64*c* may be hereinafter referred to as a detachable position. When the user releases the hand from the knob 446, the lock pin 444 is moved inward by the biasing force of the compression spring 448 and the lock portion 444*a* of the lock pin 444 enters the guide groove 62 as shown in FIG. 31. In this state, the lock portion 444*a* of the lock pin 444 is engaged with the flange 64, thus the downward slide of the wheel cover 406 with respect to the bearing box 10 is prohibited. Therefore, even when the wheel cover 406 is at the detachable position, the wheel cover 406 cannot be detached from the bearing box 10.

The wheel cover 406 attached to the bearing box 10 is rotatable about the cover mounting portion 60. In other words, the wheel cover 406 is rotatable about the rotation axis direction of the spindle 38 (i.e., the up-down direction) with respect to the bearing box 10. When the wheel cover 406 is rotated from the detachable position with respect to the bearing box 10, the engagement ribs 430*b*, 450*a*, and 450*b* slide in the guide groove 62. In the state where the wheel cover 406 is rotated from the detachable position with respect to the bearing box 10, the flange 64 is engaged with the engagement ribs 430*b*, 450*a*, and 450*b*, thus the downward slide of the wheel cover 406 with respect to the bearing box 10 is prohibited. Therefore, after rotating the wheel cover 406 from the detachable position, the user cannot detach the wheel cover 406 from the bearing box 10 even though he/she pulls the lock pin 444 outward by pinching the knob 446.

The wheel cover 406 attached to the bearing box 10 is rotatable in a range from the detachable position to a position where contact portion 416*a* contacts the contact piece 458. When the wheel cover 406 is rotated to a desired position within the rotatable range and the lever 432 is closed with respect to the curved portion 416, the free end of the pressing plate 430 is pushed inward, as a result of which the cover mounting portion 60 is pressed by the free end of the pressing plate 430, the pressing rib 430*a*, and the inner cylindrical portion 450. The rotation of the wheel cover 406 with respect to the bearing box 10 is thereby prohibited. When the lever 432 is opened with respect to the curved portion 416, the free end of pressing plate 430, the pressing rib 430*a*, and the inner cylindrical portion 450 no longer press the cover mounting portion 60, thus the wheel cover 406 is allowed to rotate with respect to the bearing box 10.

When the wheel cover 406 is to be detached from the cover mounting portion 60, the user opens the lever 432 with respect to the curved portion 416 to make the wheel cover 406 become rotatable with respect to the bearing box 10. After rotating wheel cover 406 to the detachable position with respect to the bearing box 10, the user slides the wheel cover 406 downward with respect to the bearing box 10 while pulling the lock pin 444 outward by pinching the knob 446. Thereby, the engagement ribs 430*b*, 450*a*, and 450*b* of the wheel cover 406 pass through the notches 64*a*, 64*b*, and 64*c* of the cover mounting portion 60, thus the wheel cover 406 can be detached from the cover mounting portion 60.

In the present embodiment, the grinder 402 (an example of the electric power tool) comprises the motor 14; the bevel gear 40 (an example of the power transmission mechanism) connected to the motor 14; the housing 50 that houses the motor 14 and the bevel gear 40; the spindle 38 (an example of the tip tool holder) connected to the bevel gear 40; the wheel cover 406 (an example of the cover) covering at least a part of the spindle 38; the first locking mechanism 408 configured to switch between a first locking state and a first unlocked state, wherein the first locking mechanism 408 switches from the first locking state to the first unlocked state in response to a first unlocking operation by the user; and the second locking mechanism 410 configured to switch between a second locking state and a second unlocked state, wherein the second locking mechanism 410 switches from the second locking state to the second unlocked state in response to a second unlocking operation by the user. In the grinder 402, the wheel cover 46 becomes detachable from the housing 50 when the user performs the second unlocking operation on the second locking mechanism 410 and the first unlocking operation on the first locking mechanism 408.

According to the above configuration, the wheel cover 406 will not be detached from the housing 50 unless the first unlocking operation is performed on the first locking mechanism 408 and the second unlocking operation is performed on the second locking mechanism 410. Therefore, even when the first unlocking operation is accidentally performed on the first locking mechanism 408, the wheel cover 406 cannot be detached from the housing 50 unless the second unlocking operation is performed on the second locking mechanism 410. On the contrary, even when the second unlocking operation is accidentally performed on the second locking mechanism 410, the wheel cover 406 cannot be detached from the housing 50 unless the first unlocking operation is performed on the first locking mechanism 408. According to the above configuration, it is possible to reliably prevent the wheel cover 406 from being unintentionally detached from the housing 50.

In the present embodiment, the first locking mechanism 408 is configured to prohibit the wheel cover 406 from rotating with respect to the housing 50 and being detached from the housing 50 in the first locking state, and allow the wheel cover 406 to rotate with respect to the housing 50 and be detached from the housing 50 in the first unlocked state. The second locking mechanism 410 is configured to prohibit the wheel cover 406 from being detached from the housing 50 in the second locking state, and allow the wheel cover 406 to be detached from the housing 50 in the second unlocked state.

The above configuration can reliably prevent the wheel cover 406 from being unintentionally detached from the housing 50 as well as fix the rotational angle of the wheel cover 406 with respect to the housing 50.

In the present embodiment, the wheel cover 406 includes the band portion 412 surrounding a part of the housing 50 that is in a vicinity of the spindle 38. The first locking mechanism 408 includes the lever 432 (an example of the first rotatable member) rotatably supported by the band portion 412. When the first locking mechanism 408 is in the first locking state, the lever 432 is at a first locking angle at which the lever 432 presses the band portion 412 against the housing 50. When the first locking mechanism 408 is in the first unlocked state, the lever 432 is at a first unlocked angle at which the lever 432 does not press the band portion 412 against the housing 50. In response to the first unlocking operation by the user, the lever 432 rotates from the first locking angle to the first unlocked angle.

The above configuration enables the first locking mechanism 408 with the simple configuration to realize both fixation of the rotational angle of the wheel cover 406 with respect to the housing 50 and prevention of detachment of the wheel cover 406 from the housing 50.

In the present embodiment, the second locking mechanism 410 includes the lock pin 444 (an example of the second slidable member) supported by the wheel cover 406 so as to be movable in a second sliding direction (e.g., radial direction) that is substantially orthogonal to the rotation axis of the spindle 38. The lock pin 444 includes the lock portion 444*a* (an example of the engagement portion) configured to engage with the housing 50. When the second locking mechanism 410 is in the second locking state, the lock pin 444 is at a second locking position at which the lock pin 444 engages with the housing 50. When the second locking mechanism 410 is in the second unlocked state, the lock pin 444 is at a second unlocked position at which the lock pin 444 does not engage with the housing 50. In response to the second unlocking operation by the user, the lock pin 444 moves from the second locking position to the second unlocked position.

The above-described configuration enables the second locking mechanism 410 with the simple configuration to prevent the wheel cover 406 from being detached from the housing 50.

Figure 32:
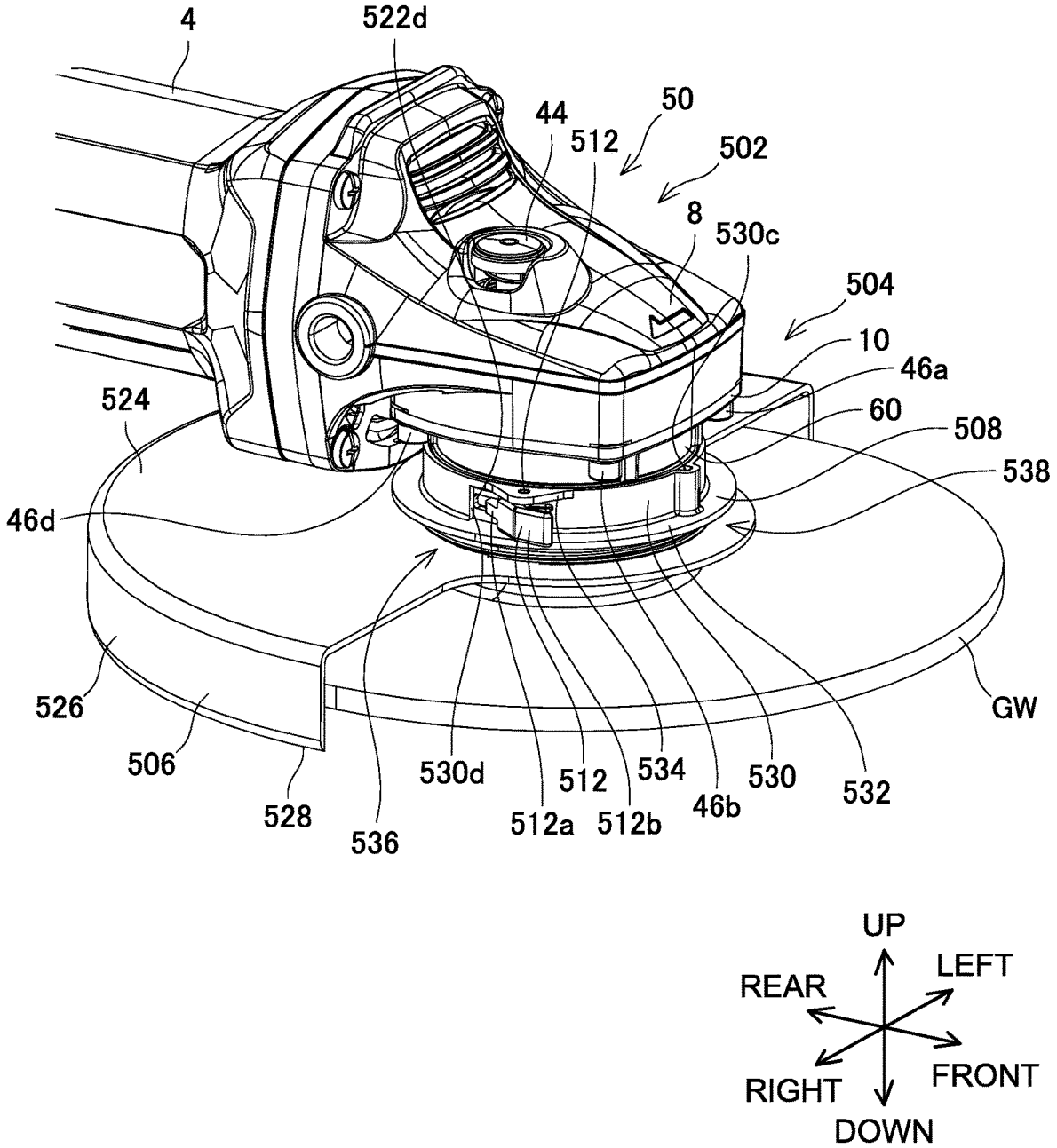
FIG. 32 is a perspective view of a front portion of a grinder 502 according to a sixth embodiment, when seen from front-upper-right side.

Sixth Embodiment s shown in FIG. 32, a grinder 502 according to the present embodiment has substantially the same configuration as the grinder 2 according to the first embodiment. Hereinafter, regarding the grinder 502 according to the present embodiment, differences from the grinder 2 according to the first embodiment will be described. The grinder 502 according to the present embodiment includes a wheel cover 504 instead of the wheel cover 12.

Figure 33:
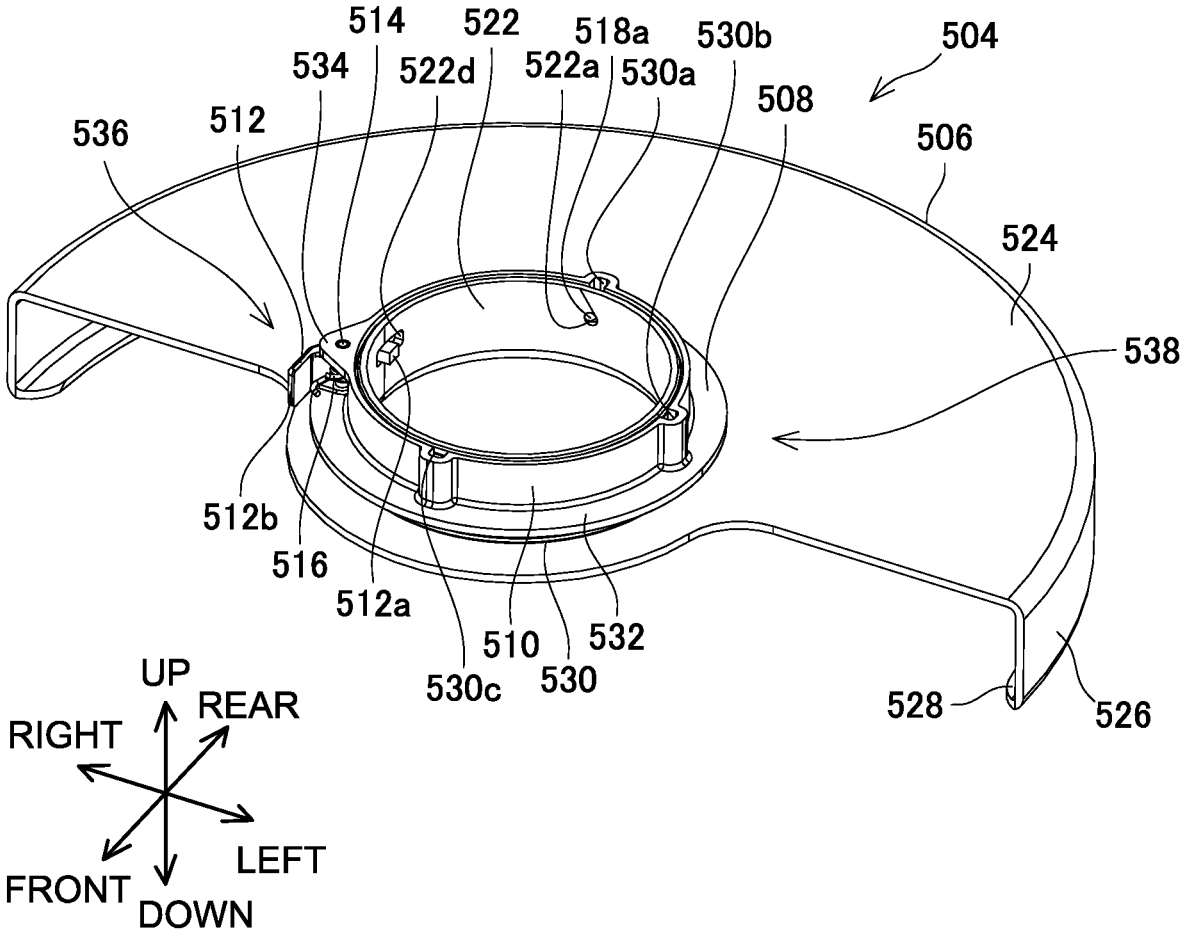
FIG. 33 is a perspective view of a wheel cover 504 of the grinder 502 according to the sixth embodiment.
Figure 34:
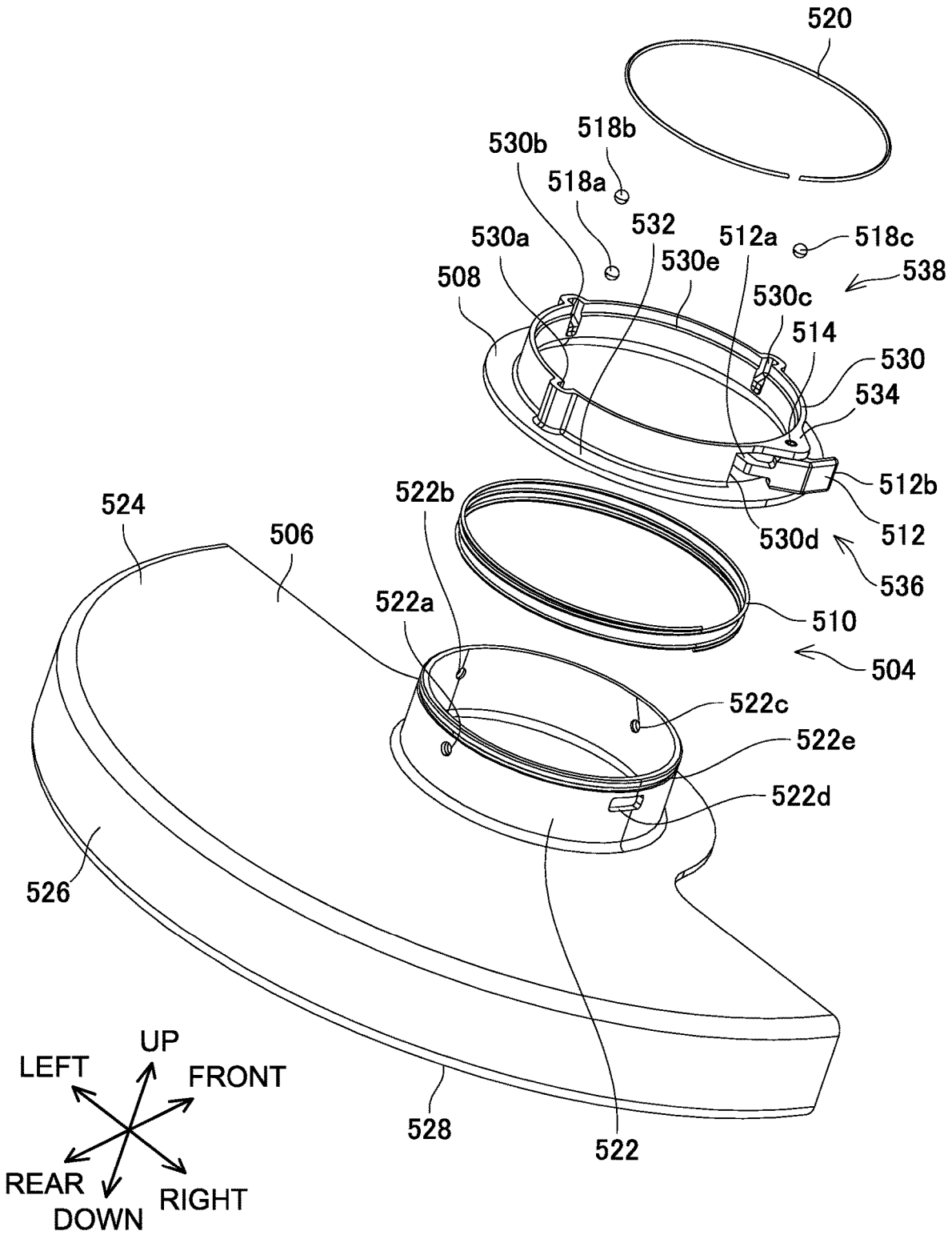
FIG. 34 is an exploded perspective view of the wheel cover 504 of the grinder 502 according to he sixth embodiment.

As shown in FIGS. 33 and 34, the wheel cover 504 includes a cover main body 506, a slidable member 508, a compression spring 510, a rotatable member 512, a hinge pin 514, a torsion spring 516, lock balls 518*a*, 518*b*, and 518*c*, and a ring spring 520.

The cover main body 506 includes a band portion 522, an upper surface portion 524, a side surface portion 526, and a narrowing portion 528. The band portion 522 has a substantially cylindrical shape extending in the up-down direction. Through holes 522*a*, 522*b*, and 522*c* corresponding to the lock balls 518*a*, 518*b*, and 518*c*, and a through hole 522*d* corresponding to the rotatable 512 are formed in the band portion 522. The through holes 522*a*, 522*b*, 522*c*, and 522*d* are at the same height in the up-down direction. The through holes 522*a*, 522*b*, and 522*c* are in a circular shape having a diameter smaller than the diameters of the lock balls 518*a*, 518*b*, and 518*c* on the inner diameter side of the band portion 522. A ring groove 522*c* corresponding to the ring spring 520 is formed in an outer surface of the band portion 522 near its upper end. The upper surface portion 524 extends outward from a lower end of the band portion 522 and has a partially cut-out disc shape. The side surface portion 526 bas a substantially semi-cylindrical shape extending downward from an outer end of the upper surface portion 524. The narrowing portion 528 is bent inward from a lower end of the side surface portion 526.

The slidable member 508 includes a band portion 530, a flange portion 532, and a support portion 534. The band portion 530 has a substantially cylindrical shape extending in the up-down direction. The inner diameter of the band portion 530 is larger than the outer diameter of the band portion 522 of the cover main body 506. Guide grooves 530*a*, 530*b*, and 530*c* corresponding to the lock balls 518*a*, 518*b*, and 518*c* are formed in the band portion 530. The guide grooves 530*a*, 530*b*, and 530*c* extend in the up-down direction in the inner surface of the band portion 530. Dimensions of the guide grooves 530*a*, 530*b*, and 530*c* are radially decreased toward their lower ends. The flange portion 532 has an annular shape extending outward from a lower end of the band portion 530. The support portion 534 bas a flat plate shape protruding outward from an upper end of the band portion 530. The rotatable member 512 is rotatably supported by the flange portion 532 and the support portion 534 of the slidable member 508 via the hinge pin 514 having a longitudinal direction in the up-down direction. The rotatable member 512 includes a lock portion 512*a* and a manipulatable portion 512*b*. The torsion spring 516 biases the rotatable member 512 with respect to the slidable member 508 in a rotation direction along which the lock portion 512*a* is moved inward. A through hole 530*d* corresponding to the rotatable member 512 is formed in the band portion 530. A step 530*e* with which the ring spring 520 is engaged is formed in the inner surface of the band portion 530 near its upper end.

In the wheel cover 504, the band portion 522 of the cover main body 506 is located inside the band portion 530 of the slidable member 508 with the compression spring 510 surrounding the circumference of the band portion 522 of the cover main body 506. The compression spring 510 biases the flange portion 532 of the slidable member 508 upward with respect to the upper surface portion 524 of the cover main body 506. In the state where the slidable member 508 is attached to the cover main body 506, the lock balls 518*a*, 518*b*, and 518*c* are accommodated in the guide grooves 530*a*, 530*b*, and 530*c* of the slidable member 508. In the state where the lock balls 518*a*, 518*b*, and 518*c* are located at the lower ends of the guide grooves 530*a*, 530*b*, and 530*c*, a part of each of the lock balls 518*a*, 518*b*, and 518*c* is located inward of the inner surface of the band portion 522 of the cover main body 506 via the through holes 522*a*, 522*b*, and 522*c* as shown in FIG. 33. Further, in the state where the slidable member 508 is attached to the cover main body 506, the lock portion 512*a* of the rotatable member 512 is located inward of the inner surface of the band portion 522 of the cover main body 506 via the through hole 530*d* of the band portion 530 of the slidable member 508 and the through hole 522*d* of the band portion 522 of the cover main body 506.

The ring spring 520 is attached to the ring groove 522*e* of the cover main body 506 in the state where the slidable member 508 is attached to the cover main body 506. The diameter of the ring spring 520 is smaller than the outer diameter of the ring groove 522*e* of the cover main body 506 when the ring spring 520 is under no load, thus it is enlarged when the ring spring 520 is attached to the ring groove 522*e*. In the state where the ring spring 520 is attached to the cover main body 506, the outer diameter of the ring spring 520 is larger than the outer diameter of the band portion 522 of the cover main body 506, thus the ring spring 520 is engaged with the step 530*e* and the lock balls 518*a*, 518*b*, and 518*c* of the slidable member 508. The ring spring 520 prevents the slidable member 508 and the lock balls 518*a*, 518*b*, and 518*c* from falling out of the cover main body 506.

Figure 35:
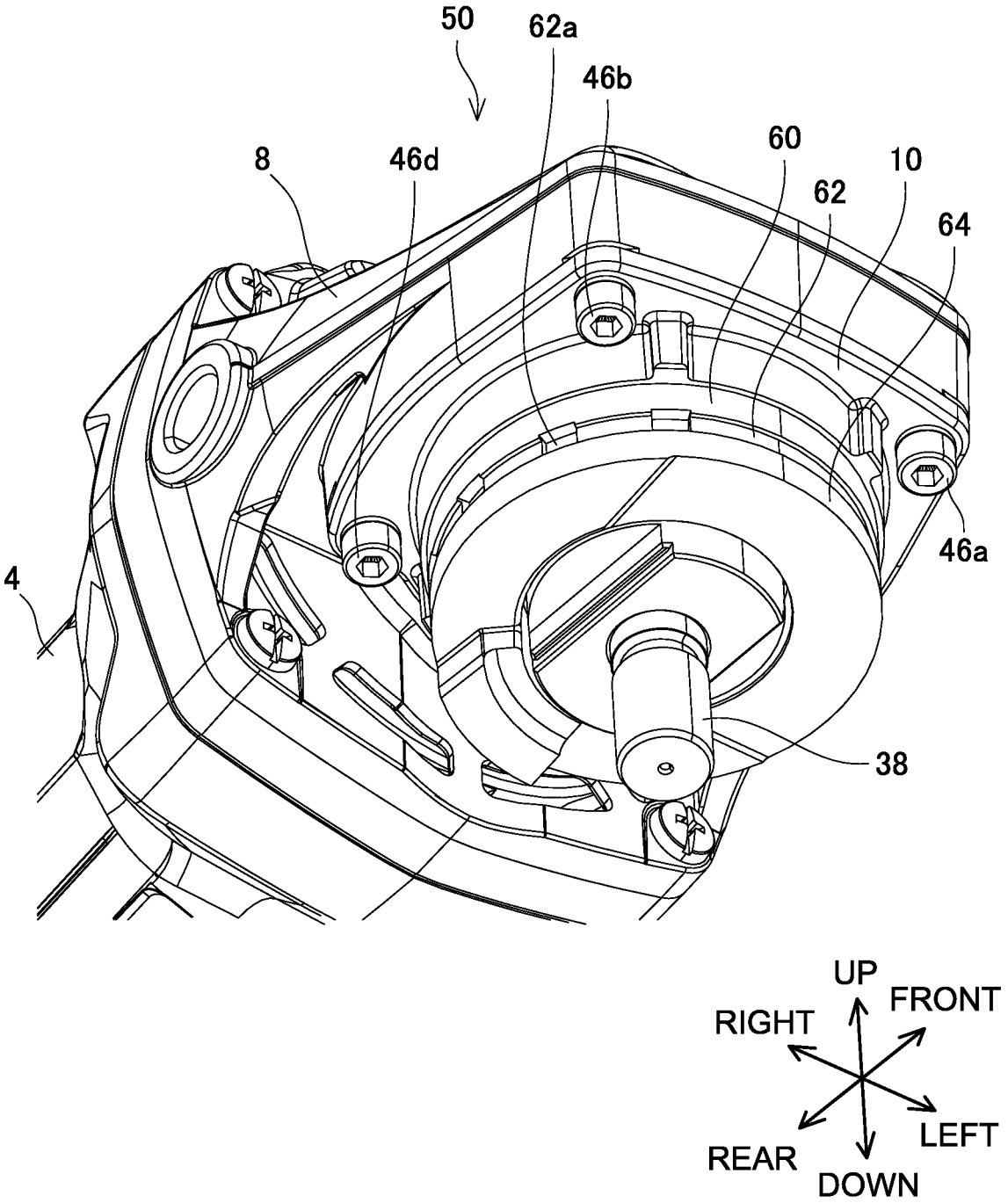
FIG. 35 is a perspective view of a structure around the cover mounting portion 60 of the grinder 502 according to the sixth embodiment, when seen from front-lower-right side.

As shown in FIG. 35, in the grinder 502 of the present embodiment, the notches 64*a*, 64*b*, 64*c*, 64*d*, and 64*e* are not formed in the flange 64 of cover mounting portion 60 of the bearing box 10. Further, in the grinder 502 of the present embodiment, the screws 46*c* and 46*d* for securing the bearing box 10 to the gear housing 8 fasten the bearing box 10 with the gear housing 8 without passing through the sleeves 72*a* and 72*b*. In the grinder 502 of the present embodiment, a plurality of engagement grooves 62*a* which are deeper than the guide groove 62 is formed in the guide groove 62 of the cover mounting portion 60. The engagement grooves 62*a* are disposed at predetermined angular intervals.

Figure 36:
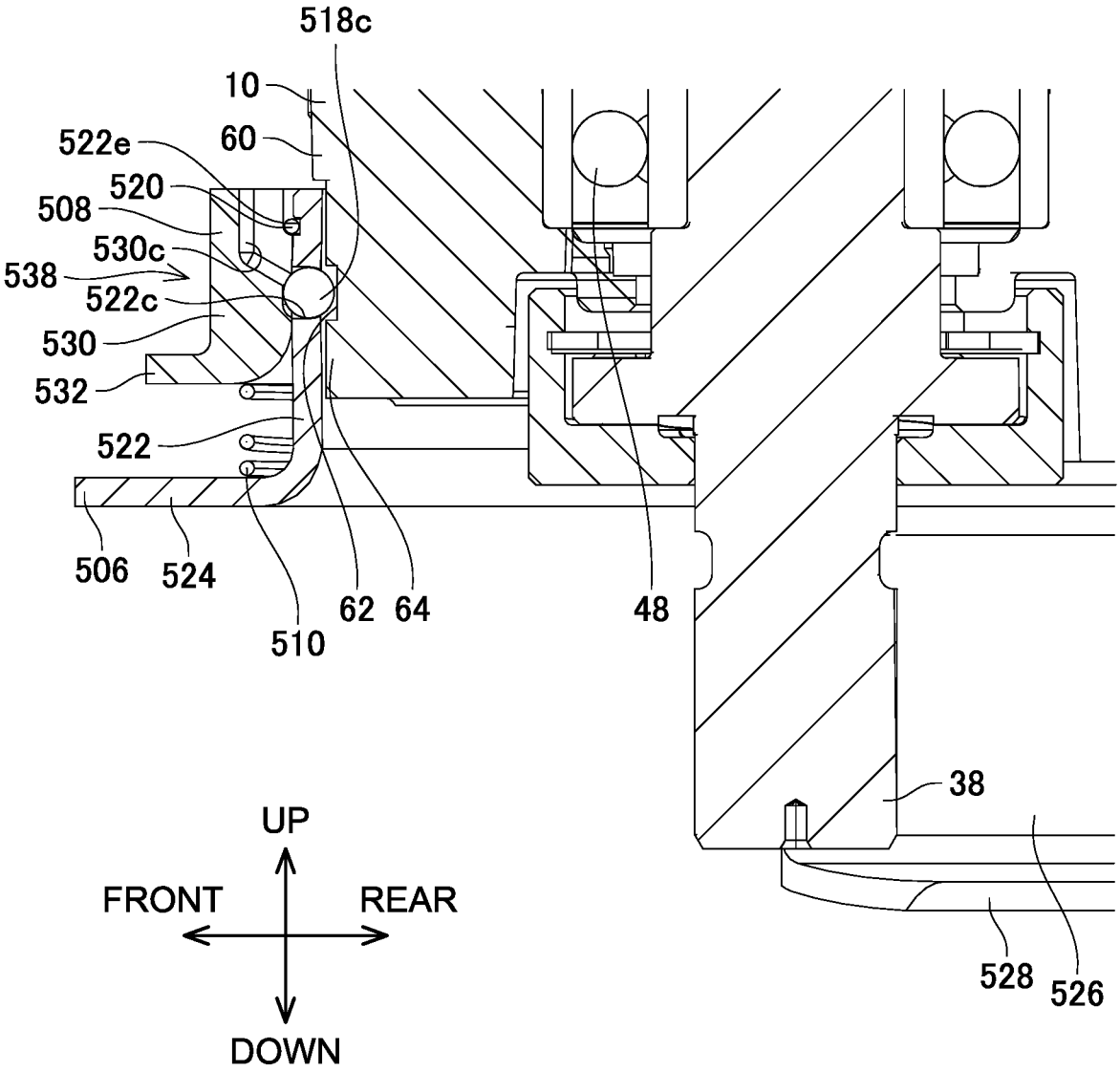
FIG. 36 is a longitudinal sectional view of a second locking mechanism 538 of the grinder 502 according to the sixth embodiment in the state where lock balls 518*a*, 518*b*, and 518*c* are in through holes 522*a*, 522*b*, and 522*c*.
Figure 37:
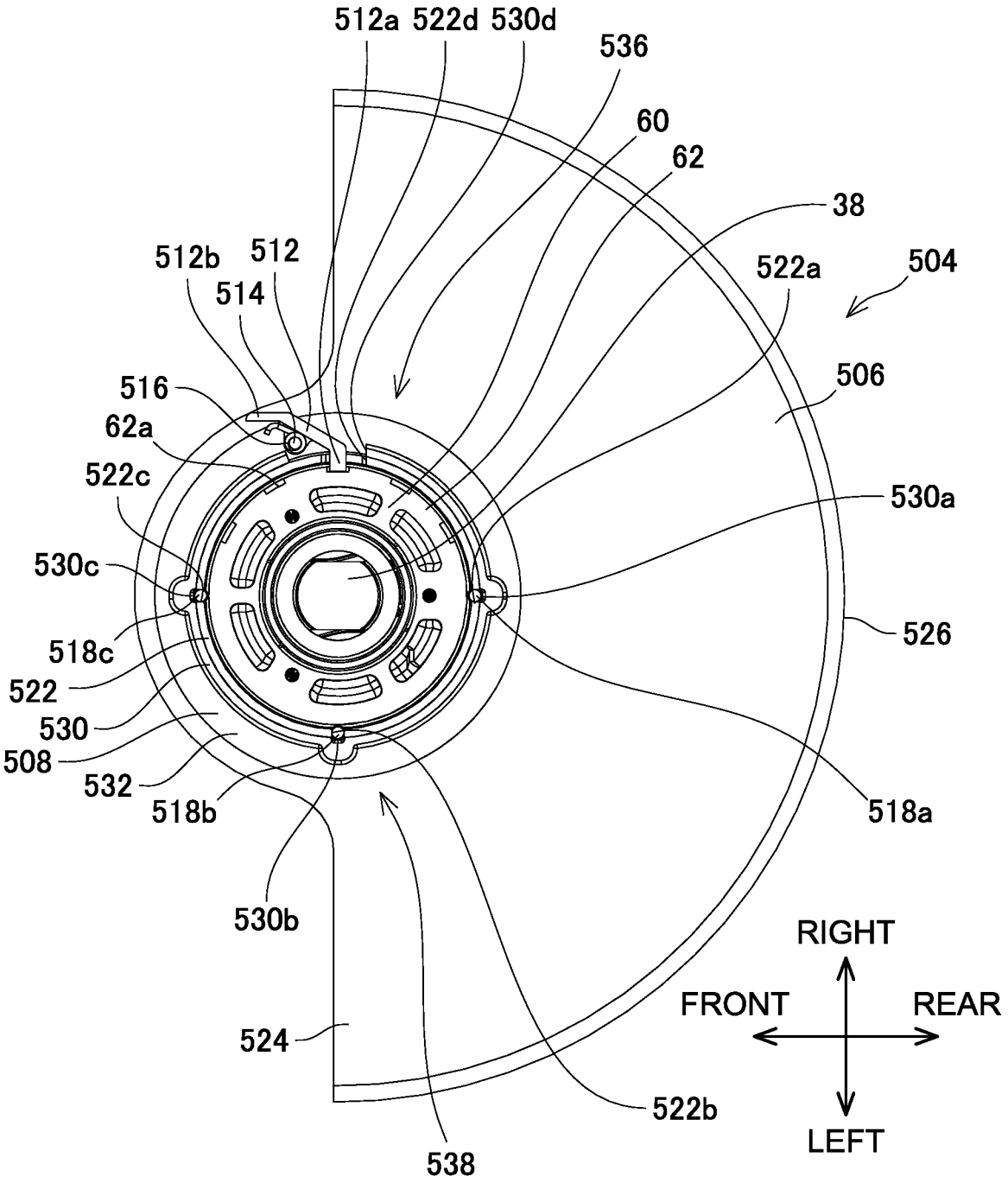
FIG. 37 is a lateral sectional view of the cover mounting portion 60 of the grinder 502 according to the sixth embodiment.

As shown in FIGS. 36 and 37, in the grinder 502 according to the present embodiment, the lock balls 518*a*, 518*b*, and 518*c* protruding inward beyond the inner surface of the band portion 522 of the cover main body 506 enter the guide groove 62 of the cover mounting portion 60 when the wheel cover 504 is attached to the cover mounting portion 60. In this state, the lock balls 518*a*, 518*b*, and 518*c* engage with the flange 64 of the cover mounting portion 60 when the wheel cover 504 is slid downward with respect to the bearing box 10, by which the downward slide of the wheel cover 504 with respect to the bearing box 10 is prohibited. Further, in the grinder 502 according to the present embodiment, in the state where the wheel cover 504 is attached to the cover mounting portion 60, the lock portion 512*a* of the rotatable member 512 protruding inward beyond the inner surface of the band portion 522 of the cover main body 506 is engaged with one of the plurality of engagement grooves 62*a* of the cover mounting portion 60. In this state, the downward slide of the wheel cover 504 with respect to the bearing box 10 and the rotation of the wheel cover 504 with respect to the bearing box 10 are prohibited.

In the grinder 502 according to the present embodiment, the rotatable member 512, the hinge pin 514, the torsion spring 516 of the wheel cover 504 constitute a first locking mechanism 536, while the slidable member 508, the compression spring 510, the lock balls 518*a*, 518*b*, and 518*c* of the wheel cover 504 constitute a second locking mechanism 538.

Figure 38:
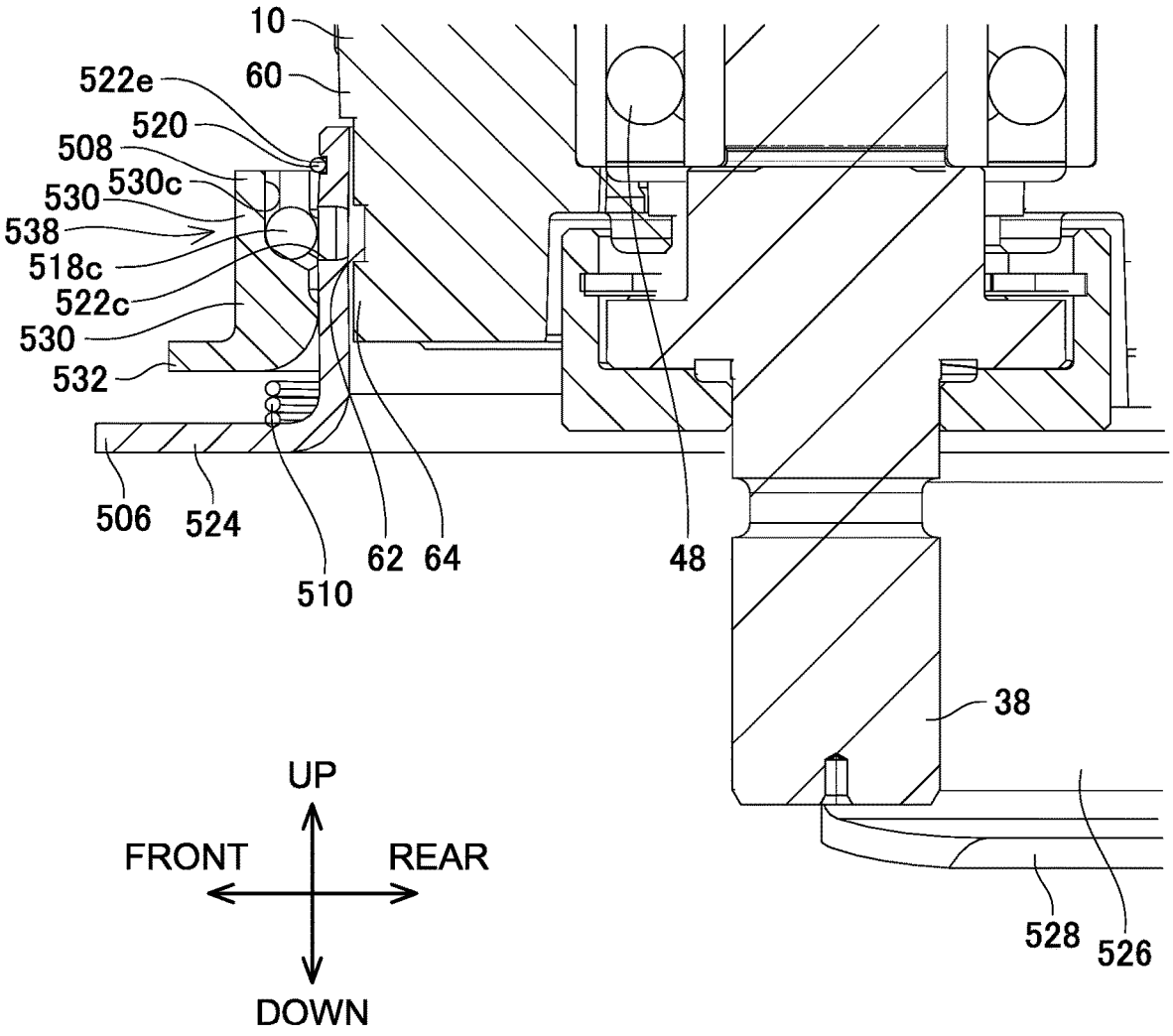
FIG. 38 is a longitudinal sectional view of the second locking mechanism 538 of the grinder 502 according to the sixth embodiment in the state where the lock balls 518*a* , 518*b*, and 518*c* are out of the through holes 522*a*, 522*b*, and 522*c*.

When the wheel cover 504 is to be attached to the cover mounting portion 60, the user pushes the manipulatable portion 512*b* of the rotatable member 512 to rotate the rotatable member 512 and slides the slidable member 508 downward with respect to the cover main body 506. As a result, the lock portion 512*a* of the rotatable member 512 disengages from the through holes 522*d* and 530*d* and the lock balls 518*a*, 518*b*, and 518*c* disengage from the through holes 522*a*, 522*b*, and 522*c*. Then, the user slides the wheel cover 504 upward with respect to the bearing box 10 such that the cover mounting portion 60 is located inside the band portion 522 of the cover main body 506. In this way, the wheel cover 504 is attached to the cover mounting portion 60 as shown in FIG. 38. Then, when the slidable member 508 is slid upward with respect to the cover main body 506 by the biasing force of the compression spring 510, the lock balls 518*a*, 518*b*, and 518*c* are inserted into the through holes 522*a*, 522*b*, and 522*c*, and a part of each of the lock balls 518*a*, 518*b*, and 518*c* is inserted into the guide groove 62 as shown in FIG. 36. In this state, the lock balls 518*a*, 518*b*, and 518*c* are engaged with the flange 64, thus the downward slide of the wheel cover 504 with respect to the bearing box 10 is prohibited.

The wheel cover 504 attached to the bearing box 10 is rotatable about the cover mounting portion 60. In other words, the wheel cover 504 is rotatable about the rotation axis direction of the spindle 38 (i.e., the up-down direction) with respect to the bearing box 10. When the wheel cover 504 is rotated with respect to the bearing box 10, the lock balls 518*a*, 518*b*, and 518*c* slide in the guide groove 62. In this case as well, the lock balls 518*a*, 518*b*, and 518*c* engages with the flange 64, thus the downward slide of the wheel cover 504 with respect to the bearing box 10 is prohibited.

When the user rotates the wheel cover 504 with respect to the bearing box 10 to align the lock portion 512*a* of the rotatable member 512 with one of the plurality of engagement grooves 62*a* of the cover mounting portion 60 and releases the hand from the rotatable member 512, the lock portion 512*a* of the rotatable member 512 is inserted into the engagement groove 62*a* by the biasing force of the torsion spring 516. In this state, the rotation of the wheel cover 504 with respect to the bearing box 10 is prohibited and the wheel cover 504 is fixed to the bearing box 10. To change the rotational angle of the wheel cover 504 with respect to the bearing box 10, the user pushes the manipulatable portion 512*b* of the rotatable member 512 to disengage the lock portion 512*a* of the rotatable member 512 from the engagement groove 62*a*, as a result of which the wheel cover 504 can be rotated with respect to the bearing box 10. By appropriately selecting which engagement groove 62*a* the lock portion 512*a* of the rotatable member 512 is to be inserted into, a rotation angle at which the wheel cover 504 is secured to the bearing box 10 can be selected.

When the wheel cover 504 is to be detached from the cover mounting portion 60, the user pushed the manipulatable portion 512*b* of the rotatable member 512 and slide the slidable member 508 downward with respect to the cover main body 506. As a result, the lock portion 512*a* of the rotatable member 512 disengages from the through holes 522*d* and 530*d* and the lock balls 518*a*, 518*b*, and 518*c* disengage from the through holes 522*a*, 522*b*, and 522*c* as shown in FIG. 38. Then, the user slides the wheel cover 504 downward with respect to the bearing box 10. In this way, the wheel cover 504 can be detached from the cover mounting portion 60.

In the present embodiment, the grinder 502 (an example of the electric power tool) comprises the motor 14; the bevel gear 40 (an example of the power transmission mechanism) connected to the motor 14; the housing 50 that houses the motor 14 and the bevel gear 40; the spindle 38 (an example of the tip tool holder) connected to the bevel gear 40; the wheel cover 504 (an example of the cover) covering at least a part of the spindle 38; the first locking mechanism 536 configured to switch between a first locking state and a first unlocked state, wherein the first locking mechanism 536 switches from the first locking state to the first unlocked state in response to a first unlocking operation by the user; and the second locking mechanism 538 configured to switch between a second locking state and a second unlocked state, wherein the second locking mechanism 538 switches from the second locking state to the second unlocked state in response to a second unlocking operation by the user. In the grinder 502, the wheel cover 504 becomes detachable from the housing 50 when the user performs the second unlocking operation on the second locking mechanism 538 and the first unlocking operation on the first locking mechanism 536.

According to the above configuration, the wheel cover 504 will not be detached from the housing 50 unless the first unlocking operation is performed on the first locking mechanism 536 and the second unlocking operation is performed on the second locking mechanism 538. Therefore, even when the first unlocking operation is accidentally performed on the first locking mechanism 536, the wheel cover 504 cannot be detached from the housing 50 unless the second unlocking operation is performed on the second locking mechanism 538. On the contrary, even when the second unlocking operation is accidentally performed on the second locking mechanism 538, the wheel cover 504 cannot be detached from the housing 50 unless the first unlocking operation is performed on the first locking mechanism 536. According to the above configuration, it is possible to reliably prevent the wheel cover 504 from being unintentionally detached from the housing 50.

In the present embodiment, the first locking mechanism 536 is configured to prohibit the wheel cover 504 from rotating with respect to the housing 50 and being detached from the housing 50 in the first locking state, and allow the wheel cover 504 to rotate with respect to the housing 50 and be detached from the housing 50 in the first unlocked state. The second locking mechanism 538 is configured to prohibit the wheel cover 504 from being detached from the housing 50 in the second locking state, and allow the wheel cover 504 to be detached from the housing 50 in the second unlocked state.

The above configuration can reliably prevent the wheel cover 504 from being unintentionally detached from the housing 50 as well as fix the rotational angle of the wheel cover 504 with respect to the housing 50.

In the present embodiment, the housing 50 includes the plurality of engagement grooves 62*a* (example of the engaged portions) arranged circumferentially about the rotation axis of the spindle 38. The first locking mechanism 536 includes the rotatable member 512 (an example of the first rotatable member) rotatably supported by the wheel cover 504. The rotatable member 512 includes the lock portion 512*a* (an example of the engagement portion) configured to engage with any one of the engagement grooves 62*a*. When the first locking mechanism 536 is in the first locking state, the rotatable member 512 is at a first locking angle at which the lock portion 512*a* engages with one of the engagement grooves 62*a*. When the first locking mechanism 536 is in the first unlocked state, the rotatable member 512 is at a first unlocked angle at which the lock portion 512*a* does not engage with any of the engagement grooves 62*a*. In response to the first unlocking operation by the user, the rotatable member 512 rotates from the first locking angle to the first unlocked angle.

The above configuration enables the first locking mechanism 536 with the simple configuration to realize both fixation of the rotational angle of the wheel cover 504 with respect to the housing 50 and prevention of detachment of the wheel cover 504 from the housing 50.

In the present embodiment, the second locking mechanism 538 includes the slidable member 508 (an example of the second slidable member) supported by the wheel cover 504 so as to be movable in a second sliding direction (e.g., the up-down direction) that is substantially parallel to the rotation axis of the spindle 32; and the lock balls 518*a*, 518*b*, and 518*c* (example of the ball member) supported by the slidable member 508 and configured to engage with the housing 50. When the second locking mechanism 538 is in the second locking state, the slidable member 508 is at a second locking position at which the lock balls 518*a*, 518*b*, and 518*c* engage with the housing 50. When the second locking mechanism 538 is in the second unlocked state, the slidable member 508 is at a second unlocked position at which the lock balls 518*a*, 518*b*, and 518*c* do not engage with the housing 50. In response to the second unlocking operation by the user, the slidable member 508 moves from the second locking position to the second unlocked position.

The above-described configuration enables the second locking mechanism 538 with the simple configuration to prevent the wheel cover 504 from being detached from the housing 50.

Seventh Embodiment

A grinder 602 according to the present embodiment has substantially the same configuration as the grinder 2 according to the first embodiment. Hereinafter, regarding the grinder 602 according to the present embodiment, differences from the grinder 2 according to the first embodiment will be described.

Figure 39:
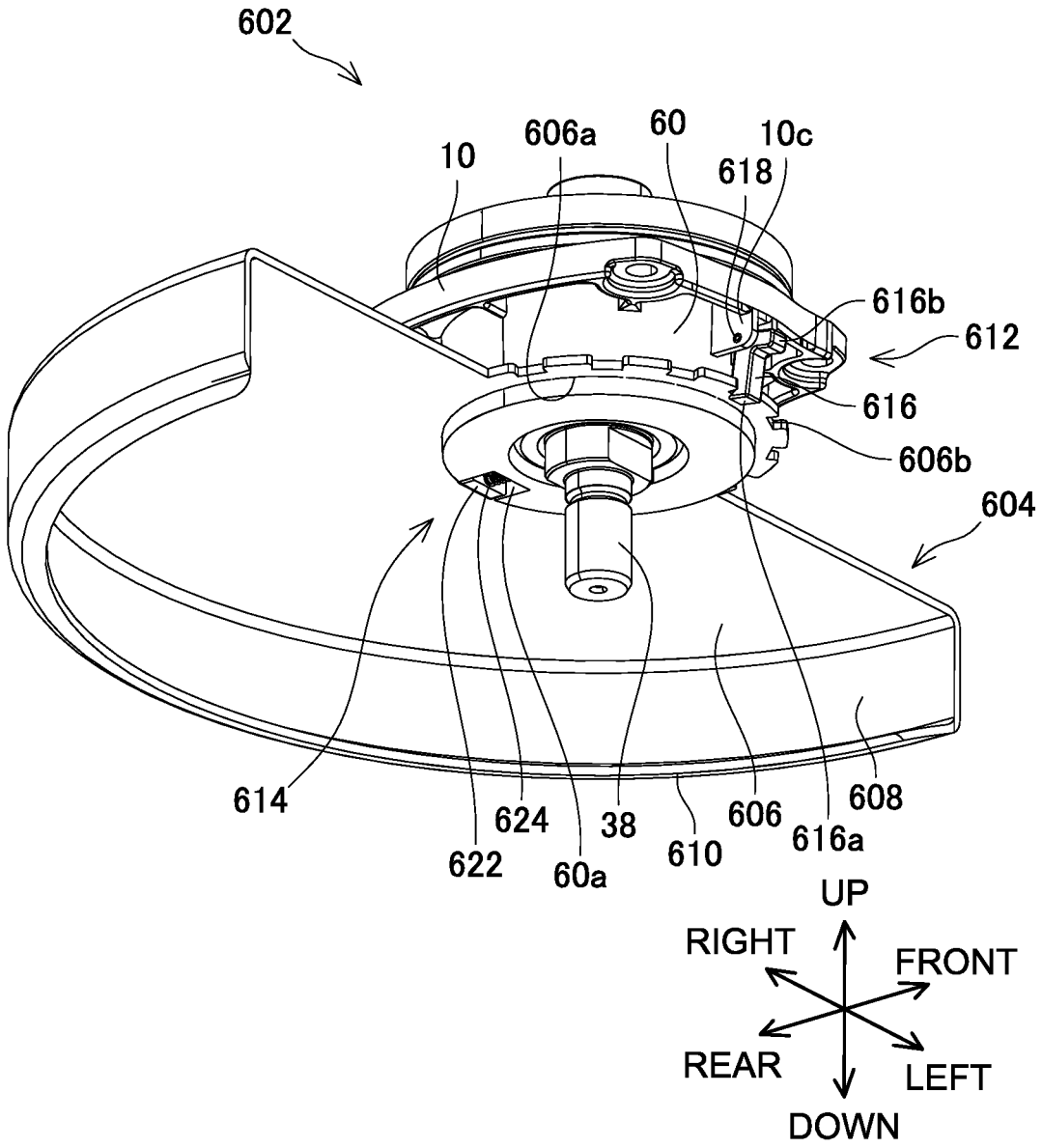
FIG. 39 is a perspective view of a front portion of a grinder 602 according to a seventh embodiment, when seen from front-lower-right side.

As shown in FIG. 39, the grinder 602 according to the present embodiment includes a wheel cover 604 instead of the wheel cover 12. In FIG. 39, the motor housing 4, the gear housing 8, etc. of the grinder 602 are not shown.

Figure 40:
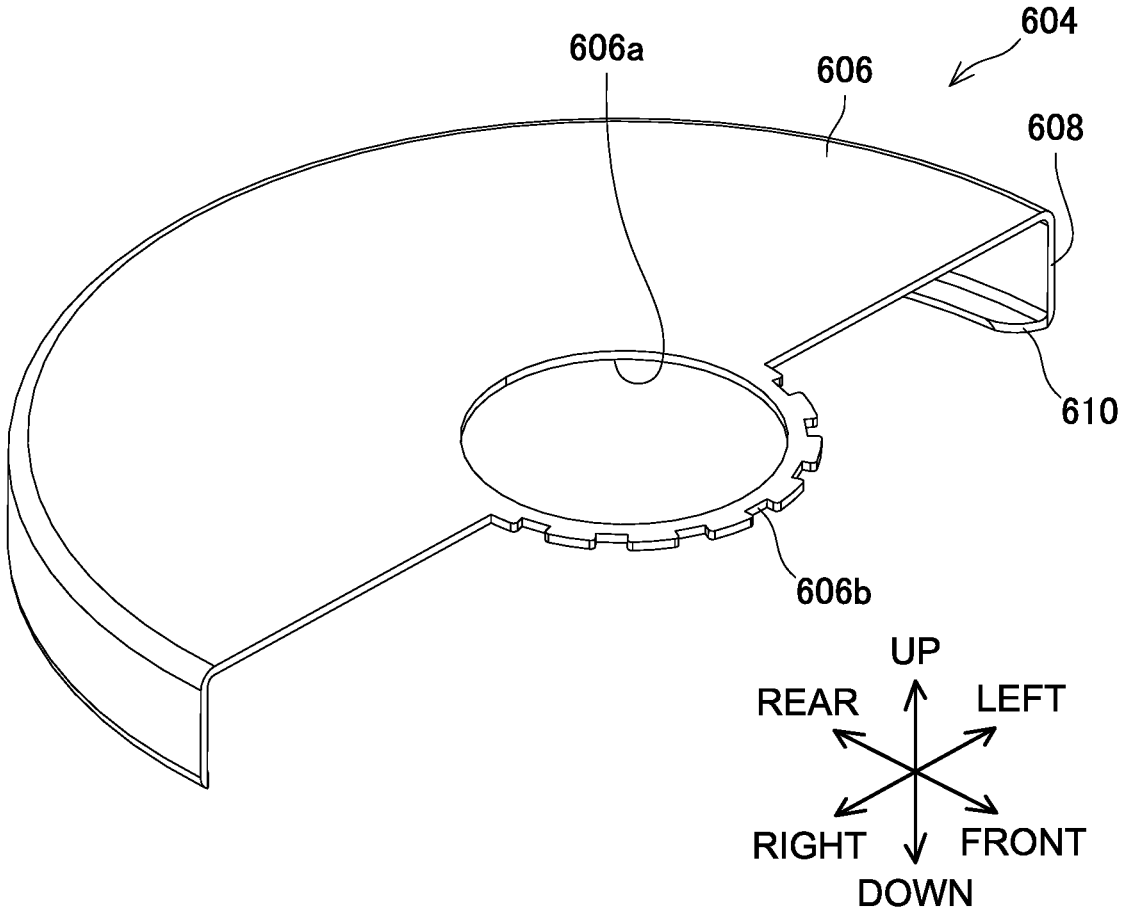
FIG. 40 is a perspective view of a wheel cover 604 of the grinder 602 according to the seventh embodiment.

As shown in FIG. 40, the wheel cover 604 includes an upper surface portion 606, a side surface portion 608, and a narrowing portion 610. The upper surface portion 606 has a partially cut-out disc shape. A circular through hole 606*a* through which the cover mounting portion 60 of the bearing box 10 passes and a plurality of engagement grooves 606*b* disposed at predetermined angular intervals are formed in the upper surface portion 606. The side surface portion 608 has a substantially semi-cylindrical shape extending downward from an outer end of the upper surface portion 606. The narrowing portion 610 is bent inward from a lower end of the side surface portion 608.

Figure 41:
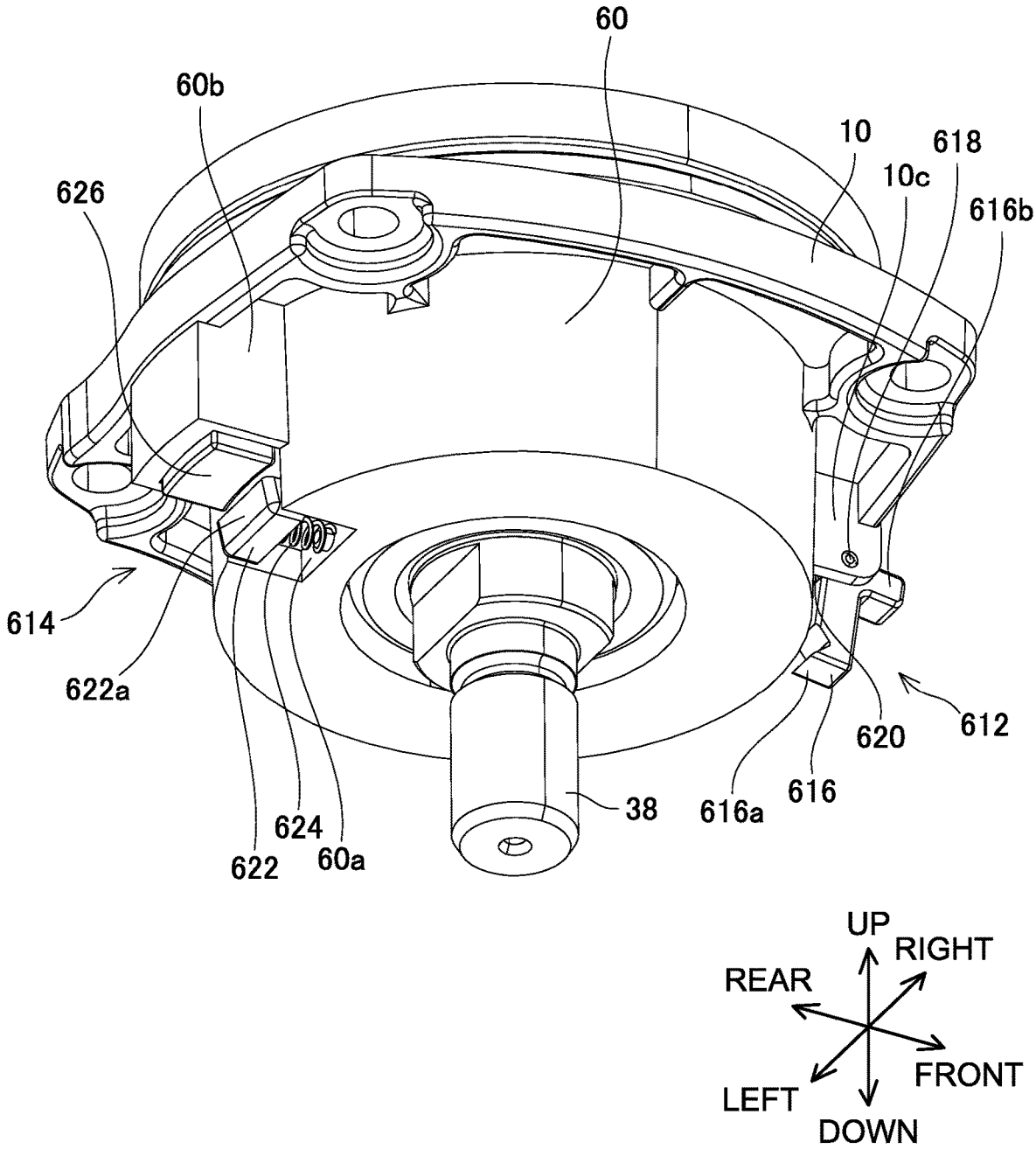
FIG. 41 is a perspective view of a structure around the cover mounting portion 60 of the grinder 602 according to the seventh embodiment, when seen from rear-lower-right side.

As shown in FIG. 41, in the grinder 602 according to the present embodiment, the guide groove 62 and the flange 64 are not formed in the cover mounting portion 60 of the bearing box 10. In the grinder 602 according to the present embodiment, a first locking mechanism 612 is disposed at the front portion of the bearing box 10, and a second locking mechanism 614 is disposed at the rear portion of the cover mounting portion 60.

The first locking mechanism 612 includes a rotatable member 616, a hinge pin 618, and a torsion spring 620. The rotatable member 616 includes a lock portion 616*a* and a manipulatable portion 616*b*. The rotatable member 616 is rotatably supported by a bearing portion 10*c* of the bearing box 10 via the hinge pin 618 having a longitudinal direction in the right-left direction. The torsion spring 620 bias the rotatable member 616 with respect to the bearing box 10 in a rotation direction along which the lock portion 616*a* of the rotatable member 616 is moved inward.

Figure 42:
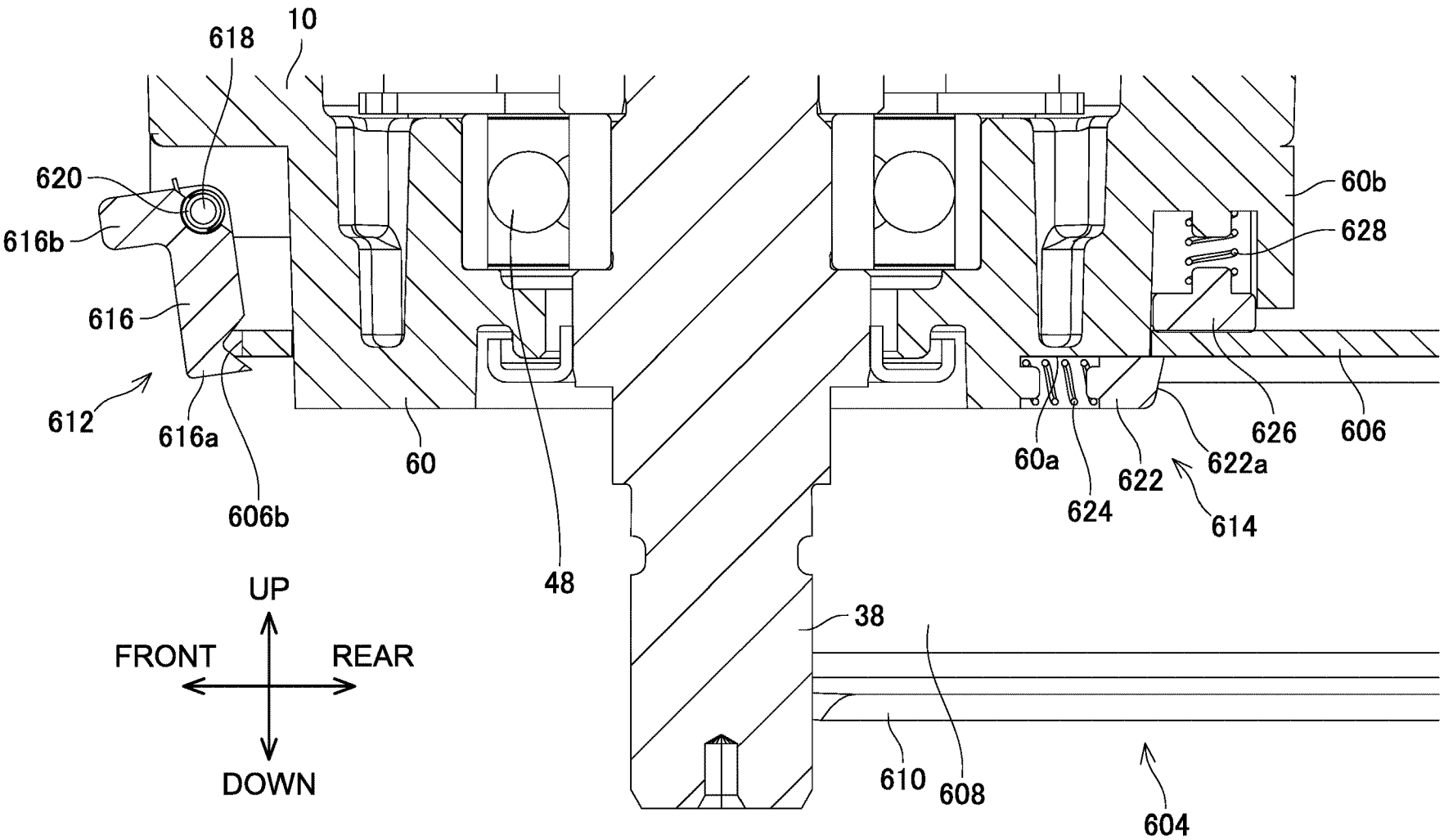
FIG. 42 is a longitudinal sectional view of the front portion of the grinder 602 according to the seventh embodiment in the state where a rotatable member 616 is engaged with the wheel cover 604 and a slidable member 622 and a pressing member 626 sandwich the wheel cover 604.
Figure 43:
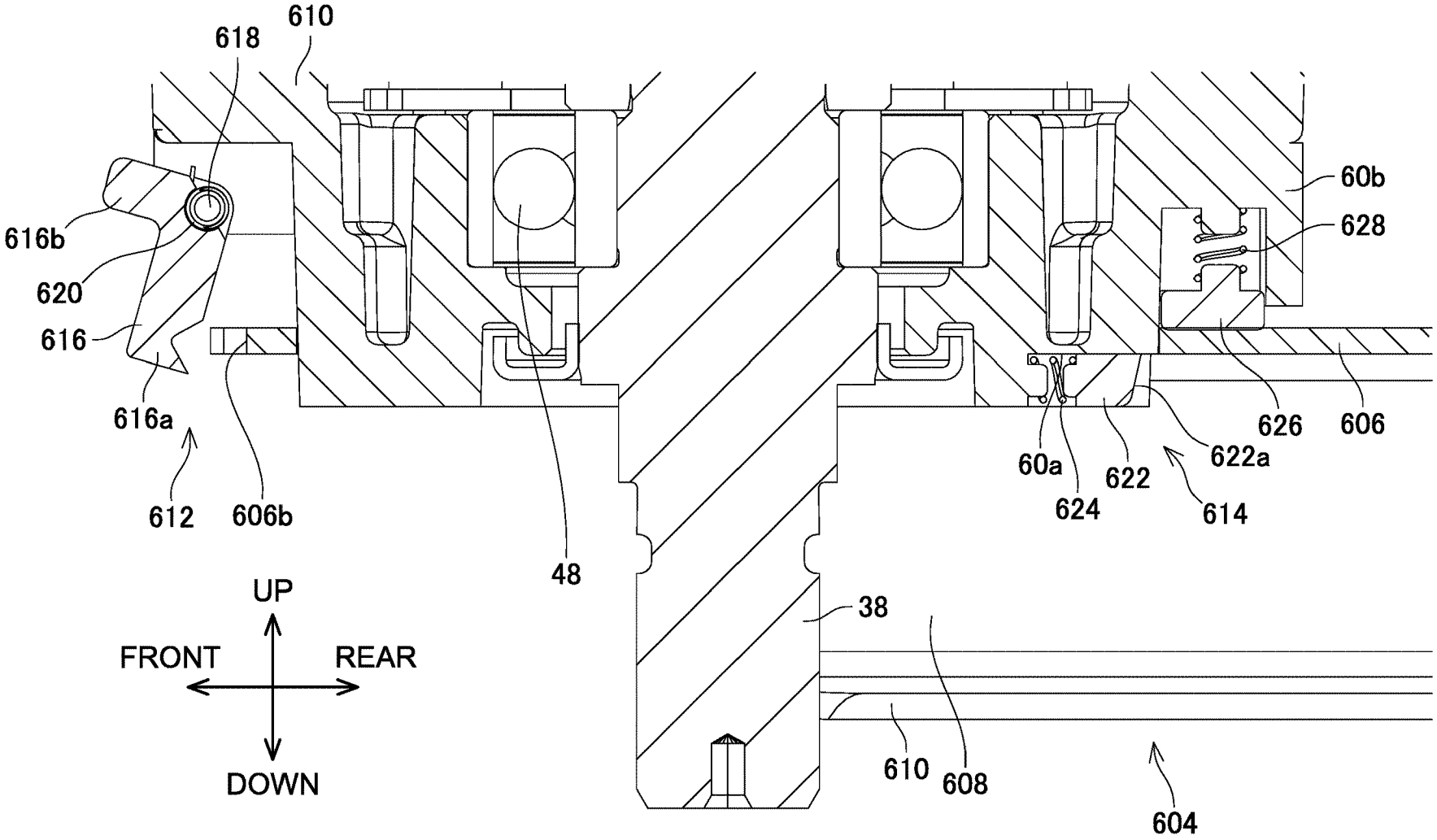
FIG. 43 is a longitudinal sectional view of the front portion of the grinder 602 according to the seventh embodiment in the state where the rotatable member 616 is not engaged with the wheel cover 604 and the slidable member 622 and the pressing member 626 do not sandwich the wheel cover 604.
Figure 44:
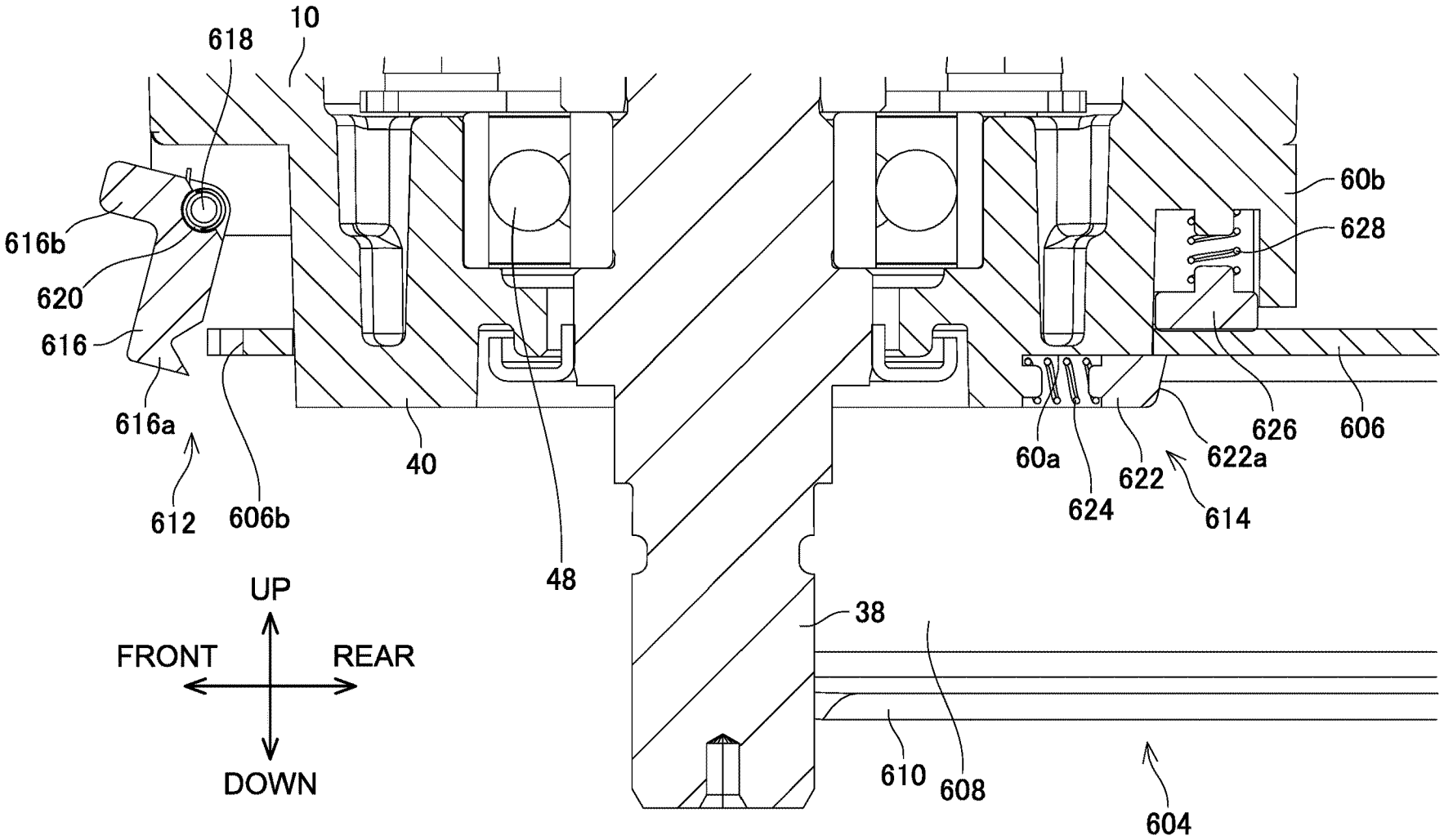
FIG. 44 is a longitudinal sectional view of the front portion of the grinder 602 according to the seventh embodiment in the state where the rotatable member 616 is not engaged with the wheel cover 604 and the slidable member 622 and the pressing member 626 sandwich the wheel cover 604.

The second locking mechanism 614 includes a slidable member 622, a compression spring 624, a pressing member 626, and a compression spring 628 (see FIGS. 42 to 44). The slidable member 622 and the compression spring 624 are disposed in an accommodation groove 60*a* formed in the rear portion of the cover mounting portion 60 near its lower end. The pressing member 626 and the compression spring 628 are disposed in an accommodation portion 60*b* located at the rear portion of the cover mounting portion 60. The slidable member 622 has a substantially trapezoidal prism shape having an inclined surface 622*a* at the rear and is attached to the cover mounting portion 60 such that the slidable member 622 is slidable in the front-rear direction with respect to the cover mounting portion 60. The compression spring 624 is disposed in the accommodation groove 60*a* and biases the slidable member 622 rearward with respect to the cover mounting portion 60. The pressing member 626 has a substantially rectangular parallelepiped shape and is attached to the cover mounting portion 60 such that the pressing member 626 is slidable in the up-down direction with respect to the cover mounting portion 60. The compression spring 628 is disposed in the accommodation portion 60*b* and biases the pressing member 626 downward with respect to the bearing box 10.

As shown in FIGS. 39 and 42, in the grinder 602 according to the present embodiment, the lock portion 616*a* of the rotatable member 616 of the first locking mechanism 612 is engaged with one of the plurality of engagement grooves 606*b* of the wheel cover 604 in the state where the wheel cover 604 is attached to the cover mounting portion 60. In this state, the downward slide of the wheel cover 604 with respect to the bearing box 10 and the rotation of the wheel cover 604 with respect to the bearing box 10 are prohibited. Further, in the grinder 602 according to the present embodiment, the slidable member 622 and the pressing member 626 of the second locking mechanism 614 sandwich the upper surface portion 606 of the wheel cover 604 in the state where the wheel cover 604 is attached to the cover mounting portion 60. In this state, the downward slide of the wheel cover 604 with respect to the bearing box 10 is prohibited.

When the wheel cover 604 is to be attached to the cover mounting portion 60, the user pushes the manipulatable portion 616*b* of the rotatable member 616 upward to rotate the rotatable member 616. Then, the user slides the wheel cover 604 upward with respect to the bearing box 10 such that the cover mounting portion 60 passes the through hole 606*a* of the wheel cover 604. As a result, the edge of the through hole 606*a* of the wheel cover 604 contacts the inclined surface 622*a* of the slidable member 622. Then, when the user slides the wheel cover 604 further upward, the slidable member 622 is pushed forward and retracts into the portion 60 as shown in FIG. 43. In this state, the slidable member 622 is moved rearward by the biasing force of the compression spring 624 and the slidable member 622 and the pressing member 626 sandwich the upper surface portion 606 of the wheel cover 604 as shown in FIG. 44. In this state, the slidable member 622 is engaged with the upper surface portion 606; thus the downward slide of the wheel cover 604 with respect to the bearing box 10 is prohibited.

The upper surface portion 606 of the wheel cover 604 is slidable with respect to the slidable member 622 and the pressing member 626 when sandwiched by the slidable member 622 and the pressing member 626. Therefore, the wheel cover 604 attached to the bearing box 10 is rotatable about the cover mounting portion 60. In other words, the wheel cover 604 is rotatable about the rotation axis direction of the spindle 38 (i.e., the up-down direction) with respect to the bearing box 10.

When the user rotates the wheel cover 604 with respect to the bearing box 10 to align the lock portion 616*a* of the rotatable member 616 with one of the plurality of engagement grooves 606*b* of the wheel cover 604 and releases the hand from the rotatable member 616, the lock portion 616*a* of the rotatable member 616 is inserted into the engagement groove 606*b* by the biasing force of the torsion spring 620 as shown in FIG. 42. In this state, the rotation of the wheel cover 604 with respect to the bearing box 10 is prohibited and the wheel cover 604 is fixed to the bearing box 10. To change the rotational angle of the wheel cover 604 with respect to the bearing box 10, the user pushes the manipulatable portion 616*b* of the rotatable member 616 upward to disengage the lock portion 616*a* of the rotatable member 616 from the engagement groove 606*b*, as a result of which the wheel cover 604 can be rotated with respect to the bearing box 10. By appropriately selecting which engagement groove 606*b* the lock portion 616*a* of the rotatable member 616 is to be inserted into, a rotation angle at which the wheel cover 604 is fixed to the bearing box 10 can be selected.

When the wheel cover 604 is to be detached from the cover mounting portion 60, the user pushes the manipulatable portion 616*b* of the rotatable member 616 upward and moves the slidable member 622 forward. As a result, as shown in FIG. 43, the lock portion 616*a* of the rotatable member 616 disengages from the engagement groove 606*b* and the slidable member 622 retracts into the accommodation groove 60*a*. Then, the user slides the wheel cover 604 downward with respect to the bearing box 10. In this way, the wheel cover 604 can be detached from the cover mounting portion 60.

In the present embodiment, the grinder 602 (an example of the electric power tool) comprises the motor 14; the bevel gear 40 (an example of the power transmission mechanism) connected to the motor 14; the housing 50 that houses the motor 14 and the bevel gear 40; the spindle 38 (an example of the tip tool holder) connected to the bevel gear 40; the wheel cover 604 (an example of the cover) covering at least a part of the spindle 38; the first locking mechanism 612 configured to switch between a first locking state and a first unlocked state, wherein the first locking mechanism 612 switches from the first locking state to the first unlocked state in response to a first unlocking operation by the user; and the second locking mechanism 614 configured to switch between a second locking state and a second unlocked state, wherein the second locking mechanism 614 switches from the second looking state to the second unlocking state in response to a second unlocking operation by the user. In the grinder 602, the wheel cover 604 becomes detachable from the housing 50 when the user performs the second unlocking operation on the second locking mechanism 614 and the first unlocking operation on the first locking mechanism 612.

According to the above configuration, the wheel cover 604 will not be detached from the housing 50 unless the first unlocking operation is performed on the first locking mechanism 612 and the second unlocking operation is performed on the second locking mechanism 614. Therefore, even when the first unlocking operation is accidentally performed on the first locking mechanism 612, the wheel cover 604 cannot be detached from the housing 50 unless the second unlocking operation is performed on the second locking mechanism 614. On the contrary, even when the second unlocking operation is accidentally performed on the second locking mechanism 614, the wheel cover 604 cannot be detached from the housing 50 unless the first unlocking operation is performed on the first locking mechanism 612. According to the above configuration, it is possible to reliably prevent the wheel cover 604 from being unintentionally detached from the housing 50.

In the present embodiment, the first locking mechanism 612 is configured to prohibit the wheel cover 604 from rotating with respect to the housing 50 and being detached from the housing 50 in the first locking state, and allow the wheel 604 to rotate with respect to the housing 50 and be detached from the housing 50 in the first unlocked state. The second locking mechanism 614 is configured to prohibit the wheel cover 604 from being detached from the housing 50 in the second locking state, and allow the wheel cover 604 to be detached from the housing 50 in the second unlocked state.

The above configuration can reliably prevent the wheel cover 604 from being unintentionally detached from the housing 50 as well as fix the rotational angle of the wheel cover 604 with respect to the housing 50.

In the present embodiment, the wheel cover 604 includes the plurality of engagement grooves 606*b* (example of the engaged portions) arranged circumferentially about the rotation axis of the spindle 38. The first locking mechanism 612 includes the rotatable member 616 (an example of the first rotatable member) rotatably supported by the housing 50. The rotatable member 616 includes the lock portion 616*a* (an example of the engagement portion) configured to engage with one of the engagement grooves 606*b*. When the first locking mechanism 612 is in the first locking state, the rotatable member 616 is at a first locking angle at which the lock portion 616*a* engages with one of the engagement grooves 606*b*. When the first locking mechanism 612 is in the first unlocked state, the rotatable member 616 is at a first unlocked angle at which the lock portion 616*a* does not engage with any of the engagement grooves 606*b*. In response to the first unlocking operation by the user, the rotatable member 616 rotates from the first locking angle to the first unlocked angle.

The above configuration enables the first locking mechanism 612 with the simple configuration to realize both fixation of the rotational angle of the wheel cover 604 with respect to the housing 50 and prevention of detachment of the wheel cover 604 from the housing 50.

In the present embodiment, the second locking mechanism 614 includes the slidable member 622 (an example of the second slidable member) supported by the housing 50 so as to be movable in a second sliding direction (e.g., the front-rear direction) that is substantially orthogonal to the rotation axis of the spindle 38. When the second locking mechanism 614 is in the second locking state, the slidable member 622 is at a second locking position at which the slidable member 622 engages with the wheel cover 604. When the second locking mechanism 614 is in the second unlocked state, the slidable member 622 is at a second unlocked position at which the slidable member 622 does not engage with the wheel cover 604. In response to the second unlocking operation by the user, the slidable member 622 moves from the second locking position to the second unlocked position.

The above-described configuration enables the second locking mechanism 614 with the simple configuration to prevent the wheel cover 604 from being detached from the housing 50.

In the embodiments described above, the electric power tool is the grinder 2, 102, 202, 302, 402, 502, or 602, the power transmission mechanism is the bevel gear 40, the tip tool holder is the spindle 38, the tip tool is the grinding wheel GW, and the cover is the wheel cover 12, 406, 504, or 604. However, the electric power tool may be an electric power tool of another type, the power transmission mechanism may be a reduction mechanism of another type, the tip tool holder may be a tip tool holder of another type, the tip tool may be a tip tool of another type, and the cover may be a cover of another type.

No limitation is placed on the combination of the first locking mechanism 66, 104, 204, 408, 536, 612 and the second locking mechanism 74, 106, 206, 306, 410, 538, 614 described in the above embodiments. The first locking mechanism 66, 104, 204, 408, 536, or 612 in one of the embodiments may be combined with the second locking mechanism 74, 106, 206, 306, 410, 538, or 614 in another embodiment.

The invention claimed is:

1. An electric power tool, comprising:

a motor;

a power transmission mechanism connected to the motor;

a housing that houses the motor and the power transmission mechanism;

a tip tool holder connected to the power transmission mechanism;

a cover covering at least a part of the tip tool holder;

a first locking mechanism comprising a first member configured to switch between a first locking state and a first unlocked state, wherein the first member switches from the first locking state to the first unlocked state in response to a first unlocking operation by a user; and a second locking mechanism comprising a second member configured to switch between a second locking state and a second unlocked state, wherein the second member switches from the second locking state to the second unlocked state in response to a second unlocking operation by the user, wherein the cover becomes detachable from the housing when the user performs the second unlocking operation on the second member and the first unlocking operation on the first member, the first member is configured to prohibit the cover from being detached from the housing in the first locking state and to allow the cover to be detached from the housing in the first unlocked state, the second member is configured to prohibit the first member from switching from the first locking state to the first unlocked state in the second locking state and to allow the first member to switch from the first locking state to the first unlocked state in the second unlocked state, the first member includes a movable member supported by the housing so as to be movable, when the first member is in the first locking state, the movable member is at a first locking position at which the movable member engages with the cover, when the first member is in the first unlocked state, the movable member is at a first unlocked position at which the movable member does not engage with the cover, in response to the first unlocking operation by the user, the movable member moves from the first locking position to the first unlocked position, and the second member is configured to prohibit the movable member from moving from the first locking position to the first unlocked position in the second locking state and to allow the movable member to move from the first locking position to the first unlocked position in the second unlocked state.

2. The electric power tool according to claim 1, wherein the movable member includes a first slidable member supported by the housing so as to be movable in a first sliding direction that is substantially orthogonal to a rotation axis of the tip tool holder, when the first member is in the first locking state, the first slidable member is at a first locking position at which the first slidable member engages with the cover, when the first member is in the first unlocked state, the first slidable member is at a first unlocked position at which the first slidable member does not engage with the cover, in response to the first unlocking operation by the user, the first slidable member moves from the first locking position to the first unlocked position, and the second member is configured to prohibit the first slidable member from moving from the first locking position to the first unlocked position in the second locking state and to allow the first slidable member to move from the first locking position to the first unlocked position in the second unlocked state.

3. The electric power tool according to claim 2, wherein the cover includes a plurality of engaged portions arranged circumferentially about the rotation axis of the tip tool holder, the first slidable member includes an engagement portion configured to engage with any one of the engaged portions, and when the first member is in the first locking state, the first slidable member is at the first locking position at which the engagement portion engages with one of the engaged portions, when the first member is in the first unlocked state, the first slidable member is at the first unlocked position at which the engagement portion does not engage with any of the engaged portions, and in response to the first unlocking operation by the user, the first slidable member moves from the first locking position to the first unlocked position.

4. The electric power tool according to claim 2, wherein the second member includes a second rotatable member rotatably supported by the first slidable member, when the second member is in the second locking state, the second rotatable member is at a second locking angle at which the second rotatable member interferes with the housing when the first slidable member moves from the first locking position to the first unlocked position, when the second member is in the second unlocked state, the second rotatable member is at a second unlocked angle at which the second rotatable member does not interfere with the housing when the first slidable member moves from the first locking position to the first unlocked position, and in response to the second unlocking operation by the user, the second rotatable member rotates from the second locking angle to the second unlocked angle.

5. The electric power tool according to claim 2, wherein the second member includes a second slidable member supported by the housing so as to be movable in a plane orthogonal to the first sliding direction, when the second member is in the second locking state, the second slidable member is at a second locking position at which the second slidable member interferes with the first slidable member on a way from the first locking position to the first unlocked position, when the second member is in the second unlocked state, the second slidable member is at a second unlocked position at which the second slidable member does not interfere with the first slidable member on the way from the first locking position to the first unlocked position, and in response to the second unlocking operation by the user, the second slidable member moves from the second locking position to the second unlocked position.

6. The electric power tool according to claim 5, further comprising a switch member disposed on the housing, wherein when the user performs an ON operation on the switch member, power is supplied to the motor, when the user performs an OFF operation on the switch member, power supply to the motor is stopped, the second slidable member is configured to allow the ON operation on the switch member when the second slidable member is at the second locking position and to prohibit the ON operation on the switch member when the second slidable member is at the second unlocked position.

7. The electric power tool according to claim 5, further comprising a switch member disposed on the housing, wherein when the user performs an ON operation on the switch member, power is supplied to the motor, when the user performs an OFF operation on the switch member, power supply to the motor is stopped, the second slidable member is mechanically connected to the switch member, and the second unlocking operation is performed via the switch member.

8. An electric power tool, comprising:

a motor;

a power transmission mechanism connected to the motor;

a housing that houses the motor and the power transmission mechanism;

a tip tool holder connected to the power transmission mechanism;

a cover covering at least a part of the tip tool holder;

a first locking mechanism comprising a first member configured to switch between a first locking state and a first unlocked state, wherein the first member switches from the first locking state to the first unlocked state in response to a first unlocking operation by a user; and a second locking mechanism comprising a second member configured to switch between a second locking state and a second unlocked state, wherein the second member switches from the second locking state to the second unlocked state in response to a second unlocking operation by the user, wherein the cover becomes detachable from the housing when the user performs the second unlocking operation on the second member and the first unlocking operation on the first member, the first member is configured to prohibit the cover from rotating with respect to the housing and being detached from the housing in the first locking state and to allow the cover to rotate with respect to the housing and be detached from the housing in the first unlocked state, and the second member is configured to prohibit the cover from being detached from the housing in the second locking state and to allow the cover to be detached from the housing in the second unlocked state, the second member includes a movable member supported by the housing so as to be movable, when the second member is in the second locking state, the movable member is at a second locking position at which the movable member engages with the cover, when the second member is in the second unlocked state, the movable member is at a second unlocked position at which the movable member does not engage with the cover, and in response to the second unlocking operation by the user, the movable member moves from the second locking position to the second unlocked position.

9. The electric power tool according to claim 8, wherein the cover includes a band portion surrounding a part of the housing that is in a vicinity of the tip tool holder, the first member includes a first rotatable member rotatably supported by the band portion, when the first member is in the first locking state, the first rotatable member is at a first locking angle at which the first rotatable member presses the band portion against the housing, when the first member is in the first unlocked state, the first rotatable member is at a first unlocked angle at which the first rotatable member does not press the band portion against the housing, and in response to the first unlocking operation by the user, the first rotatable member rotates from the first locking angle to the first unlocked angle.

10. The electric power tool according to claim 8, wherein the housing includes a plurality of engaged portions arranged circumferentially about a rotation axis of the tip tool holder, the first member includes a first rotatable member rotatably supported by the cover, the first rotatable member includes an engagement portion configured to engage with any one of the engaged portions, when the first member is in the first locking state, the first rotatable member is at a first locking angle at which the engagement portion engages with one of the engaged portions, when the first member is in the first unlocked state, the first rotatable member is at a first unlocked angle at which the engagement portion does not engage with any of the engaged portions, and in response to the first unlocking operation by the user, the first rotatable member rotates from the first locking angle to the first unlocked angle.

11. The electric power tool according to claim 8, wherein the cover includes a plurality of engaged portions arranged circumferentially about a rotation axis of the tip tool holder, the first member includes a first rotatable member rotatably supported by the housing, the first rotatable member includes an engagement portion configured to engage with any one of the engaged portions, when the first member is in the first locking state, the first rotatable member is at a first locking angle at which the engagement portion engages with one of the engaged portions, when the first member is in the first unlocked state, the first rotatable member is at a first unlocked angle at which the engagement portion does not engage with any of the engaged portions, and in response to the first unlocking operation by the user, the first rotatable member rotates from the first locking angle to the first unlocked angle.

12. The electric power tool according to claim 8, wherein the movable member includes a second slidable member supported by the housing so as to be movable in a second sliding direction that is substantially orthogonal to a rotation axis of the tip tool holder, when the second member is in the second locking state, the second slidable member is at a second locking position at which the second slidable member engages with the cover, when the second member is in the second unlocked state, the second slidable member is at a second unlocked position at which the second slidable member does not engage with the cover, and in response to the second unlocking operation by the user, the second slidable member moves from the second locking position to the second unlocked position.

13. The electric power tool according to claim 8, wherein the movable member includes a second rotatable member rotatably supported by the housing, when the second member is in the second locking state, the second rotatable member is at a second locking angle at which the second rotatable member engages with the cover, when the second member is in the second unlocked state, the second rotatable member is at a second unlocked angle at which the second rotatable member does not engage with the cover, and in response to the second unlocking operation by the user, the second rotatable member rotates from the second locking angle to the second unlocked angle.

14. The electric power tool according to claim 13, wherein the second rotatable member is supported by the housing so as to be rotatable about a rotation axis extending in a direction substantially orthogonal to the rotation axis of the tip tool holder, the second locking mechanism further includes a second biasing member configured to bias the second rotatable member in a direction from the second unlocked angle to the second locking angle, and the second rotatable member includes a protrusion configured to engage with the cover and a manipulatable portion integrally formed with the protrusion.

15. The electric power tool according to claim 8, wherein the cover includes a plurality of engaged portions arranged circumferentially about a rotation axis of the tip tool holder, the first member includes a first slidable member supported by the housing so as to be movable in a first sliding direction that is substantially orthogonal to the rotation axis of the tip tool holder, the first slidable member includes an engagement portion configured to engage with any one of the engaged portions, when the first member is in the first locking state, the first slidable member is at a first locking position at which the engagement portion engages with one of the engaged portions, when the first member is in the first unlocked state, the first slidable member is at a first unlocked position at which the engagement portion does not engage with any of the engaged portions, and in response to the first unlocking operation by the user, the first slidable member moves from the first locking position to the first unlocked position.

16. The electric power tool according to claim 15, wherein the first locking mechanism further includes a first biasing member configured to bias the first slidable member in a direction from the first unlocked position to the first locking position.

17. The electric power tool according to claim 16, wherein the first slidable member includes:

a base portion extending in the first sliding direction;

a manipulatable portion disposed at one end of the base portion;

an elongated hole located at the base portion and having a longitudinal direction in the first sliding direction;

a support portion disposed at another end of the base portion and supporting the engagement portion; and a protrusion disposed at the base portion and configured to be biased by the first biasing member, and the first slidable member is supported by the housing via a support member penetrating the elongated hole.

18. An electric power tool, comprising:

a motor;

a power transmission mechanism connected to the motor;

a housing that houses the motor and the power transmission mechanism;

a tip tool holder connected to the power transmission mechanism;

a cover covering at least a part of the tip tool holder;

a first locking mechanism comprising a first member configured to switch between a first locking state and a first unlocked state, wherein the first member switches from the first locking state to the first unlocked state in response to a first unlocking operation by a user; and a second locking mechanism comprising a second member configured to switch between a second locking state and a second unlocked state, wherein the second member switches from the second locking state to the second unlocked state in response to a second unlocking operation by the user, wherein the cover becomes detachable from the housing when the user performs the second unlocking operation on the second member and the first unlocking operation on the first member, the first member is configured to prohibit the cover from rotating with respect to the housing and being detached from the housing in the first locking state and to allow the cover to rotate with respect to the housing and be detached from the housing in the first unlocked state, the second member is configured to prohibit the cover from being detached from the housing in the second locking state and to allow the cover to be detached from the housing in the second unlocked state, the second member includes a second slidable member supported by the cover so as to be movable in a second sliding direction that is substantially orthogonal to a rotation axis of the tip tool holder, the second slidable member includes an engagement portion configured to engage with the housing, when the second member is in the second locking state, the second slidable member is at a second locking position at which the engagement portion of the second slidable member engages with the housing, when the second member is in the second unlocked state, the second slidable member is at a second unlocked position at which the engagement portion of the second slidable member does not engage with the housing, and in response to the second unlocking operation by the user, the second slidable member moves from the second locking position to the second unlocked position.

19. An electric power tool, comprising:

a motor;

a power transmission mechanism connected to the motor;

a housing that houses the motor and the power transmission mechanism;

a tip tool holder connected to the power transmission mechanism;

a cover covering at least a part of the tip tool holder;

a first locking mechanism comprising a first member configured to switch between a first locking state and a first unlocked state, wherein the first member switches from the first locking state to the first unlocked state in response to a first unlocking operation by a user; and a second locking mechanism comprising a second member configured to switch between a second locking state and a second unlocked state, wherein the second member switches from the second locking state to the second unlocked state in response to a second unlocking operation by the user, wherein the cover becomes detachable from the housing when the user performs the second unlocking operation on the second member and the first unlocking operation on the first member, the first member is configured to prohibit the cover from rotating with respect to the housing and being detached from the housing in the first locking state and to allow the cover to rotate with respect to the housing and be detached from the housing in the first unlocked state, the second member is configured to prohibit the cover from being detached from the housing in the second locking state and to allow the cover to be detached from the housing in the second unlocked state, the second member includes a second slidable member supported by the cover so as to be movable in a second sliding direction that is substantially parallel to a rotation axis of the tip tool holder, the second locking mechanism includes a ball member supported by the second slidable member and configured to engage with the housing, when the second member is in the second locking state, the second slidable member is at a second locking position at which the ball member engages with the housing, when the second member is in the second unlocked state, the second slidable member is at a second unlocked position at which the ball member does not engage with the housing, and in response to the second unlocking operation by the user, the second slidable member moves from the second locking position to the second unlocked position.

* * * * *